US006448954B1

(12) United States Patent
Katoh et al.

(10) Patent No.: US 6,448,954 B1
(45) Date of Patent: Sep. 10, 2002

(54) ACTIVE MATRIX DISPLAY DEVICE AND SCANNING CIRCUIT

(75) Inventors: Kenichi Katoh, Hiroshima (JP); Yasushi Kubota, Nara (JP); Hidehiko Chimura, Nagano (JP); Jun Koyama, Kanagawa (JP)

(73) Assignees: Semiconductor Energy Laboratory Co., Ltd., Kanagawa-Ken (JP); Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/420,893

(22) Filed: Oct. 19, 1999

Related U.S. Application Data

(62) Division of application No. 08/744,054, filed on Nov. 5, 1996, now Pat. No. 6,011,535.

(30) Foreign Application Priority Data

Nov. 6, 1995 (JP) ..... 7-311605
Nov. 17, 1995 (JP) ..... 7-300331

(51) Int. Cl.[7] ..... G09G 3/36

(52) U.S. Cl. ..... 345/100; 345/98; 345/100; 345/206

(58) Field of Search ..... 345/206, 87, 92, 345/94, 98, 99, 100, 208, 212, 213

(56) References Cited

U.S. PATENT DOCUMENTS 4,264,872 A * 4/1981 Suzuki ..... 330/253
4,396,845 A * 8/1983 Nakano ..... 326/70
5,222,082 A * 6/1993 Plus ..... 377/79
5,410,583 A * 4/1995 Weisbrod et al. ..... 377/75
5,434,899 A * 7/1995 Huq et al. ..... 377/78
5,517,542 A * 5/1996 Huq ..... 377/78
5,517,543 A * 5/1996 Schleupen et al. ..... 377/79
5,559,452 A * 9/1996 Saito ..... 326/88
5,563,624 A * 10/1996 Imamura ..... 345/100
5,600,345 A * 2/1997 Dingwall et al. ..... 345/100
5,614,923 A * 3/1997 Gatou et al. ..... 345/98
5,635,950 A * 6/1997 Okada et al. ..... 345/204
5,646,642 A 7/1997 Maekawa et al.
5,686,935 A * 11/1997 Weisbrod ..... 345/100
5,708,455 A * 1/1998 Maekawa ..... 345/100
5,712,653 A 1/1998 Katoh et al.
5,726,678 A * 3/1998 Dingwall ..... 345/100
5,748,026 A 5/1998 Maekawa et al.
6,064,364 A 5/2000 Katoh et al.

FOREIGN PATENT DOCUMENTS

| | | |
|---|---|---|
| JP | 3-107994 | 5/1991 |
| JP | 3-287291 | 12/1991 |
| JP | 6-216753 | 8/1994 |
| JP | 7-191636 | 7/1995 |
| JP | 9-006278 | 1/1997 |

* cited by examiner

*Primary Examiner*—Kent Chang
(74) *Attorney, Agent, or Firm*—Fish & Richardson P.C.

(57) ABSTRACT

An active matrix display device has a number of pixels arranged in matrix form, signal lines for supplying display signals to the pixels, and a driver circuit for driving the signal lines. The driver circuit includes a frequency divider circuit for frequency-dividing input multi-phase clock signals, a synchronous counter circuit for frequency-dividing part of the input multi-phase clock signals, and a decoder circuit for selecting a desired one of the signal lines based on outputs of the frequency divider circuit and the synchronous counter circuit.

15 Claims, 35 Drawing Sheets

ACTIVE MATRIX DISPLAY DEVICE AND SCANNING CIRCUIT

This is a divisional of U.S. application Ser. No. 08/744,054, filed Nov. 5, 1996, now U.S. Pat. No. 6,011,535.

BACKGROUND OF THE INVENTION

1. Field of the Invention

The present invention relates to an active matrix display device and, more specifically, to an active matrix display device incorporating driver circuits.

2. Description of the Related Art

The active matrix display device means a display device in which as shown in FIG. 20 pixels are arranged at intersections of a matrix and each pixel is provided with a switching element, and pixel information is controlled by on/off switching of the switching element. The active matrix display device uses a liquid crystal 1 as a display medium. In the invention, a thin-film transistor 2, which is a three-terminal device having the gate, source, and drain, is used as the switching element.

In the matrix, the term "row" means a structure in which a scanning line (gate line) 3 extending parallel with the associated row is connected to the gate electrodes of thin-film transistors 2 of the associated row. The term "column" means a structure in which a signal line (source line) 4 extending parallel with the associated column is connected to the sources (or drains) of thin-film transistors 2 of the associated column. The circuit for driving the scanning lines 3 is called a scanning line driver circuit, and the circuit for driving the signal lines 4 is called a signal line driver circuit. The thin-film transistor is abbreviated as "TFT".

FIGS. 21A and 21B show a first example of a conventional active matrix liquid crystal display device. Reference numerals 11 denotes an amorphous TFT active matrix, and numerals 12 and 13 denote single crystal silicon driver circuit ICs.

In this active matrix liquid crystal display device, the TFTs are formed by using amorphous silicon, the scanning line and signal line driver circuits are single crystal silicon integrated circuits and are mounted around a glass substrate by means of tabs (see FIG. 21A) or by using a COG (chip on glass) technique (see FIG. 21B).

This type of liquid crystal display device has the following problems.

First, there is a reliability problem because the signal lines and the scanning lines are connected to the active matrix via tabs or bonding wires. For example, in the case of a VGA (video graphic display) display device, the number of signal lines is 1,920 and the number of scanning lines is 480. These numbers are increasing year by year with the increase in resolution.

Second, in the case of producing a view finder for a video camera or a liquid crystal projector, a compact display device is needed. However, for these purposes, a liquid crystal display device using tabs is disadvantageous in terms of a space occupied by it.

To solve the above problems, an active matrix liquid crystal display device using polysilicon TFTs has been developed. FIG. 22 shows its example. In this display device, by using polysilicon TFTs, a signal line driver circuit 17 and a scanning line driver circuit 18 are formed on a glass substrate 15 at the same time as pixel TFTs that constitute an active matrix 16. The polysilicon TFTs are formed either by a high-temperature polysilicon process in which elements are formed on a quartz substrate by a process of higher than 1,000° C., or by a low-temperature process in which elements are formed on a glass substrate by a process of lower than 600° C.

The polysilicon TFT can attain a mobility of larger than 30 $cm^2/V.s$ and can operate with a signal of about several megahertz in contrast to the fact that the mobility of the amorphous silicon TFT is about 0.5 $cm^2/V.s$.

Driver circuits for driving an active matrix liquid crystal display device are classified into a digital type and an analog type. Since the number of elements needed in a digital driver circuit is much larger than in an analog driver circuit, driver circuits using polysilicon TFTs generally employ an analog scheme. Further, each of the scanning line driver circuit and the signal line driver circuit may be configured in two different ways, that is, by using a shift register or a decoder.

A driver circuit using a shift register will be described first.

FIG. 23 is a block diagram of a shift register. In a commonly used configuration of a shift register 20, a D-type flip-flop (hereinafter abbreviated as "DFF") 21 is formed by combining clocked inverters and inverters. FIGS. 24A–24E show an example of a DFF. Specifically, FIG. 24A shows a circuit configuration of a DFF, FIGS. 24B and 24D show a circuit configuration of a clocked inverter 25 that is a component of the DFF, and FIGS. 24C and 24E show a circuit configuration of an inverter 26 that is another component. There is another type of DFF which uses transmission gates.

Referring to FIGS. 25A and 25B, a description will be made of a signal line driver circuit that is formed by combining a shift register, inverter-type buffers, and transmission gates (hereinafter referred to as "TM gates").

A start pulse (SP) and clocks (CL and /CL) are input to the first stage of a shift register. FIGS. 25A and 25B are a block diagram and a timing chart of the signal line driver circuit. In FIG. 25B, waveforms at points A–F in FIG. 25A are shown and t1–t8 denote time periods.

Each of periods t1–t8 is a half of the clock pulse cycle. The start pulse changes from High to Low in period t1. Since a clocked inverter 31 performs an inverter operation, a waveform at point A has a phase opposite to the phase of the start pulse. The phase of a waveform at point B is further reversed.

During period t2, the clock inverter 31 is rendered non-operating and a clocked inverter 32 operates as an inverter. As a result, at point A, the final state of period t1, i.e., Low, is maintained. At point B, where the phase is opposite to the phase at point A, the final state of period t1, i.e., High, is maintained. A clocked inverter 33 operates during period t2. As a result, Low, i.e., an opposite phase to the phase at point B, appears at point C, and High, i.e., the same phase as at point B, appears at point D.

Next, during period t3, clocked inverters 31, 34 and 35 operate and clocked inverters 32, 33 and 36 are rendered non-operating. As a result, Low, which is the same as the sate of the input start pulse, appears at point B, and the final state of period t2, i.e., High, is maintained at point D. At point F, where the phase is the same as at point D, High is maintained.

Next, during period t4, the clocked inverters 31, 34 and 35 are rendered non-operating and the clocked inverters 32, 33 and 36 operate. As a result, Low appears at points B and D, and High appears at point F. The shift register using the DFFs operates in the above manner (see FIG. 25B) to transfer signals sequentially. In FIG. 25A, reference numerals 37–39 denote clocked inverters, 52 denotes a video signal line, and 53–55 denote signal lines.

Outputs of the respective stages at points B, D and F are transferred to TM gates 49–51 via inverter-type buffers 40–48. Inverter-type buffers are used to drive large-sized transistors of a TM gate, and have a size ratio of about 1:3 in each buffer stage.

When one of the TM gates 49–51 is turned on, the video signal line 52 is short-circuited with one of the signal lines 53–55 in the matrix and a video signal is written to the signal line. The written signal is held by the signal line until the next writing, because each signal line, the opposed substrate, and the liquid crystal in between constitute a capacitor in the matrix. Where the capacitance is insufficient, a thin-film capacitor is connected to each signal line to hold a signal.

As described above, the maximum operating frequency of a shift register is about several megahertz in the case of a polysilicon TFT driver circuit. However, a signal cannot be used as it is in the case of VGA in which the reference clock frequency is 25 MHz. Even higher frequencies of 50 MHz and 100 MHz are used in XGA and EWS, which are higher level standards than VGA. Naturally the polysilicon TFT driver circuits cannot deal with a signal according to such standards. One of the following measures is usually taken to obviate this problem.

A first measure is to externally provide a sampling circuit which consists of sampling switches 61-1 to 61-8, sampling capacitors 62-1 to 62-8, and buffer amplifiers 63-1 to 63-8 as shown in FIG. 26. An input video signal is converted into parallel signals by high-speed sample-and-holding and time-division. FIG. 27 is a timing chart showing how this measure is effected for a VGA signal. In the case of VGA, a video signal varies every 40 ns as shown in part (a) of FIG. 27. This signal is sampled by sampling signals shown in parts (b)–(d) of FIG. 27, to produce signals shown in parts (e)–(g) of FIG. 27. With the above operation, the frequency can be reduced by a factor of ⅛. Although this method has an advantage that the number of stages of the shift register in the signal line driver circuit can also be reduced by a factor of ⅛, the necessity of an external sample-and-hold circuit imposes an additional load on the external circuitry.

A second measure is a sampling method in which a video signal is not altered, and instead the internal shift register is divided into four sections and the phases of clocks supplied to the respective shift register sections are deviated by a quarter of the cycle. Although this measure is advantageous in that no external sample-and-hold circuit is needed, it has a disadvantage that the internal driver circuit is complex. FIG. 28 shows this method, in which respective sampling periods are 320 ns.

Next, a description will be made of the scanning line driver circuit. The scanning line circuit is different from the signal line driver circuit in that the drive frequency of the former is 1/500 to 1/1000 of the latter, and that outputs of the scanning line driver circuit is supplied to the scanning lines via an inverter-type buffer circuit. To drive the scanning lines, no TM gates are used unlike the case of the signal line driver circuit and binary outputs of High and Low are used. FIGS. 29A and 29B are a block diagram and a timing chart of a scanning line driver circuit. In FIG. 29A, reference numerals 81–86 denote clocked inverters; 87–89, inverters; 90–92, NAND circuits; and 93–101 inverter-type buffers.

The clock frequency is about 16 kHz in the case of VGA. The shift register operates in the same manner as that of the signal line driver circuit.

Next, driver circuits using a decoder will be described.

A decoder circuit is formed by AND circuits in a logic design, but it is usually produced by combining NAND circuits and inverters or NAND circuits and NOR circuits because semiconductor devices as an implementation of NAND circuits can be produced more easily than those as an implementation of AND circuits. FIG. 30 shows a signal line driver circuit using a decoder. In FIG. 30, reference numerals 111–113 denote NAND circuits; 114–122, inverter-type buffers; 123–125, sampling analog switches. Further, reference numeral 126 denotes a video signal line, and 127–129 denote signal lines.

The decoder circuit operates in response to an input address signal, to drive a necessary TM gate. A scanning line driver circuit using a decoder is constructed and operates in similar manners (not described here).

FIG. 31 is a simplified diagram of a circuit configuration using a decoding circuit. This circuit consists of a scan control signal lines 131-1 to 131-4 and logic circuits 132-1 to 132-4. Each of the logic circuits 132-1 to 132-4 performs a logic operation on signals that are input from the scan control signal lines 131-1 to 131-4, and outputs a result of the operation. By constructing the logic circuits 132-1 to 132-4 so that they perform different logic operations, scanning signals are output in a deviated manner as shown in a timing chart of FIG. 32.

The above-described shift register type driver circuit and the decoder type driver circuit have the following problems.

In the shift register type driver circuit, input pulses are sequentially transferred in response to clocks. Therefore, if a device failure occurs at a certain stage of the driver circuit, operation failures are caused in all the following stages. Thus, this type of driver circuit likely causes a reduction in the yield rate of a display device. If it is intended to make the driver circuit redundant, the circuit configuration becomes complex.

Although being free of the above problems associated with the shift register type driver circuit, the decoder type driver circuit has other problems described below. As described above, a polysilicon TFT driver circuit is insufficient in frequency response, it is necessary to employ frequency division or multi-phase clock signals.

In the case of the decoder type driver circuit, it is difficult to employ multi-phase clock signals, while it is possible to employ frequency division though there arises the problem of addition of an external circuit (this problem also occurs in the shift register type driver circuit). For example, to use 640 signal lines of VGA without employing multi-phase clock signals, 10-bit address data is needed. Since two wiring lines are needed for each bit, a total of 20 wiring lines need to be provided to drive the decoder circuit. On the other hand, to perform 8-phase sampling on address data, addresses of 7 bits (for 80 signal lines) are needed for each phase. That is, addresses of 56 bits (8 times the above number) are needed for the total of 640 signal lines. This number is more than 5 times the number of the case where the 8-phase sampling is not employed. The number of wiring lines amounts to 112. Therefore, a large wiring area needs to be secured on a substrate. Further, there arise problems of crosstalk between wiring lines and wiring delay which is caused by the fact that each wiring line serves as a load capacitance of the other wiring lines.

In recent years, matrix-type display devices are required to perform display based on high-resolution, high-frequency video signals such as those of SVGA, XGA, and Hi-Vision. In this case, it is difficult to cause a scanning circuit, a sample-and-hold circuit, etc. to operate at a sufficiently high speed for a video signal of the above frequencies.

This problem can be solved by a technique in which, as shown in FIGS. 33 and 34, plural sets of logic circuits 132 and scan control signal lines 131 (see FIG. 31) are provided and signals of the respective scan control signal lines 131 are given different phases. This configuration enables display of a high-resolution, high-frequency video signal by causing adjacent logic circuits 132 to produce that are deviated in phase by a period shorter than the sampling pulse width and performing time-related processing on the video signal accordingly.

As is apparent from FIG. 33, this configuration has many wiring cross points because of the increase in the number of scan control signal lines 131. Since the parasitic capacitances of the wiring increase due to parasitic capacitances occurring at the cross points, this configuration is problematic not only in increase of the circuit scale but also in increase of the power consumption due to the parasitic capacitances.

Further, a variation in the characteristics of the circuits for driving the respective scan control signal lines 131 causes variations in delay and rising and falling times. As a result, a pulse signal may be output at unintended timing, causing adverse influences on the sample-and-hold circuit etc.

SUMMARY OF THE INVENTION

The present invention has been made to solve the above problems in the art, and has an object of providing a scanning circuit that constitutes a driver circuit which scanning circuit is small in circuit scale and low in power consumption by virtue of a decreased number of wiring lines required therein, and which can suppress the occurrence of glitches in outputs.

Another object of the invention is to provide a matrix-type image display device which can produce superior display images by suppressing the occurrence of glitches.

According to a first aspect of the invention, there is provided an active matrix display device comprising a number of pixels arranged in matrix form; signal lines for supplying display signals to the pixels; and a driver circuit for driving the signal lines, the driver circuit comprising a frequency divider circuit for frequency-dividing input multi-phase clock signals; a synchronous counter circuit for frequency-dividing part of the input multi-phase clock signals; and a decoder circuit for selecting a desired one of the signal lines based on outputs of the frequency divider circuit and the synchronous counter circuit.

The above active matrix display device may further comprise a level shift circuit provided upstream of the frequency divider circuit and the synchronous counter circuit, for converting an amplitude of the multi-phase clock signals.

In the above active matrix display device, the frequency divider circuit or the synchronous counter circuit may be constituted by using thin-film transistors.

In the above active matrix display device, the frequency divider circuit or the synchronous counter circuit may be constituted by using single crystal transistors.

According to a second aspect of the invention, there is provided an active matrix display device comprising a number of pixels arranged in matrix form; signal lines for supplying display signals to the pixels; and a driver circuit for driving the signal lines, the driver circuit comprising a frequency divider circuit for frequency-dividing input multi-phase clock signals; a synchronous counter circuit for frequency-dividing part of the input multi-phase clock signals; a decoder circuit divided into a plurality of decoder circuit sections; and a gate circuit for selectively supplying the respective decoder circuit sections with outputs of the frequency divider circuit and the synchronous counter circuit, wherein each of the decoder circuit sections selects a desired one of the signal lines based on the selectively supplied outputs of the frequency divider circuit and the synchronous counter circuit.

The above active matrix display device may further comprise a level shift circuit provided upstream of the frequency divider circuit and the synchronous counter circuit, for converting an amplitude of the multi-phase clock signals.

In the above active matrix display device, the frequency divider circuit or the synchronous counter circuit may be constituted by using thin-film transistors.

In the above active matrix display device, the frequency divider circuit or the synchronous counter circuit may be constituted by using single crystal transistors.

As an embodiment of the first and second aspects of the invention, a driver circuit for a liquid crystal display device is constituted by a frequency divider circuit for frequency-dividing input multi-phase clock signals; a synchronous counter circuit for frequency-dividing part of the input multi-phase clock signals; and a decoder circuit for selecting a desired one of signal lines based on outputs of the frequency divider circuit and the synchronous counter circuit.

By selectively driving the signal lines of a matrix based on a combination of the multi-phase clock signals and the decoder circuit in the above manner, the number of address signal lines of the decoder circuit can be reduced. This enables reduction in the area occupied by the driver circuit as well as reduction in the crosstalk between wiring lines. Thus, a higher quality display device can be realized.

To attain the above objects, according to a third aspect of the invention, there is provided a scanning circuit comprising L scan control signal lines to be used for setting a direction and an order of scanning; first logic circuits for producing pulse signals by performing a logic operation on signals on M of the L scan control signal lines; flip-flop circuits each being set by a pulse signal that is output from one of the first logic circuits, and reset by a pulse signal that is output from another of the first logic circuits which belongs to a stage after a stage of the one first logic circuit; N timing control signal lines for setting output timing of scanning signals that are output finally; and second logic circuits for producing the scanning signals by performing a logic operation on pulse signals that are output from the N timing control signal lines and pulse signals that are output from the flip-flop circuits.

According to a fourth aspect of the invention, there is provided a scanning circuit comprising L scan control signal lines to be used for setting a direction and an order of scanning; a glitch preventing pulse signal line for forwarding a glitch preventing pulse to be used for preventing generation of a glitch; first logic circuits for producing pulse signals by performing a logic operation on signals on M of the L scan control signal lines and the glitch preventing pulse; flip-flop circuits each being set by a pulse signal that is output from one of the first logic circuits, and reset by a pulse signal that is output from another of the first logic circuits which belongs to a stage after a stage of the one first logic circuit; N timing control signal lines for setting output timing of scanning signals that are output finally; and second logic circuits for producing the scanning signals by performing a logic operation on pulse signals that are output from the N timing control signal lines and pulse signals that are output from the flip-flop circuits.

According to a fifth aspect of the invention, there is provided a scanning circuit comprising L scan control signal lines to be used for setting a direction and an order of scanning; a glitch preventing pulse signal line for forwarding a glitch preventing pulse to be used for preventing generation of a glitch; first logic circuits for producing pulse signals by performing a logic operation on signals on M of the L scan control signal lines, or signals on M of the L scan control signal lines and the glitch preventing pulse; flip-flop circuits each being set by a pulse signal that is output from one of the first logic circuits, and reset by a pulse signal that is output from another of the first logic circuits which belongs to a stage after a stage of the one first logic circuit; N timing control signal lines for setting output timing of scanning signals that are output finally; and second logic circuits for producing the scanning signals by performing a logic operation on pulse signals that are output from the N timing control signal lines and pulse signals that are output from the first logic circuits or the flip-flop circuits.

In the scanning circuit according to any of the third to fifth aspects of the invention, L may be set equal to M.

The scanning circuit according to any of the third to fifth aspects of the invention may be constructed such that L is equal to 2M, that the L scan control signal lines are M sets of two scan control signal lines of opposite polarities, and that each of the first logic circuits uses one of the two scan control signal lines for each of the M sets.

The scanning circuit according to any of the third to fifth aspects of the invention may be constructed such that during operation of the scanning circuit, signals on the M scan control signal lines and signals on the other scan control signal lines have opposite polarities, and a combination of the M scan control signal lines having the same polarity is switched at a fixed cycle.

In the scanning circuit according to any of the third to fifth aspects of the invention, a signal on at least one of the scan control signal lines and the glitch preventing pulse signal line may be used as a signal on the timing control signal lines.

In the scanning circuit according to any of the third to fifth aspects of the invention, each of the first may produce a plural number of outputs which control flip flop circuits of the same number.

According to the invention, there is provided a matrix-type image display device comprising a data signal line driver circuit and a scan signal line driver circuit, at least one of the data signal line driver circuit and the scan signal line driver circuit comprising the scanning circuit according to any of the third to fifth aspects of the invention.

The operation and advantages of the third to fifth aspects of the invention will be described below.

In the invention, since scanning signals are produced by performing logic operations on outputs of the flip-flop circuits and signals on the timing control signal lines, it is not necessary to provide plural systems of scan control signal lines having different phases. This enables reduction in the number of signal lines. As a result, the number of wiring cross points is decreased and the parasitic capacitances occurring in the wiring is reduced. Thus, the power consumption can be reduced from the conventional case.

By designing the flip-flop circuits so that they are not set or reset unless they receive a pulse sufficiently wider than glitches that may be generated by the first logic circuits due to timing deviations in signals on the scan control signal lines, erroneous operation of the flip-flop circuits can be avoided, thereby allowing scanning signals to be output at the required timing.

Alternatively, by inputting a glitch preventing pulse to the first logic circuits, the glitch generation itself can be avoided. Therefore, erroneous operation of the flip-flop circuits can be avoided, thereby allowing scanning signals to be output at the required timing.

Similarly, scanning signals can be produced at the required timing without causing glitches with a relatively simple circuit configuration by inputting a glitch preventing pulse to the first logic circuits to suppress generation of glitches to thereby prevent erroneous operation of the flip-flop circuits, and by producing scanning signals by performing logic operations on outputs of the first logic circuits or the flip-flop circuits and signals on the timing control signal lines.

The number of signal lines can be minimized by a configuration which satisfies a relationship L=M where L is the total number of scan control signal lines and M is the number of scan control signal lines used by the first logic circuits.

Alternatively, there may be employed a configuration in which L is equal to 2M, the L scan control signal lines are M sets of two scan control signal lines of opposite polarities, and that each of the first logic circuits uses one of the two scan control signal lines for each of the M sets. In this case, the first logic circuits, the second logic circuits, and the flip-flop circuits of the respective stages can have the same configuration.

As a further alternative, there may be employed a configuration in which during operation of the scanning circuit, signals on the M scan control signal lines and signals on the other scan control signal lines have opposite polarities, and a combination of the M scan control signal lines having the same polarity is switched at a fixed cycle. In this case, the number of scan control signal lines can be made as small as possible, and at least the first logic circuits of the respective stages can have the same configuration.

In the scanning circuit according to any of the third to fifth aspects of the invention, a signal on at least one of the scan control signal lines and the glitch preventing pulse signal line may be used as a signal on the timing control signal lines. This enables further reduction in the number of signal lines.

In the scanning circuit according to any of the third to fifth aspects of the invention, each of the first may produce a plural number of outputs which control flip flop circuits of the same number. This reduces the total number of elements, thereby simplifying the configuration of the scanning circuit.

The scanning circuit according to any of the third to fifth aspects of the invention may be used in at least one of a data signal line driver circuit and a scan signal line driver circuit of a matrix-type image display device. This configuration can reduce the power consumption and prevent occurrence of glitches, thereby providing superior display images.

DETAILED DESCRIPTION OF THE PREFERRED EMBODIMENTS

Embodiments of the present invention will be hereinafter described with reference to the accompanying drawings.

Embodiment 1

Figure 1A:
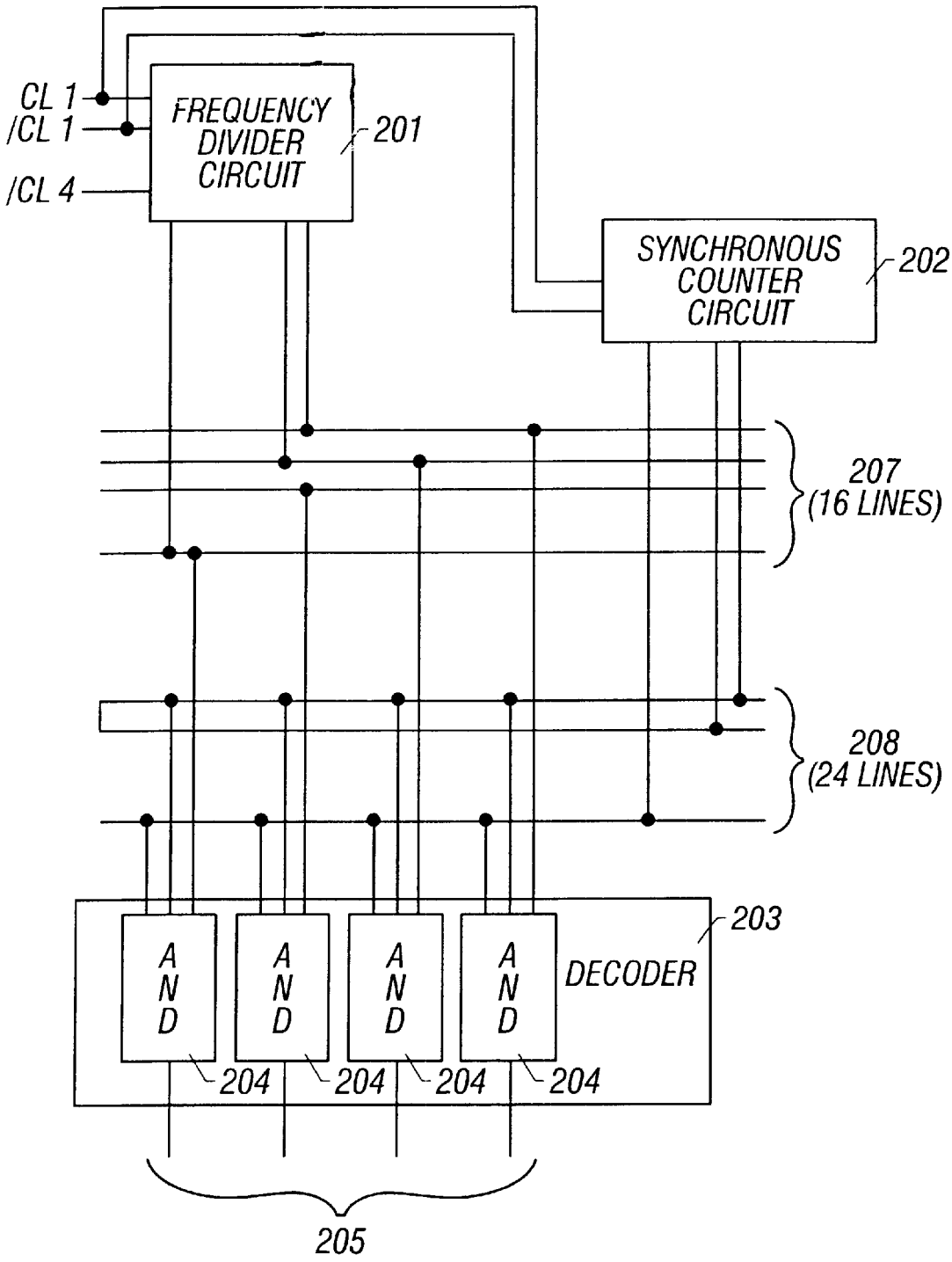
FIGS. 1A and 1B are a block diagram and a timing chart, respectively, of a scanning circuit according to a first embodiment of the invention.
Figure 1B:
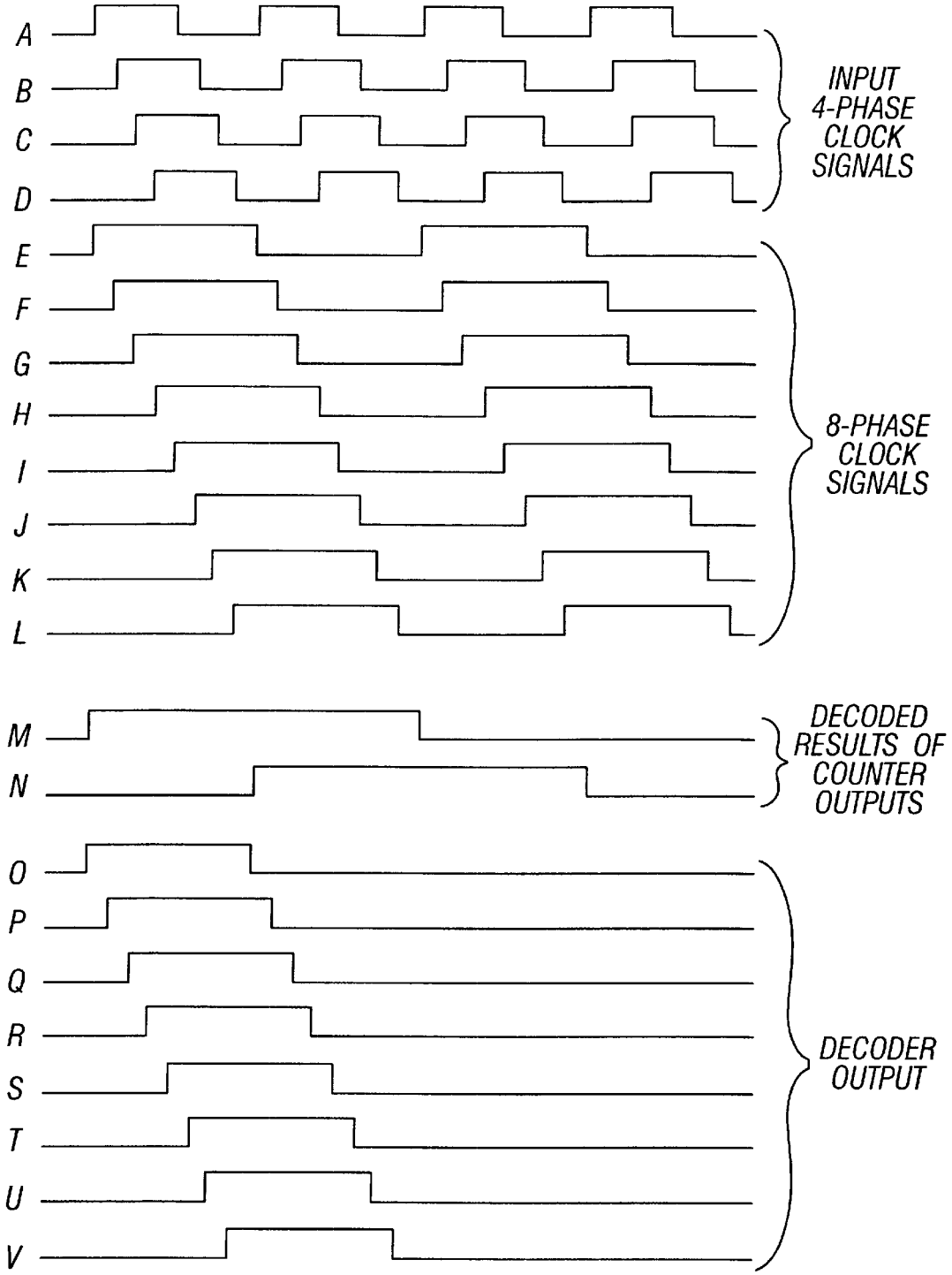

FIGS. 1A and 1B are a block diagram and a timing chart, respectively, of a scanning circuit according to a first embodiment of the invention.

In this embodiment, the invention is applied to a signal line driver circuit according to VGA. It is assumed that the sampling period is 320 ns, and that the input clock signals are 4-phase clock signals of 3.125 MHz.

In FIG. 1B, a reference clock signal A and clock signals B–D are deviated in this order with delays of 40 ns. The clock signals A–D are input to a frequency divider circuit 201 for halving the frequency. It is desired that the frequency divider circuit 201 have the same circuit configuration as a synchronous counter 202 (described later) to equalize circuit delays etc.

The frequency divider circuit 201 converts the input 4-phase clock signals to 8-phase clock signals of 1.563 MHz, which are input to a decoder 203. There are 16 clock lines on the output side of the frequency divider circuit 201 because two lines are needed for positive and negative signal polarities. These signals are indicated by characters E–L in FIG. 1B.

The reference clock signal A and a clock signal that is deviated in phase from the reference clock signal A by 180° are input to a synchronous counter circuit 202. By frequency-dividing these clock signals, the synchronous counter circuit 202 produces signals of 781 kHz, 391 kHz, 195 kHz, 98 kHz, 49 kHz, and 24 kHz, which are input to the decoder 203 and used therein to select among signal lines 205. The synchronous counter circuit 202 supplies outputs to 24 lines (6 frequencies, existence/non-existence of a 320-ns delay, and positive and negative polarities). ANDed results of these signals in each AND circuit 204 of the decoder 203 are indicated by M and N in FIG. 1B. Each AND circuit 204 of the decoder 203 ANDs an 8-phase clock signal and the outputs of the synchronous counter circuit 202, and selects a signal line 205 connected to its output when all of the above signals are on, as indicated by O-V in FIG. 1B.

The total number of address lines connected to the decoder 203 is 40, that is, 16 8-phase clock lines 207 plus 24 output lines 208 of the synchronous counter circuit 202. Although this number is larger than the number in the case of not using multi-phase clock signals, is about ⅓ of the number in the case of simply producing multi-phase clock signals.

This embodiment can prevent such problems as increase in the area of occupation due to an increased number of wiring lines, degradation in signal content due to crosstalk between wiring lines, and increase in power consumption due to increased wiring capacitances.

Embodiment 2

Figure 2:
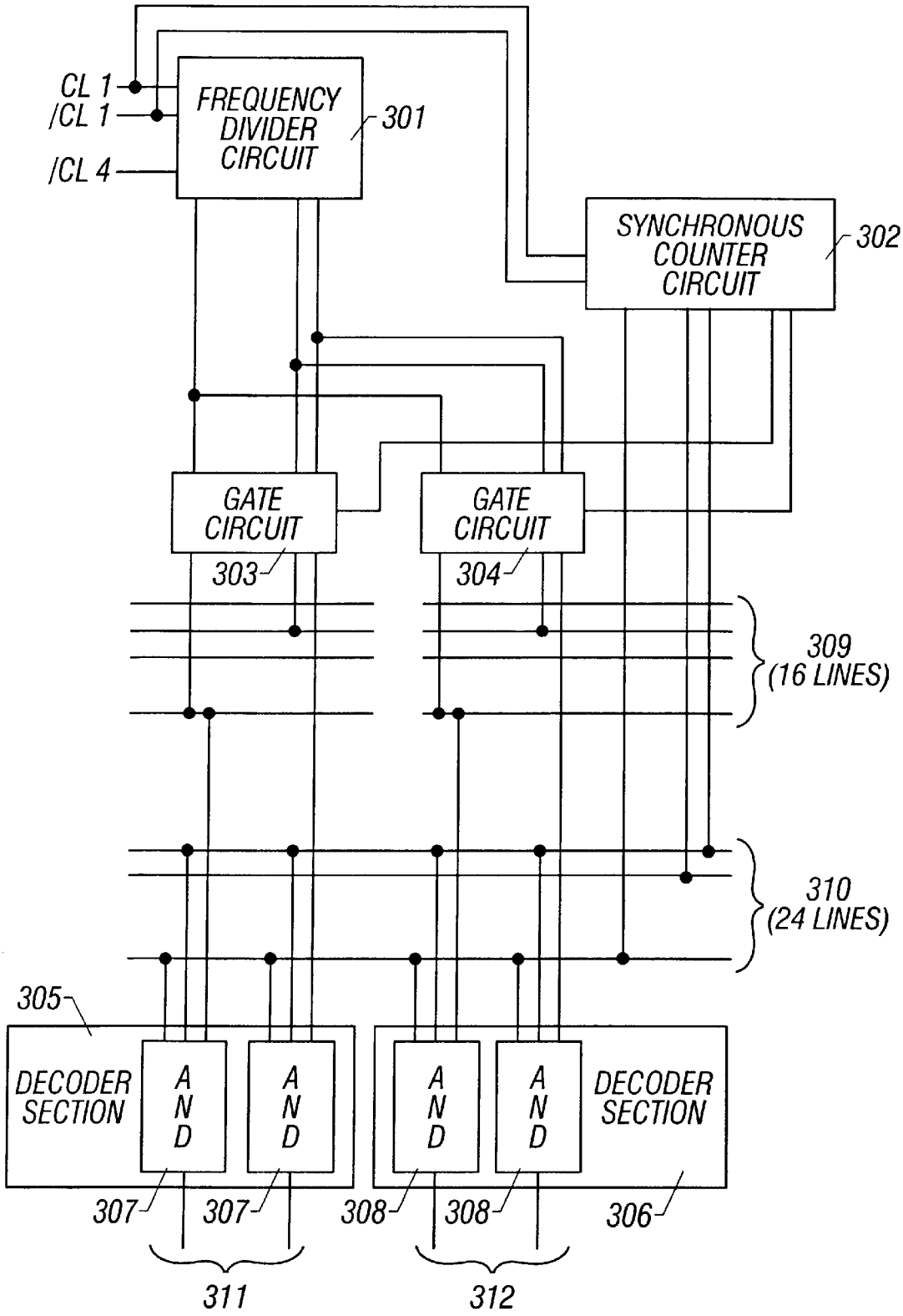
FIG. 2 is a block diagram of a scanning circuit according to a second embodiment of the invention.

FIG. 2 shows a scanning circuit according to a second embodiment of the invention.

In this embodiment, the decoder is divided into a plurality of sections 305 and 306, and gate circuits 303 and 304 are provided downstream of a frequency divider circuit 301 to selectively supply clock signals to the respective sections. Controlled by a synchronous counter circuit 302, each of the gate circuits 303 and 304 takes AND of clock signals and a control signal that is supplied from the counter circuit 302. By selectively supplying high-frequency clock signals to the decoder sections 305 and 306 in this manner, unnecessary power consumption can be avoided.

The other part of the operation is the same as that of the first embodiment. In the decoder sections 305 and 306, when the output of each of AND circuits 307 and 308 turns on, a signal line 311 or 312 connected thereto is selected.

The total number of address lines connected to the decoder 306 is 40, that is, 16 8-phase clock lines 309 plus 24 output lines 310 of the synchronous counter circuit 302.

Embodiment 3

Figure 3:
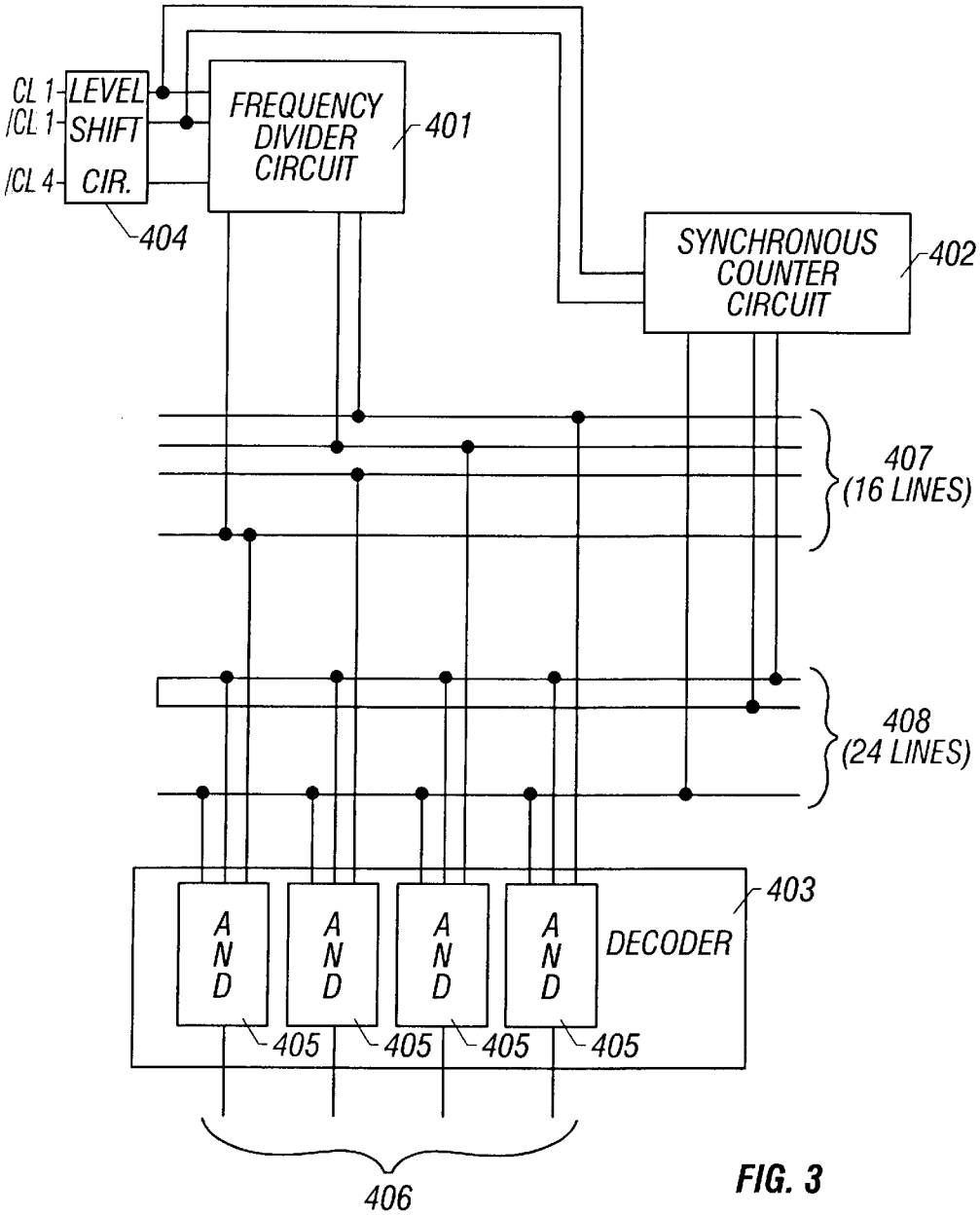
FIG. 3 is a block diagram of a scanning circuit according to a third embodiment of the invention.

FIG. 3 shows a scanning circuit according to a third embodiment of the invention.

Figure 4:
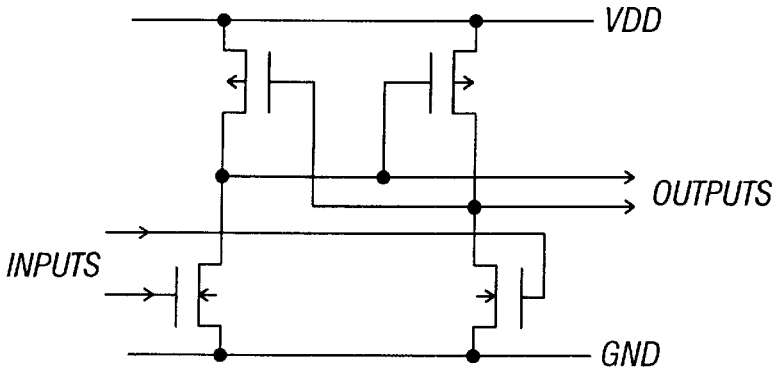
FIG. 4 shows an example of a level shift circuit used in the scanning circuit of FIG. 3.

In this embodiment, for the following reason, a level shift circuit 404 is provided upstream of a frequency divider circuit 401 and a synchronous counter circuit 402 to perform amplitude conversion. Since the threshold voltage of the polysilicon TFT is higher than that of the single crystal silicon TFT, an external voltage of, for instance, 5 V needs to be converted into 10 V or more in constructing a circuit by using polysilicon TFTs. However, because the input portion has capacitances of input pins and protection elements, the power consumption in the input portion increases if the voltage conversion is effected outside. Therefore, in this embodiment, the level shift circuit 404 is incorporated in the scanning circuit to suppress power consumption in the input portion. FIG. 4 shows an example of a circuit configuration of the level shift circuit 404.

The other part of the operation of this embodiment is the same as that of the first embodiment. In a decoder 403, when the output of an AND circuit 405 turns on, a signal line 406 connected thereto is selected.

The total number of address lines connected to the decoder 403 is 40, that is, 16 8-phase clock lines 407 plus 24 output lines 408 of the synchronous counter circuit 402.

The scanning circuit of this embodiment (FIG. 3) is constructed by adding the level shift circuit 404 to the scanning circuit of the first embodiment (FIG. 1A). Instead, the level shift circuit 404 may be added to the scanning circuit of the second embodiment (FIG. 2).

In the first and second embodiments, the frequency dividing circuit and the synchronous counter circuit may either be formed on a glass substrate by using polysilicon or implemented as a single crystal IC.

Embodiment 4

Figure 5:
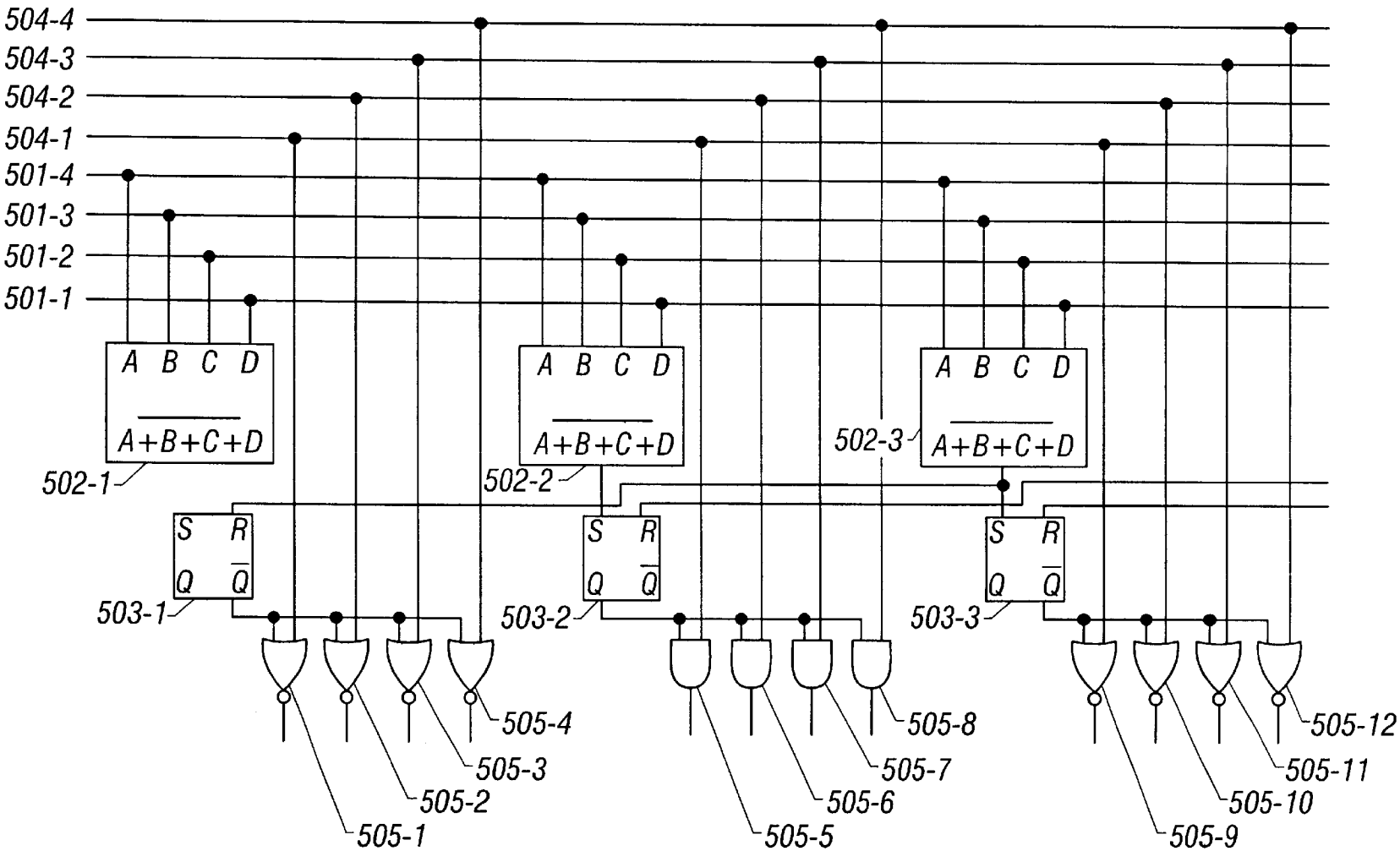
FIG. 5 is a circuit diagram showing a scanning circuit according to a fourth embodiment of the invention.

FIG. 5 shows a scanning circuit according to a fourth embodiment of the invention. Although the scanning circuit of this embodiment is described as having four scan control signal lines 501 to simplify the description, apparently there may be provided five or more scan control signal lines.

This scanning circuit consists of scan control signal lines 501, first logic circuits 502, flip-flop circuits 503, timing control signal lines 504, and second logic circuits 505. Each first logic circuit 502 performs a logic operation on signals that are input from the scan control signal lines 501, and supplies an operation result to the set terminal (S) of one of the flip-flop circuits 503 and the reset terminal (R) of another flip-flop circuit 503 such that each flip-flop circuit 503 receives at its reset terminal a signal coming from a first logic circuit 502 that is located two stages after a first logic circuit 502 that supplies a signal to the set terminal of the same flip-flop circuit 503. Each flip-flop circuit 503 supplies a signal to four second logic circuits 505. Each second logic circuit 505 performs a logic operation on signals that are supplied from the corresponding flip-flop circuit 503 and timing control signal line 504, and outputs an operation result.

Figure 6:
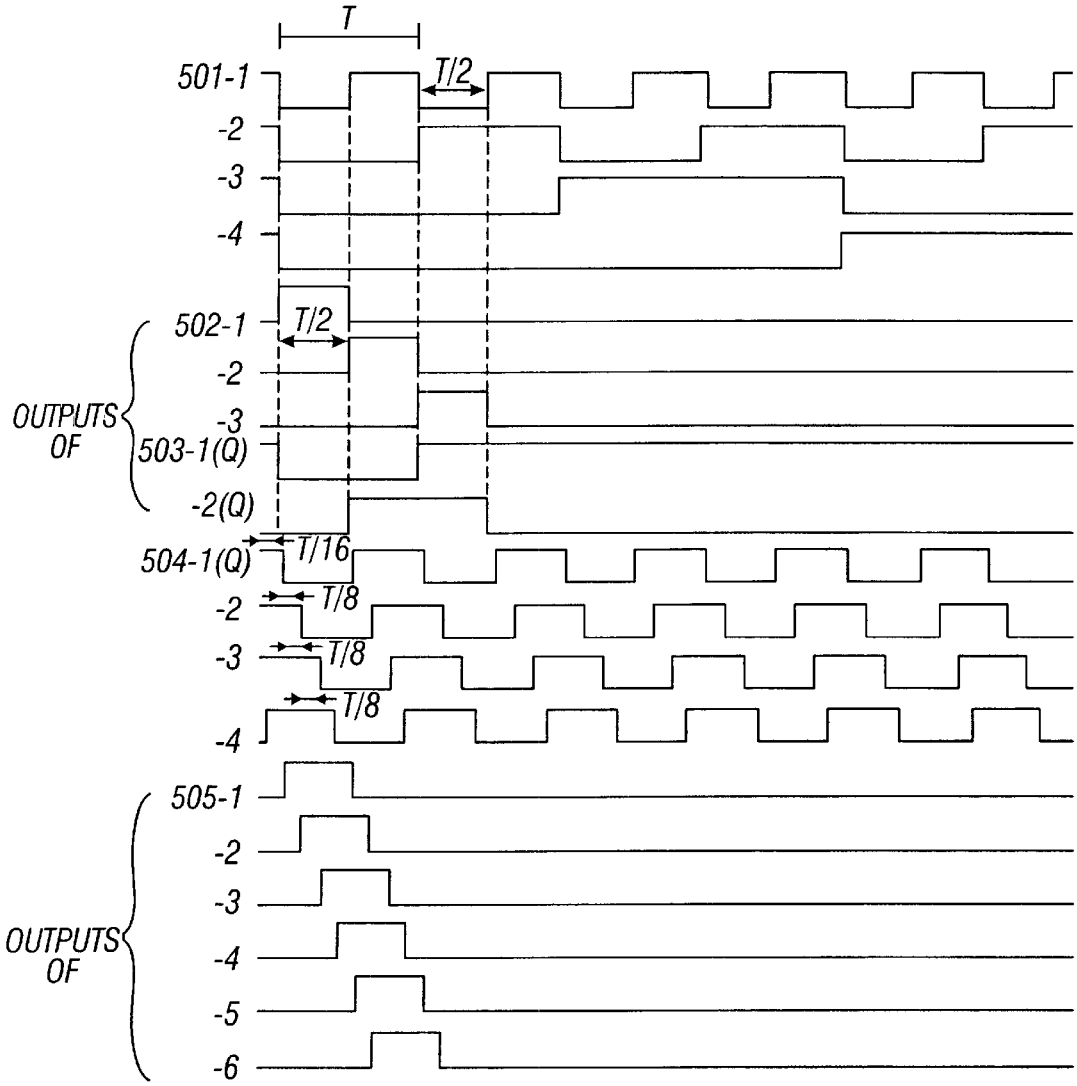
FIG. 6 is a timing chart of the scanning circuit of FIG. 5.

FIG. 6 shows a timing chart of this scanning circuit. A signal on the scan control signal line 501-1 has a constant cycle T and a duty ratio of 50%. A signal on each of the scan control signal lines 501-2 to 502-4 rises in synchronism with a fall of the one bit lower scan control signal line 501-1, 501-2, or 501-3, and has a cycle that is two times the cycle the latter. The first logic circuits 502 performs different operations. The first logic circuit 502-1 outputs a pulse when signals on all of the scan control signal lines 501-1 to 501-4 are Low. The first logic circuit 502-2 outputs a pulse when a signal on the scan control signal line 501-1 is High and signals on the scan control signal lines 501-2 to 502-4 are Low. The first logic circuit 502-3 outputs a pulse when a signal on the scan control signal line 501-2 is High and signals on the scan control signal lines 501-1, 501-3, and 501-4 are Low. Therefore, the first logic circuits 502 produce pulse signals that have a pulse width of T/2 and phases deviated from each other by T/2, in which the odd-stage first logic circuits 502 produce pulse signals that rise in synchronism with falls of a signal on the scan control signal line 501-1 and the even-stage first logic circuits 502 produce pulse signals that rise in synchronism with rises of the signal on the scan control signal line 502.

The flip-flop circuit 503-1 is set in synchronism with a rise of the output of the first logic circuit 502-1, and is reset in synchronism with a rise of the output of the first logic circuit 502-3. Therefore, the flip-flop circuit 503-1 is set and reset in synchronism with falls of a signal on the scan control signal line 501-1.

On the other hand, a signal on the timing control signal line 20 504-1 is delayed from a signal on the scan control signal line 501-1 by T/16 where T is the cycle of the latter signal. Signals on the timing control signal lines 504-2 to 504-4 are signals obtained by delaying, by T/8, signals on the timing control signal lines 504-1 to 504-3, respectively. Therefore, signals on the timing control signal lines 504-1 to 504-4 sequentially fall after the flip-flop circuit 503-1 is set, and sequentially rise before the flip-flop circuit 503-1 is reset.

Since the second logic circuits 505-1 to 505-4 take NOR of a negative logic output signal of the flip-flop circuit 503-1 and signals on the timing control signal lines 504-1 to 504-4, respectively, they output pulses while the signals on the timing control signal lines 504-1 to 504-4 are Low in a period from the setting to the resetting of the flip-flop circuit 503-1. In this manner, pulse signals having the same pulse width and deviated from each other by a fixed time are produced.

Similarly, the flip-flop circuit 503-2 is set and reset in synchronism with rises of a signal on the scan control signal line 501-1.

On the other hand, signals on the timing control signal lines 504-1 to. 504-4 sequentially rise after the flip-flop circuit 503-2 is set, and sequentially fall before the flip-flop circuit 503-2 is reset.

Since the second logic circuits 505-5 to 505-8 take AND of a positive logic output signal of the flip-flop circuit 503-2 and signals on the timing control signal lines 504-1 to 504-4, respectively (outputs of the second logic circuits 505-7 and 505-8 are not shown in FIG. 6), they output pulses while the signals on the timing control signal lines 504-1 to 504-4 are High in a period from the setting to the resetting of the flip-flop circuit 503-2. In this manner, pulse signals having the same pulse width and deviated from each other by a fixed time are produced.

The scanning circuit thus constructed produces pulse signals having the same pulse width and deviated from each other by a fixed time, that is, operates as a scanning circuit.

Figure 33:
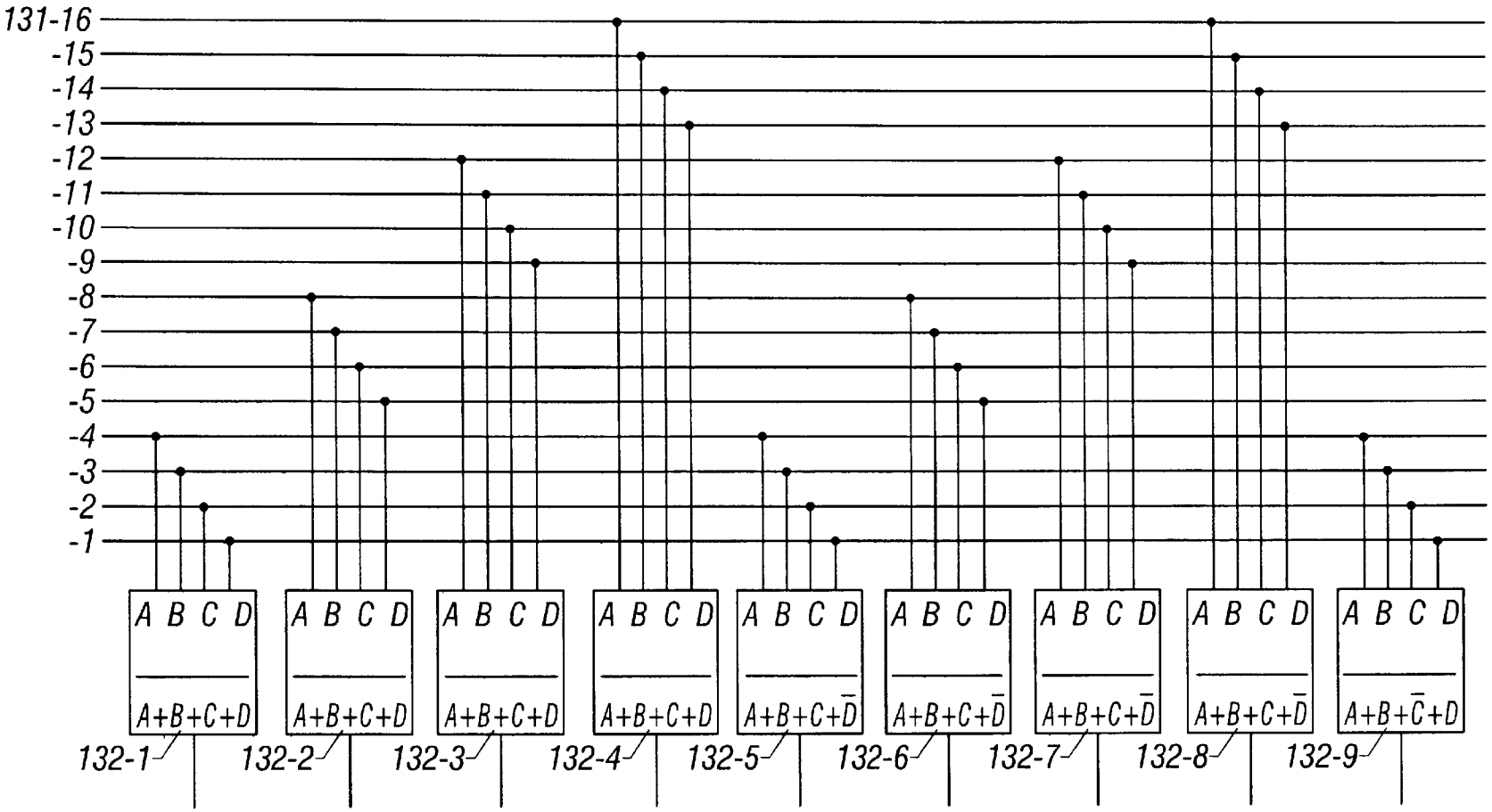
FIG. 33 (Prior Art)
FIG. 33 is a circuit diagram of another example of a scanning circuit constituting a signal line driver circuit or a scanning line driver circuit that is used in a matrix-type image display device.
Figure 34:
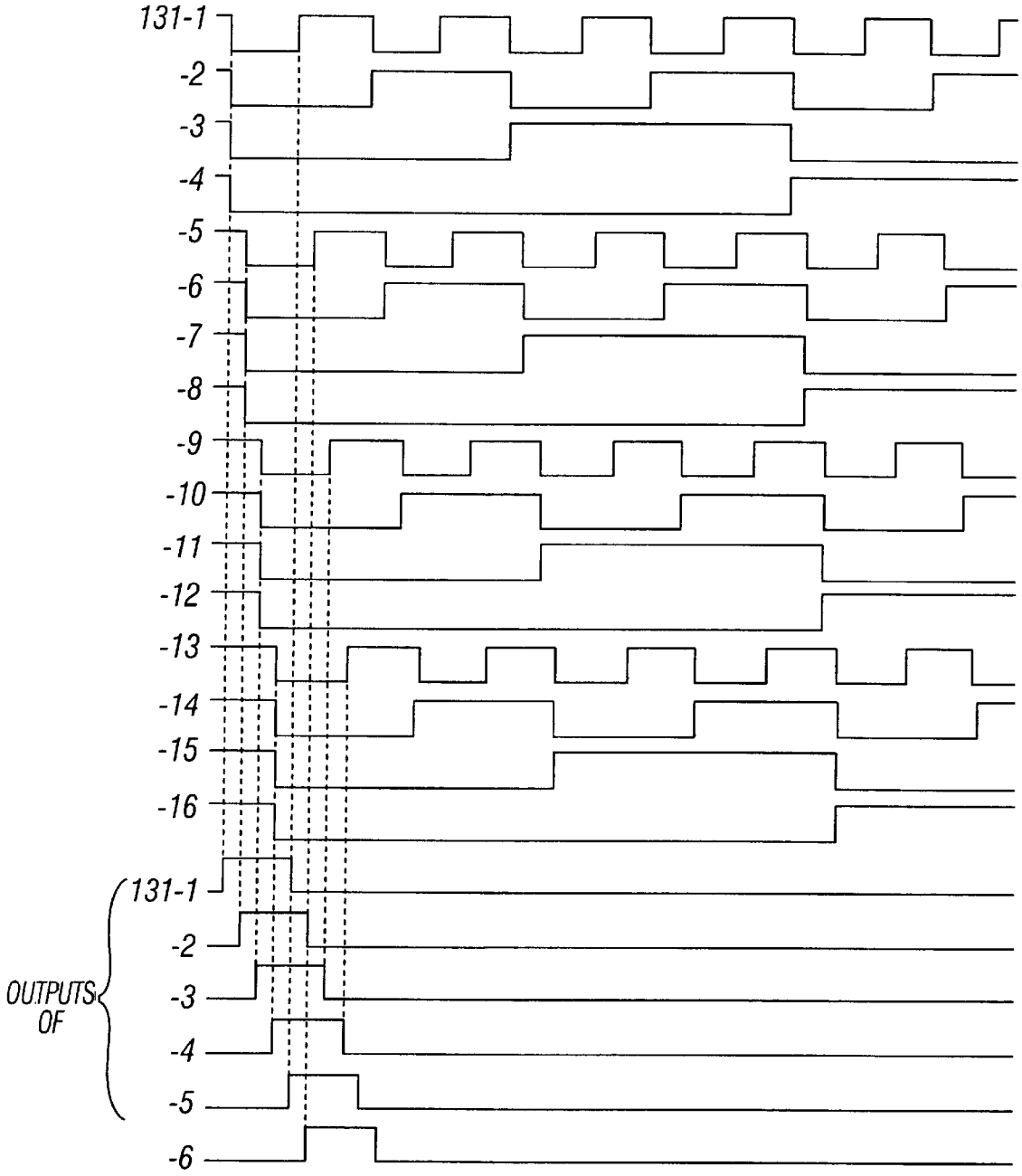
FIG. 34 (Prior Art)
FIG. 34 is a timing chart of the scanning circuit of FIG. 32.

The number of signal lines connected to the scanning circuit is 4+4=8, which is a half of the number 4×4=16 in the conventional case of FIGS. 33 and 34. Accordingly, the circuit scale and the parasitic capacitances occurring in the wiring can be reduced from the conventional case.

If the frequency of a signal on the scan control signal line 501-1 is written as f, the frequencies of signals on the scan control signal lines 501-2 to 502-4 are f/1, f/4, and f/8, respectively. Therefore, the numbers of switching per second from High to Low or Low to High of the signals on the scan control signal lines. 501-1 to 501-4 are 2f, f, f/2, and f/4, respectively. In the scan control signal lines 501-1 to 501-4, the total number of switching per second is (2+1+½+¼)×f=15f/4.

In the conventional method, which requires 4 systems of the above, the number of switching per second is 4×15f/4=15f. In contrast, in this embodiment, which additionally requires only the four timing control signal lines 504 of frequency f, the number of switching per second is 15f/4+4.2f=47f/4, which is smaller than in the conventional case. This, combined with reduction in parasitic capacitances occurring in the wiring, can reduce the power consumption.

Further, scanning signals are produced by performing logic operations on signals of the flip-flop circuits 503 and the timing control signal lines 504. Therefore, by designing the flip-flop circuits 503 so that they are not set or reset unless they receive a pulse which is sufficiently wider than glitches that may be generated by the first logic circuits 502 due to timing deviations of signals on the scan control signal lines 501, erroneous operation of the flip-flop circuits 503 can be avoided, to allow generation of scanning signals at the required timing.

Embodiment 5

Figure 7:
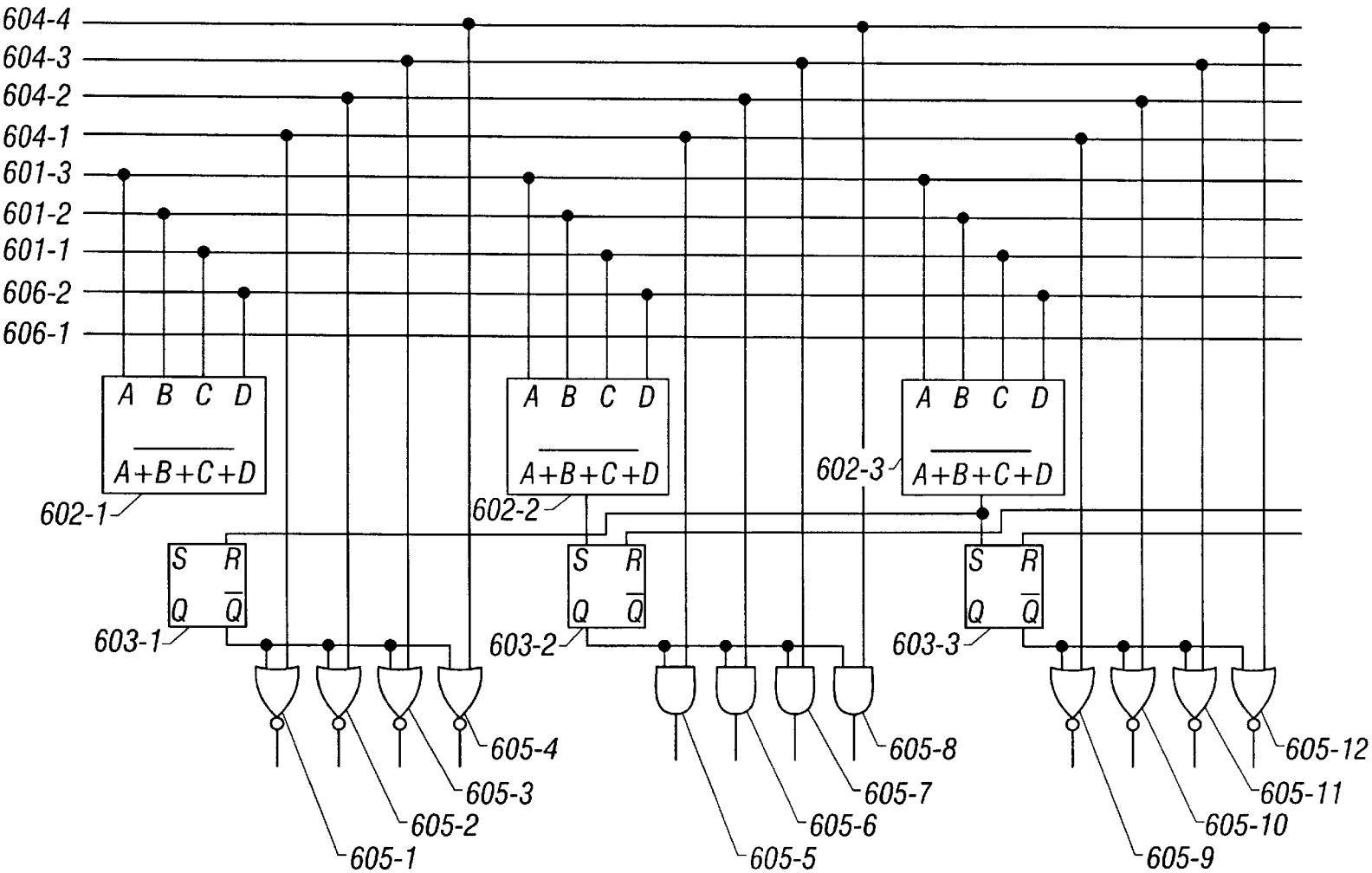
FIG. 7 is a circuit diagram showing a scanning circuit according to a fifth embodiment of the invention.

FIG. 7 shows a scanning circuit according to a fifth embodiment of the invention.

This scanning circuit consists of scan control signal lines 601, first logic circuits 602, flip-flop circuits 603, timing control signal lines 604, second logic circuits 605, and glitch preventing pulse signal lines 606. Each first logic circuit 602 performs a logic operation on signals that are input from the scan control signal lines 601 and one of the two glitch preventing pulse signal lines 606, and supplies an operation result to the set terminal of one of the flip-flop circuit 603 and the reset terminal of another flip-flop circuit 603 such that each flip-flop circuit 603 receives at its reset terminal a signal coming from a first logic circuit 602 that is located two stages after a first logic circuit 602 that supplies a signal to the set terminal of the same flip-flop circuit 603. Each flip-flop circuit 603 supplies a signal to four second logic circuits 605. Each second logic circuit 605 performs a logic operation on signals that are supplied from the corresponding flip-flop circuit 603 and timing control signal line 604, and outputs an operation result.

Figure 8:
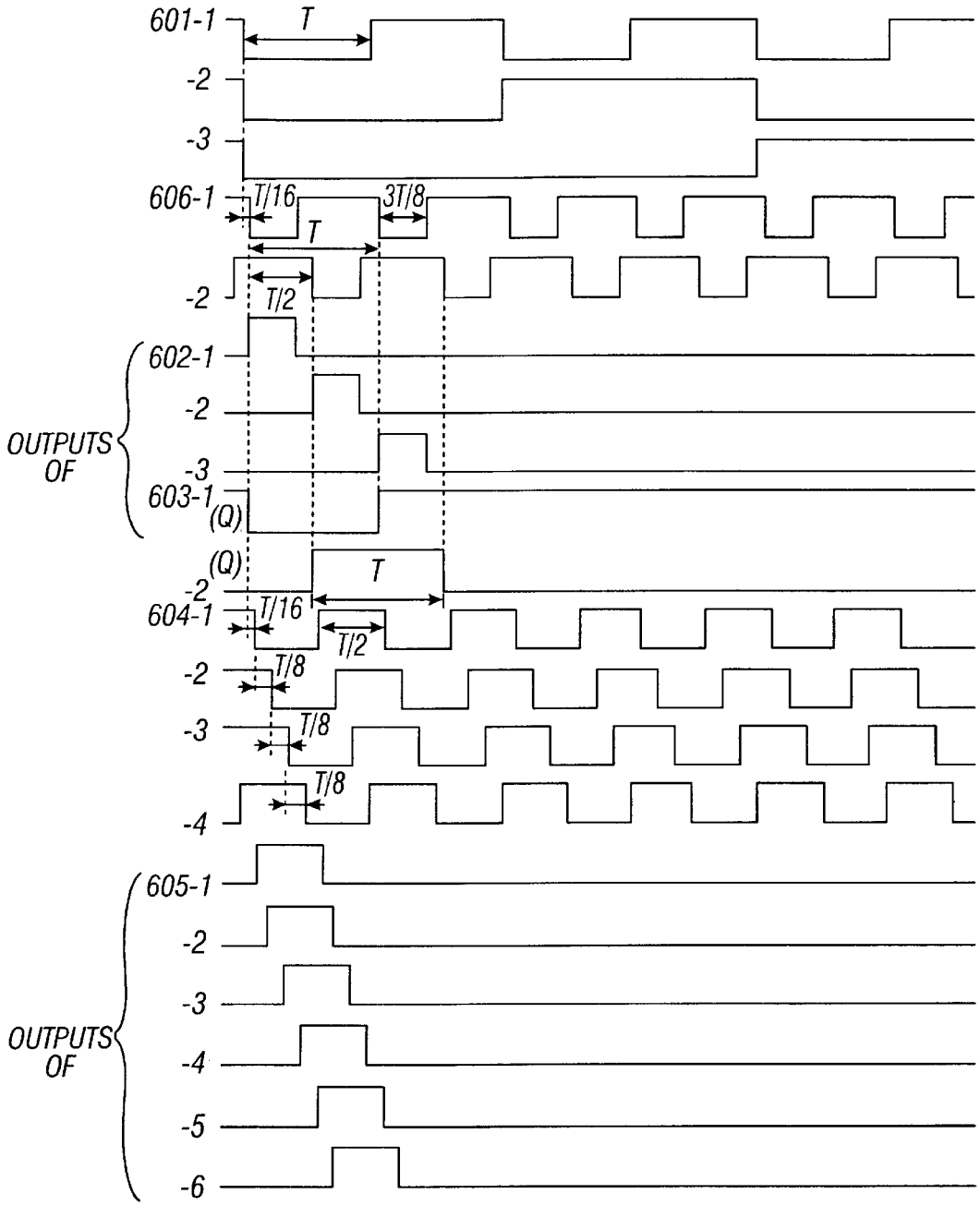
FIG. 8 is a timing chart of the scanning circuit of FIG. 7.

FIG. 8 is a timing chart of this scanning circuit. Signals on the scan control signal lines 601-1 to 601-3 correspond to signals of the scan control signal lines 501-2 to 501-4 of the fourth embodiment, respectively. On the other hand, a signal on the glitch preventing pulse signal line 606-1 has a cycle that is equal to a switching interval T of the scan control signal line 601-1 and remains Low for 3T/8, and falls at time points delayed by T/16 from a rise and a fall of a signal of the scan control signal line 601-1. A signal on the glitch preventing pulse signal line 606-2 is a signal obtained by delaying, by T/2, the signal on the glitch preventing pulse signal line 606-1.

The first logic circuits 602 performs different operations. The first logic circuit 602-1 outputs a pulse when signals on all of the scan control signal lines 601-1 to 601-3 and the glitch preventing pulse signal line 606-1 are Low. The first logic circuit 602-2 outputs a pulse when signals on all of the scan control signal lines 601-1 to 601-3 and the glitch preventing pulse signal line 606-2 are Low. The first logic circuit 602-3 outputs a pulse when a signal on the scan control signal line 601-1 is High and signals on all of the scan control signal lines 601-1 and 601-2 and the glitch preventing pulse signal line 606-1 are Low. Therefore, the first logic circuits 602 produce pulse signals that have a pulse width of 3T/8 and phases deviated from each other by T/2, in which the odd-stage first logic circuits 602 produce pulse signals that rise in synchronism with falls of a signal on the glitch preventing pulse signal line 606-1 and the even-stage first logic circuits 602 produce pulse signals that rise in synchronism with falls of a signal on the glitch preventing pulse signal line 606-2. Since signals on the glitch preventing pulse signal lines 606 fall after switching of signals on the scan control signal lines 601 and rise before switching of the signals on the scan control signal lines 601, each first logic circuit 602 never outputs a signal at a time point when a signal on the scan control signal line 601 is switched. Therefore, there can be prevented glitches which would otherwise occur due to timing deviations of signals on the scan control signal lines 601.

The flip-flop circuit 603-1 is set in synchronism with a rise of the output of the first logic circuit 602-1, and is reset in synchronism with a rise of the output of the first logic circuit 602-3. Therefore, the flip-flop circuit 603-1 is set and reset in synchronism with falls of a signal on the glitch preventing pulse signal line 606-1.

On the other hand, a signal on the timing control signal line 604-1 falls T/16 after a fall of a signal on the glitch preventing pulse signal line 606-1, and has a cycle of T and a duty cycle of 50%. Signals on the timing control signal lines 604-2 to 604-4 are signals obtained by delaying, by T/8, signals on the timing control signal lines 604-1 to 604-3, respectively. Therefore, signals on the timing control signal lines 604-1 to 604-4 sequentially fall after the flip-flop circuit 603-1 is set, and sequentially rise before the flip-flop circuit 603-1 is reset.

Since the second logic circuits 605-1 to 605-4 take NOR of a negative logic output signal of the flip-flop circuit 603-1 and signals on the timing control signal lines 604-1 to 604-4, respectively, they output pulses while the signals on the timing control signal lines 604-1 to 604-4 are Low in a period from the setting to the resetting of the flip-flop circuit 603-1. In this manner, pulse signals having the same pulse width and deviated from each other by a fixed time are produced.

Similarly, the flip-flop circuit 603-2 is set and reset in synchronism with falls of a signal on the glitch preventing pulse signal line 606-2.

On the other hand, signals on the timing control signal lines 604-1 to 604-4 sequentially rise after the flip-flop circuit 603-2 is set, and sequentially fall before the flip-flop circuit 603-2 is reset.

Since the second logic circuits 605-5 to 605-8 take AND of a positive logic output signal of the flip-flop circuit 603-2 and signals on the timing control signal lines 604-1 to 604-4, respectively (outputs of the second logic circuits 605-7 and 605-8 are not shown in FIG. 8), they output pulses while the signals on the timing control signal lines 604-1 to 604-4 are High in a period from the setting to the resetting of the flip-flop circuit 603-2. In this manner, pulse signals having the same pulse width and deviated from each other by a fixed time are produced.

The circuit thus constructed produces pulse signals having the same pulse width and deviated from each other by a fixed time, that is, operates as a scanning circuit.

The number of signal lines connected to the scanning circuit is 3+4+2=9, which is about a half of the number 4×4=16 in the conventional case of FIGS. 33 and 34. Accordingly, the circuit scale and the parasitic capacitances occurring in the wiring can be reduced from the conventional case.

In addition, as in the case of the fourth embodiment, the total number of switching per second from High to Low or Low to High or signals on the scan control signal lines 601 and the glitch preventing pulse signal lines 606 is smaller than in the conventional case. This, combined with reduction in parasitic capacitances occurring in the wiring, can reduce the power consumption.

Further, since no glitches occur in the first logic circuits 602, there occurs no erroneous operation in the flip-flop circuits 603. Thus, the scanning circuit can produce scanning signals at the required timing.

Embodiment 6

Figure 9:
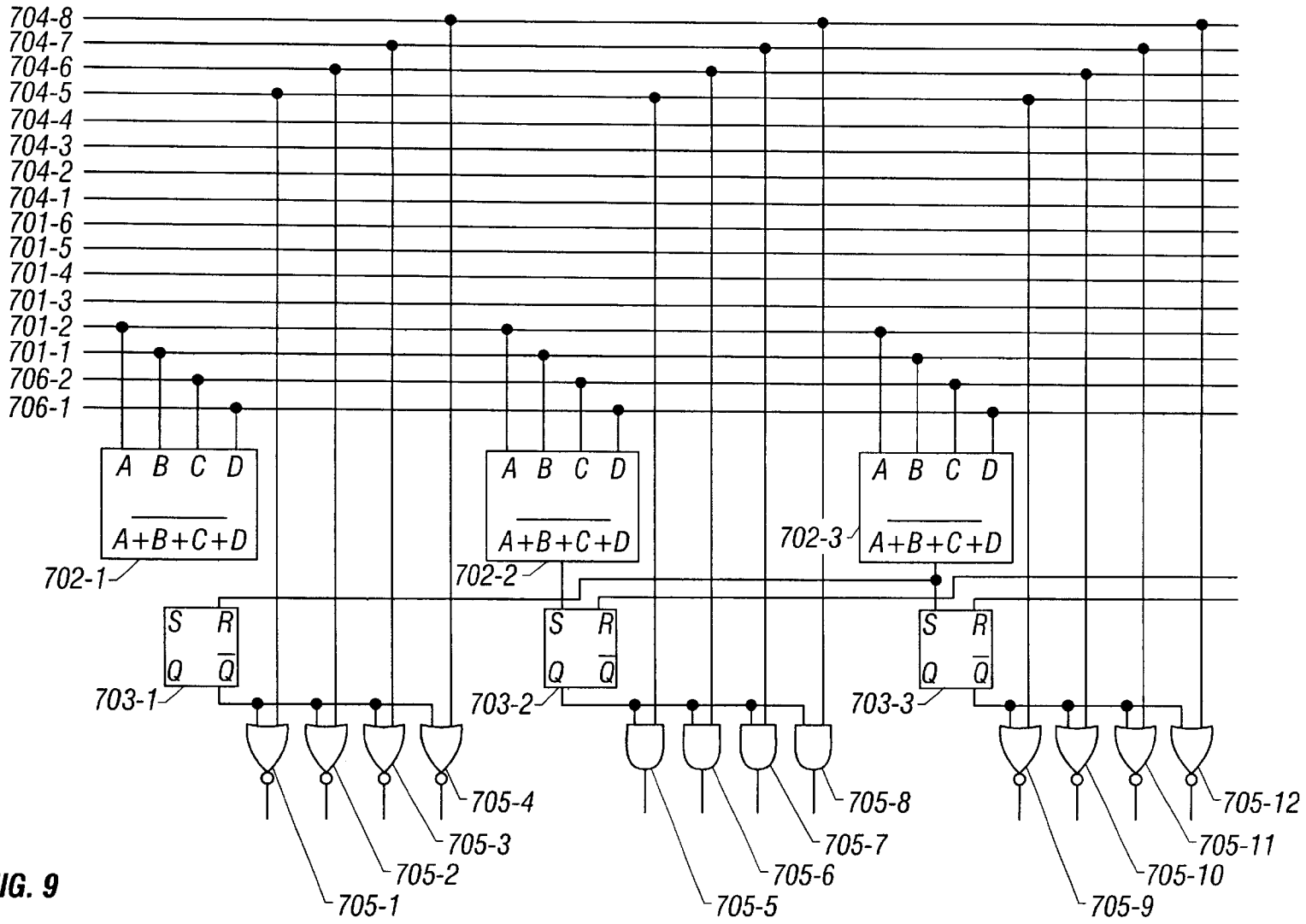
FIG. 9 is a circuit diagram showing a scanning circuit according to a sixth embodiment of the invention.

FIG. 9 shows a scanning circuit according to a sixth embodiment of the invention.

This scanning circuit consists of scan control signal lines 701, first logic circuits 702, flip-flop circuits 703, timing control signal lines 704, second logic circuits 705, and glitch preventing pulse signal lines 706.

Each first logic circuit 702 performs a logic operation on signals that are input from three of the six scan control signal lines 701 and one of the two glitch preventing pulse signal lines 706, and supplies an operation result to the set terminal of one of the flip-flop circuits 703 and the reset terminal of another flip-flop circuit 703 such that each flip-flop circuit 703 receives at its reset terminal a signal coming from a first logic circuit 702 that is located two stages after a first logic circuit 702 that supplies a signal to the set terminal of the same flip-flop circuit 703. Each flip-flop circuit 703 supplies a signal to four second logic circuits 705. Each second logic circuit 705 performs a logic operation on signals that are supplied from the corresponding flip-flop circuit 703 and timing control signal line 704, and outputs an operation result.

Figure 10:
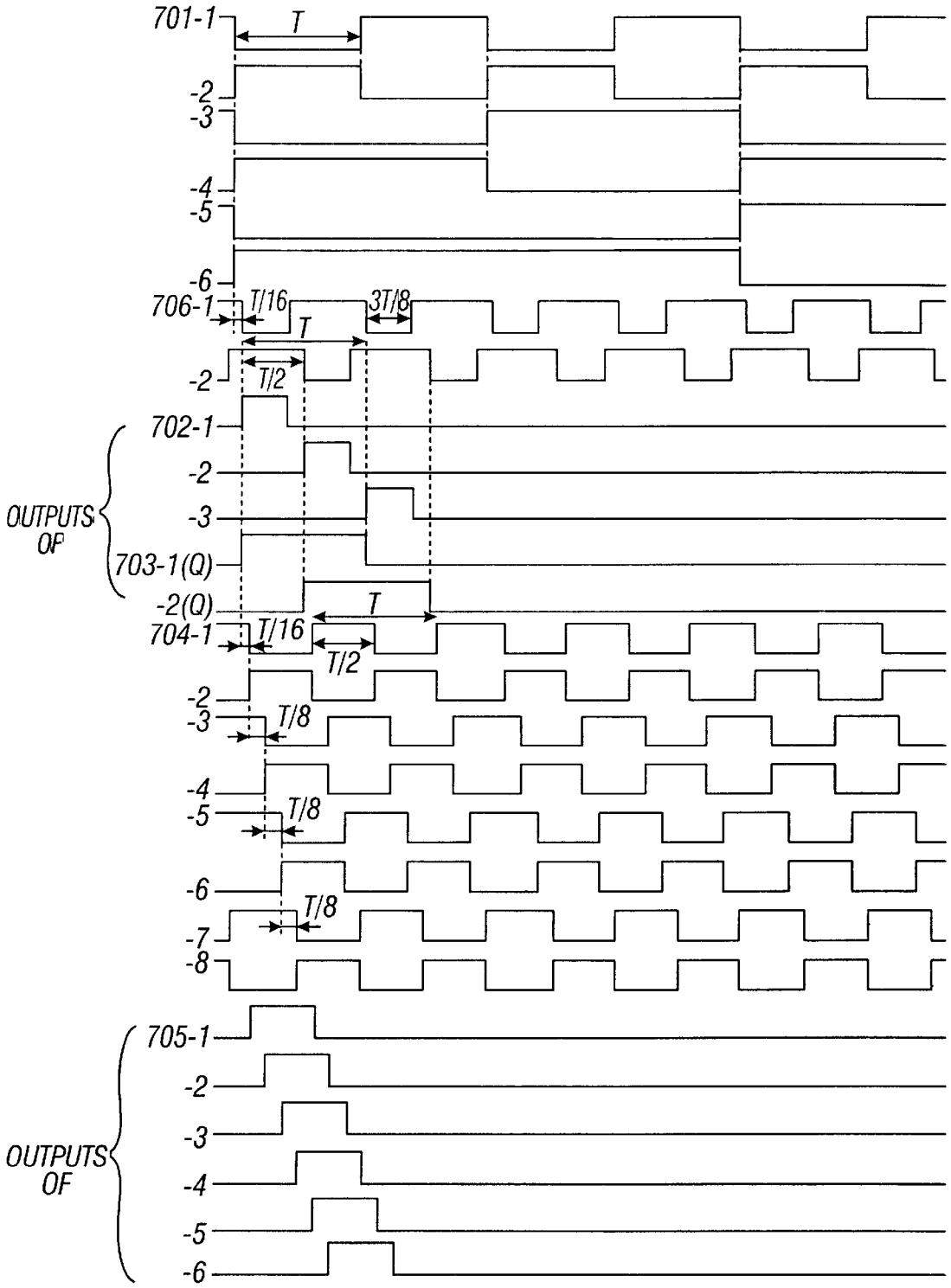
FIG. 10 is a timing chart of the scanning circuit of FIG. 9.

FIG. 10 is a timing chart of this scanning circuit. Signals on the scan control signal lines 701-1, 701-3, and 701-5 correspond to signals of the scan control signal lines 601-1 to 601-3 of the fifth embodiment, respectively. Signals on the scan control signal lines 701-2, 701-4, and 701-6 are signals whose polarities are reverse to those of signals on the scan control signal lines 701-1, 701-3, and 701-5, respectively. On the other hand, signals on the glitch preventing pulse signal lines 706 correspond to signals on the glitch preventing pulse signal lines 606 of the fifth embodiment.

One of the scan control signal lines 701-5 and 701-6 is connected to terminal A of each first logic circuit 702. One of the scan control signal lines 701-3 and 701-4 is connected to terminal B. One of the scan control signal lines 701-1 and 701-2 is connected to terminal C. One of the glitch preventing pulse signal lines 706-1 and 706-2 is connected to terminal D. The combinations of terminals A-D, the scan control signal lines 701, and the glitch preventing pulse signal lines 706 are different for the respective first logic circuits 702. The first logic circuit 702-1 outputs a pulse when signals on all of the scan control signal lines 701-1, 701-3, and 701-5 and the glitch preventing pulse signal line 706-1, which are connected to the first logic circuit 702-1, are Low. The first logic circuit 702-2 outputs a pulse when signals on all of the scan control signal lines 701-1, 701-3, and 701-5 and the glitch preventing pulse signal line 706-2, which are connected to the first logic circuit 701-2, are Low. The first logic circuit 702-3 outputs a pulse when signals on all of the scan control signal lines 701-2, 701-3, and 701-5 and the glitch preventing pulse signal line 706-1, which are connected to the first logic circuit 702-3, are Low. Therefore, the first logic circuits 702 produce pulse signals that have a pulse width of 3T/8 and phases deviated from each other by T/2, in which the odd-stage first logic circuits 702 produce pulse signals that rise in synchronism with falls of a signal on the glitch preventing pulse signal line 706-1 and the even-stage first logic circuits 702 produce pulse signals that rise in synchronism with falls of a signal on the glitch preventing pulse signal line 706-2. Since signals on the glitch preventing pulse signal lines 706 fall after switching of signals on the scan control signal lines 701 and rise before switching of the signals on the scan control signal lines 701, each first logic circuit 702 never outputs a signal at a time point when a signal on the scan control signal line 701 is switched. Therefore, there can be prevented glitches which would otherwise occur due to timing deviations of signals on the scan control signal lines 701.

The flip-flop circuit 703-1 is set in synchronism with a rise of the output of the first logic circuit 702-1, and is reset in synchronism with a rise of the output of the first logic circuit 702-3. Therefore, the flip-flop circuit 703-1 is set and reset in synchronism with falls of a signal on the glitch preventing pulse signal line 706-1.

On the other hand, a signal on the timing control signal line 704-1 falls T/16 after a fall of a signal on the glitch preventing pulse signal line 706-1 (T: switching interval of a signal on the scan control signal line 701-1), and has a cycle of T and a duty cycle of 50%. Signals on the timing control signal lines 704-3, 704-5, and 704-7 are signals obtained by delaying, by T/8, signals on the timing control signal lines 704-1, 704-3, and 704-5, respectively. Signals on the timing control signal lines 704-2, 704-4, 704-6, and 704-8 are signals whose polarities are reverse to those of signals on the timing control signal lines 704-1, 704-3, 704-5, and 704-7, respectively. Therefore, signals on the timing control signal lines 704-2, 704-4, 704-6, and 704-8 sequentially rise after the flip-flop circuit 703-1 is set, and sequentially fall before the flip-flop circuit 703-1 is reset.

Since the second logic circuits 705-1 to 705-4 take AND of a positive logic output signal of the flip-flop circuit 703-1 and signals on the timing control signal lines 704-2, 704-4, 704-6, and 704-8, respectively, they output pulses while the signals on the timing control signal lines 704-2, 704-4, 704-6, and 704-8 are High in a period from the setting to the resetting of the flip-flop circuit 703-1. In this manner, pulse signals having the same pulse width and deviated from each other by a fixed time are produced.

Similarly, the flip-flop circuit 703-2 is set and reset in synchronism with falls of a signal on the glitch preventing pulse signal line 706-2.

On the other hand, signals on the timing control signal lines 704-1, 704-3, 704-5, and 704-7 sequentially rise after the flip-flop circuit 703-2 is set, and sequentially fall before the flip-flop circuit 703-2 is reset.

Since the second logic circuits 705-5 to 705-8 take AND of a positive logic output signal of the flip-flop circuit 703-2 and signals on the timing control signal lines 704-1, 704-3, 704-5, and 704-7, respectively (outputs of the second logic circuits 705-7 and 705-8 are not shown in FIG. 10), they output pulses while the signals on the timing control signal lines 704-1, 704-3, 704-5, and 704-7 are High in a period from the setting to the resetting of the flip-flop circuit 703-2. In this manner, pulse signals having the same pulse width and deviated from each other by a fixed time are produced.

The circuit thus constructed produces pulse signals having the same pulse width and deviated from each other by a fixed time, that is, operates as a scanning circuit.

The number of signal lines connected to the scanning circuit is 6+8+2=16, which is a half of a number 8×4=32 that would be obtained when the scheme of this embodiment of selecting three of six scan control signal lines is applied to the conventional method of FIGS. 33 and 34. Accordingly, the circuit scale and the parasitic capacitances occurring in the wiring can be reduced from the conventional case.

In addition, as in the case of the fourth and fifth embodiments, the total number of switching per second from High to Low or Low to High of signals on the scan control signal lines 701 and the glitch preventing pulse signal lines 706 is smaller than in the conventional case. This, combined with reduction in parasitic capacitances occurring in the wiring, can reduce the power consumption.

Further, since no glitches occur in the first logic circuits 702, there occurs no erroneous operation in the flip-flop circuits 703. Thus, the scanning circuit can produce scanning signals at the required timing.

Further, because of the design in which the signal output timing of each first logic circuit 702 is adjusted by the combination of the scan control signal lines 701 and the glitch preventing pulse signal line 706 connected thereto, the respective first logic circuits 702 can have the same configuration.

Embodiment 7

Figure 11:
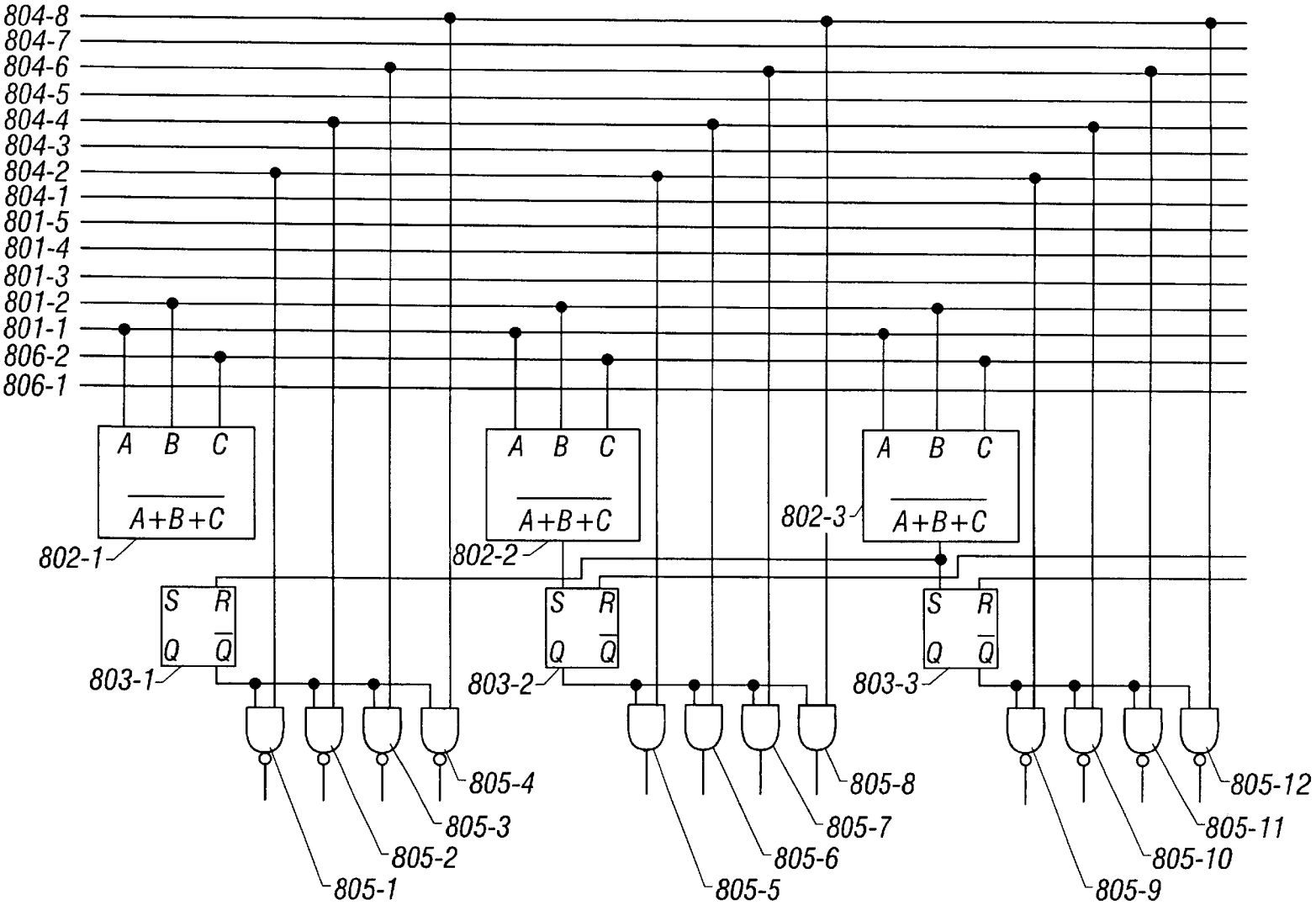
FIG. 11 is a circuit diagram showing a scanning circuit according to a seventh embodiment of the invention.

FIG. 11 shows a scanning circuit according to a seventh embodiment of the invention.

This scanning circuit consists of scan control signal lines 801, first logic circuits 802, flip-flop circuits 803, timing control signal lines 804, second logic circuits 805, and glitch preventing pulse signal lines 806. Each first logic circuit 802 performs a logic operation on signals that are input from two of the five scan control signal lines 801 and one of the two glitch preventing pulse signal lines 806, and supplies an operation result to the set terminal of one of the flip-flop circuit 803 and the reset terminal of another flip-flop circuit 803 such that each flip-flop circuit 803 receives at its reset terminal a signal coming from a first logic circuit 802 that is located two stages after a first logic circuit 802 that supplies a signal to the set terminal of the same flip-flop circuit 803. Each flip-flop circuit 803 supplies a signal to four second logic circuits 805. Each second logic circuit 805 performs a logic operation on signals that are supplied from the corresponding flip-flop circuit 803 and timing control signal line 804, and outputs an operation result.

Figure 12:
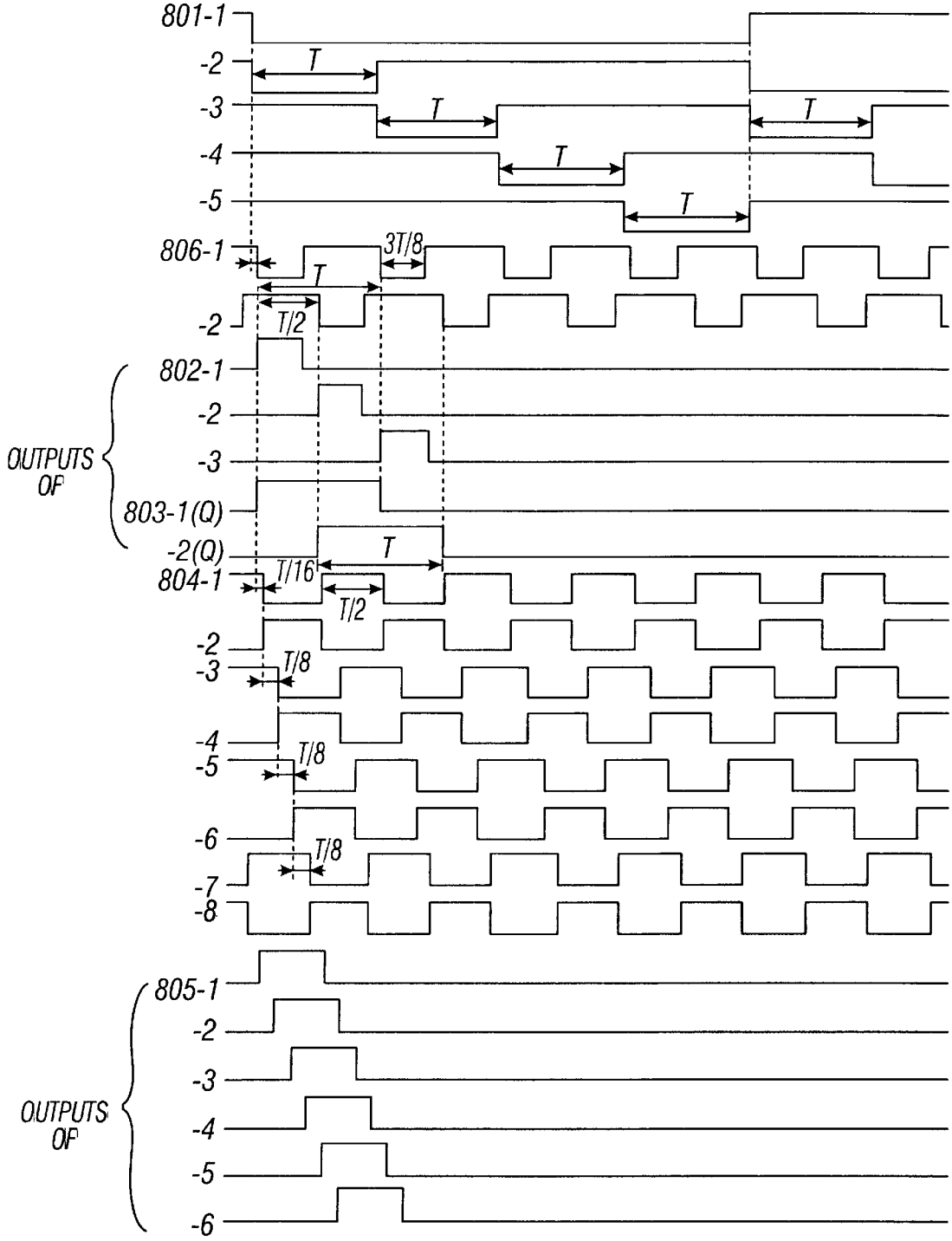
FIG. 12 is a timing chart of the scanning circuit of FIG. 11.

FIG. 12 is a timing chart of this scanning circuit. While the scanning circuit operates, it is always the case that signals on two of the five scan control signal lines 801 are Low and signals on the other three scan control signal lines 801 are High. The combination of scan control signal lines 801 bearing Low-level signals is switched at a given cycle T. On the other hand, signals on the glitch preventing pulse signal lines 806 correspond to signals on the glitch preventing pulse signal lines 606 and 706 of the fifth and sixth embodiments.

Two of the scan control signal lines 801-1 to 801-5 and one of the glitch preventing pulse signal lines 806-1 and 806-2 is connected to each first logic circuit 802. The combination of the scan control signal lines 801 and the glitch preventing pulse signal lines 806 are different for the respective first logic circuits 802. The first logic circuit 802-1 outputs a pulse when signals on all of the scan control signal lines 801-1 and 801-2 and the glitch preventing pulse signal line 806-1, which are connected to the first logic circuit 802-1, are Low. The first logic circuit 802-2 outputs a pulse when signals on all of the scan control signal lines 801-1 and 801-2 and the glitch preventing pulse signal line 806-2, which are connected to the first logic circuit 801-2, are Low. The first logic circuit 802-3 outputs a pulse when signals on all of the scan control signal lines 801-1 and 801-3 and the glitch preventing pulse signal line 806-1, which are connected to the first logic circuit 802-3, are Low. Therefore, the first logic circuits 802 produce pulse signals that have a pulse width of 3T/8 and phases deviated from each other by T/2, in which the odd-stage first logic circuits 802 produce pulse signals that rise in synchronism with falls of a signal on the glitch preventing pulse signal line 806-1 and the even-stage first logic circuits 802 produce pulse signals that rise in synchronism with falls of a signal on the glitch preventing pulse signal line 806-2. Since signals on the glitch preventing pulse signal lines 806 fall after switching of signals on the scan control signal lines 801 and rise before switching of the signals on the scan control signal lines 801, each first logic circuit 802 never outputs a signal at a time point when a signal on the scan control signal line 801 is switched. Therefore, there can be prevented glitches which would otherwise occur due to timing deviations of signals on the scan control signal lines 801.

The flip-flop circuit 803-1 is set in synchronism with a rise of the output of the first logic circuit 802-1, and is reset in synchronism with a rise of the output of the first logic circuit 802-3. Therefore, the flip-flop circuit 803-1 is set and reset in synchronism with falls of a signal on the glitch preventing pulse signal line 806-1.

On the other hand, a signal on the timing control signal line 804-1 falls T/16 after a fall of a signal on the glitch preventing pulse signal line 806-1 (T: scanning interval of signals on the scan control signal line 801-1), and has a cycle of T and a duty cycle of 50%. Signals on the timing control signal lines 804-3, 804-5, and 804-7 are signals obtained by delaying, by T/8, signals on the timing control signal lines 804-1, 804-3, and 804-5, respectively. Signals on the timing control signal lines 804-2, 804-4, 804-6, and 804-8 are signals whose polarities are reverse to those of signals on the timing control signal lines 804-1, 804-3, 804-5, and 804-7, respectively. Therefore, signals on the timing control signal lines 804-2, 804-4, 804-6, and 804-8 sequentially rise after the flip-flop circuit 803-1 is set, and sequentially fall before the flip-flop circuit 803-1 is reset.

Since the second logic circuits 805-1 to 805-4 take AND of a positive logic output signal of the flip-flop circuit 803-1 and signals on the timing control signal lines 804-2, 804-4,

804-6, and 804-8, respectively, they output pulses while the signals on the timing control signal lines 8042, 804-4, 804-6, and 804-8 are High in a period from the setting to the resetting of the flip-flop circuit 803-1. In this manner, pulse signals having the same pulse width and deviated from each other by a fixed time are produced.

Similarly, the flip-flop circuit 803-2 is set and reset in synchronism with falls of a signal on the glitch preventing pulse signal line 806-2.

On the other hand, signals on the timing control signal lines 804-1, 804-3, 804-5, and 804-7 sequentially rise after the flip-flop circuit 803-2 is set, and sequentially fall before the flip-flop circuit 803-2 is reset.

Since the second logic circuits 805-5 to 805-8 take AND of a positive logic output signal of the flip-flop circuit 803-2 and signals on the timing control signal lines 804-1, 804-3, 804-5, and 804-7, respectively (outputs of the second logic circuits 805-7 and 805-8 are not shown in FIG. 12), they output pulses while the signals on the timing control signal lines 804-1, 804-3, 804-5, and 804-7 are High in a period from the setting to the resetting of the flip-flop circuit 803-2. In this manner, pulse signals having the same pulse width and deviated from each other by a fixed time are produced.

The scanning circuit thus constructed produces pulse signals having the same pulse width and deviated from each, other by a fixed time, that is, operates as a scanning circuit.

The number of signal lines connected to the scanning circuit is 5+8+2=15, which is ¾ of a number 5×4=20 that would be obtained when the scheme of this embodiment of selecting two of five scan control signal lines is applied to the conventional method of FIGS. 33 and 34. Accordingly, the circuit scale and the parasitic capacitances occurring in the wiring can be reduced from the conventional case.

In addition, as in the case of the fourth to sixth embodiments, the total number of switching per second from High to Low or Low to High of signals on the scan control signal lines 801 and the glitch preventing pulse signal lines 806 is smaller than in the conventional case. This, combined with reduction in parasitic capacitances occurring in the wiring, can reduce the power consumption.

Further, since no glitches occur in the first logic circuits 802, there occurs no erroneous operation in the flip-flop circuits 803. Thus, the scanning circuit can produce scanning signals at the required timing.

Further, because of the design in which the signal output timing of each first logic circuit 802 is adjusted by the combination of the scan control signal lines 801 and the glitch preventing pulse signal line 806 connected thereto, the respective first logic circuits 802 can have the same configuration.

Embodiment 8

Figure 13:
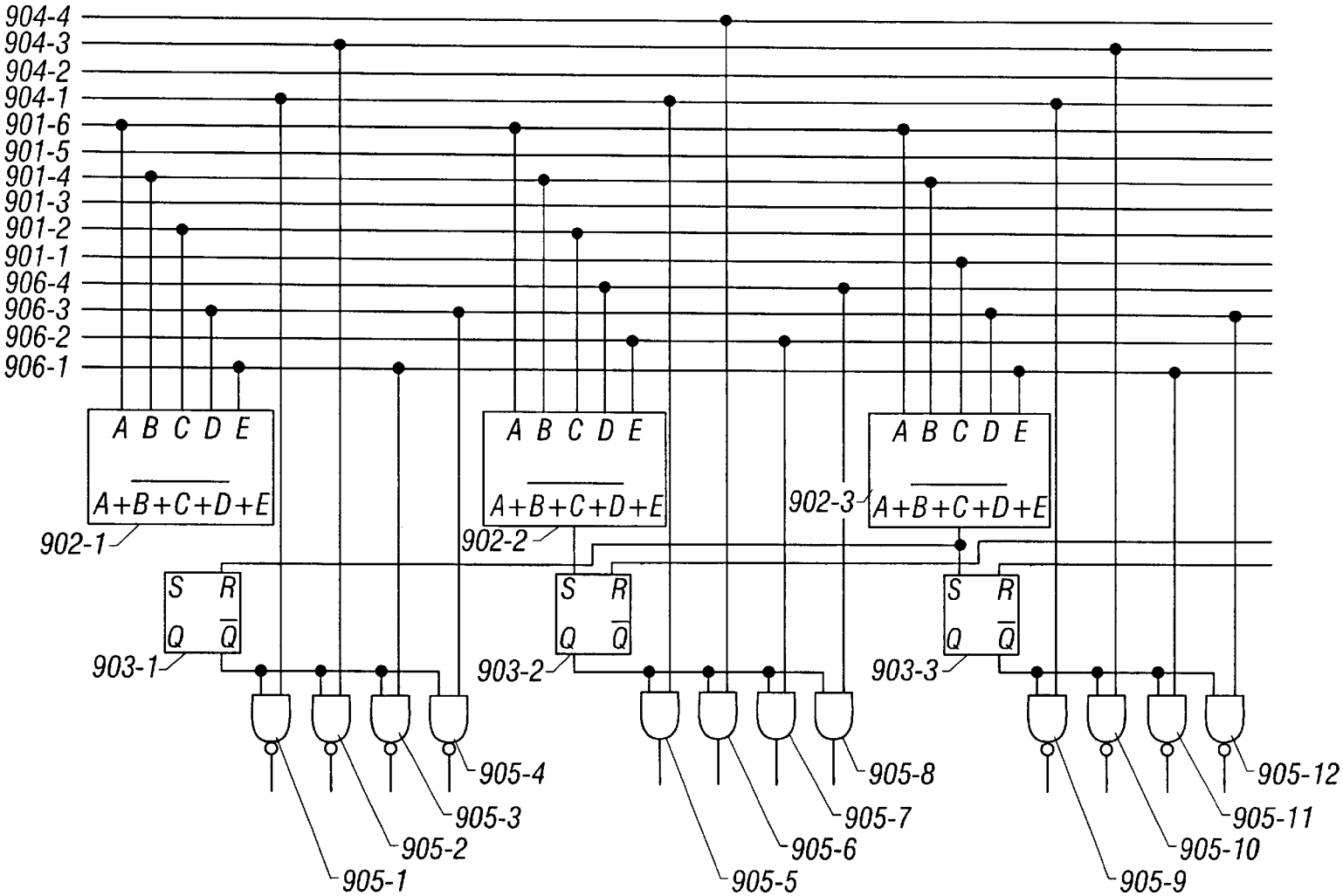
FIG. 13 is a circuit diagram showing a scanning circuit according to an eighth embodiment of the invention.

FIG. 13 shows a scanning circuit according to an eighth embodiment of the invention.

This scanning circuit consists of scan control signal lines 901, first logic circuits 902, flip-flop circuits 903, timing control signal lines 904, second logic circuits 905, and glitch preventing pulse signal lines 906. Each first logic circuit 902 performs a logic operation on signals that are input from three of the six scan control signal lines 901 and two of the four glitch preventing pulse signal lines 906, and supplies an operation result to the set terminal of one of the flip-flop circuits 903 and the reset terminal of another flip-flop circuit 903 such that each flip-flop circuit 903 receives at its reset terminal a signal coming from a first logic circuit 902 that is located two stages after a first logic circuit 902 that supplies a signal to the set terminal of the same flip-flop circuit 903. Each flip-flop circuit 903 supplies a signal to four second logic circuits 905. Each second logic circuit 905 performs a logic operation on signals that are supplied from the corresponding flip-flop circuit 903 and timing control signal line 904, and outputs an operation result.

Figure 14:
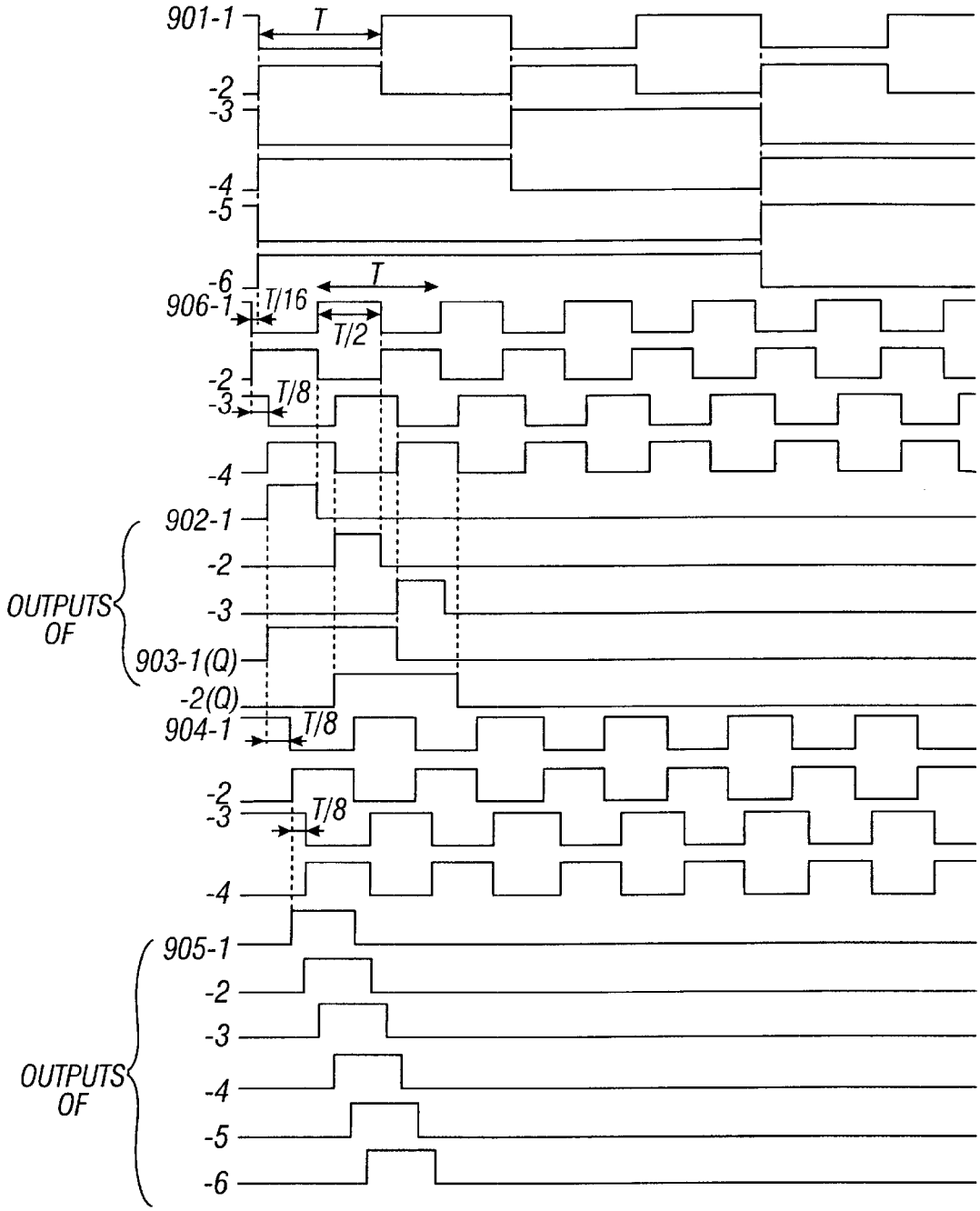
FIG. 14 is a timing chart of the scanning circuit of FIG. 13.

FIG. 14 is a timing chart of this scanning circuit. Signals on the scan control signal lines 901-1 to 901-6 correspond to signals of the scan control signal lines 801-1 to 801-6 of the seventh embodiment, respectively. On the other hand, a signal on the glitch preventing pulse signal line 906-1 falls T/16 before a rise and a fall of a signal on the scan control signal line 901-1 (T: switching interval of a signal on the scan control signal line 901-1), and has a cycle of T and a duty cycle of 50%. A signal on the glitch preventing pulse signal line 906-3 is a signal obtained by delaying, by T/8, the signal on the glitch preventing pulse signal line 906-1. Signals on the glitch preventing pulse signal lines 906-2 and 906-4 are signals whose polarities are reverse to those of the signals on the glitch preventing pulse signal lines 906-1 and 906-3, respectively.

One of the scan control signal lines 901-5 and 901-6 is connected to terminal A of each first logic circuit 902. One of the scan control signal lines 901-3 and 901-4 is connected to terminal B. One of the scan control signal lines 901-1 and 901-2 is connected to terminal C. One of the glitch preventing pulse signal lines 906-1 and 906-2 is connected to terminal D. One of the glitch preventing pulse signal lines 906-3 and 906-4 is connected to terminal E. The combinations of terminals A–E, the scan control signal lines 901, and the glitch preventing pulse signal lines 906 are different for the respective first logic circuits 902. The first logic circuit 902-1 outputs a pulse when signals on all of the scan control signal lines 901-1, 901-3, and 901-5 and the glitch preventing pulse signal lines 906-1 and 906-3, which are connected to the first logic circuit 902-1, are Low. The first logic circuit 902-2 outputs a pulse when signals on all of the scan control signal lines 901-1, 901-3, and 901-5 and the glitch preventing pulse signal lines 906-1 and 906-2, which are connected to the first logic circuit 902-2, are Low. The first logic circuit 902-3 outputs a pulse when signals on all of the scan control signal lines 901-2, 901-3, and 901-5 and the glitch preventing pulse signal lines 906-1 and 906-3, which are connected to the first logic circuit 902-3, are Low. Therefore, the first logic circuits 902 produce pulse signals that have a pulse width of 3T/8 and phases deviated from each other by T/2, in which the odd-stage first logic circuits 902 produce pulse signals that rise in synchronism with falls of a signal on the glitch preventing pulse signal line 906-3 and the evenstage first logic circuits 902 produce pulse signals that rise in synchronism with falls of a signal on the glitch preventing pulse signal line 906-4. Since a signal on the glitch preventing pulse signal line 906-3 falls after switching of signals on the scan control signal lines 901 and a signal on the glitch preventing pulse signal line 906-4 rises before switching of the signals on the scan control signal lines 901, each first logic circuit 902 never outputs a signal at a time point when a signal on the scan control signal line 901 is switched. Therefore, there can be prevented glitches which would otherwise occur due to timing deviations of signals on the scan control signal lines 901.

The flip-flop circuit 903-1 is set in synchronism with a rise of the output of the first logic circuit 902-1, and is reset in synchronism with a rise of the output of the first logic circuit 902-3. Therefore, the flip-flop circuit 903-1 is set and reset in synchronism with falls of a signal on the glitch preventing pulse signal line 906-3.

On the other hand, a signal on the timing control signal line 904-1 is a signal obtained by delaying, by T/8, a signal on the glitch preventing pulse signal line 906-3, and a signal on the timing control signal line 904-3 is a signal obtained by delaying, by T/8, the signal on the timing control signal line 904-1. Signals on the timing control signal lines 904-2 and 904-4 are signals whose polarities are reverse to those of the signals on the timing control signal lines 904-1 904-3, respectively. Therefore, signals on the timing control signal lines 904-2 and 904-4 and signals on the glitch preventing pulse signal lines 906-1 and 906-3 sequentially rise after the flip-flop circuit 903-1 is set, and sequentially fall before or approximately at the same time as the flip-flop circuit 903-1 is reset.

Since the second logic circuits 905-1 to 905-4 take AND of a positive logic output signal of the flip-flop circuit 903-1 and signals on the timing control signal lines 904-2 and 904-4 and the glitch preventing pulse signal lines 906-1 and 906-3, respectively, they output pulses while the signals on the timing control signal lines 904-2 and 904-4 and the glitch preventing pulse signal lines 906-1 and 906-3 are High in a period from the setting to the resetting of the flip-flop circuit 903-1. In this manner, pulse signals having the same pulse width and deviated from each other by a fixed time are produced.

Similarly, the flip-flop circuit 903-2 is set and reset in synchronism with falls of a signal on the glitch preventing pulse signal line 906-4.

On the other hand, signals on the timing control signal lines 904-1 and 904-3 and the glitch preventing pulse signal lines 906-2 and 906-4 sequentially rise after the flip-flop circuit 903-2 is set, and sequentially fall before or approximately at the same time as the flip-flop circuit 903-2 is reset.

Since the second logic circuits 905-5 to 905-8 take AND of a positive logic output signal of the flip-flop circuit 903-2 and signals on the timing control signal lines 904-1 and 904-3 and the glitch preventing pulse signal lines 906-2 and 906-4, respectively (outputs of the second logic circuits 905-7 and 905-8 are not shown in FIG. 14), they output pulses while the signals on the timing control signal lines 904-1 and 904-3 and the glitch preventing pulse signal lines 906-2 and 906-4 are High in a period from the setting to the resetting of the flip-flop circuit 903-2. In this manner, pulse signals having the same pulse width and deviated from each other by a fixed time are produced.

The scanning circuit thus constructed produces pulse signals having the same pulse width and deviated from each other by a fixed time, that is, operates as a scanning circuit.

The number of signal lines connected to the scanning circuit is 6+4+4=14, which is less than a half of a number 8×4=32 that would be obtained when the scheme of this embodiment of selecting three of six scan control signal lines is applied to the conventional method of FIGS. 33 and 34. Accordingly, the circuit scale and the parasitic capacitances occurring in the wiring can be reduced from the conventional case.

In addition, as in the case of the fourth and seventh embodiments, the total number of switching per second from High to Low or Low to High of signals on the scan control signal lines 901 and the glitch preventing pulse signal lines 906 is smaller than in the conventional case. This, combined with reduction in parasitic capacitances occurring in the wiring, can reduce the power consumption.

Further, since no glitches occur in the first logic circuits 902, there occurs no erroneous operation in the flip-flop circuits 903. Thus, the scanning circuit can produce scanning signals at the required timing.

Further, because of the design in which the signal output timing of each first logic circuit 902 is adjusted by the combination of the scan control signal lines 901 and the glitch preventing pulse signal line 906 connected thereto, the respective first logic circuits 902 can have the same configuration.

Embodiment 9

Figure 15:
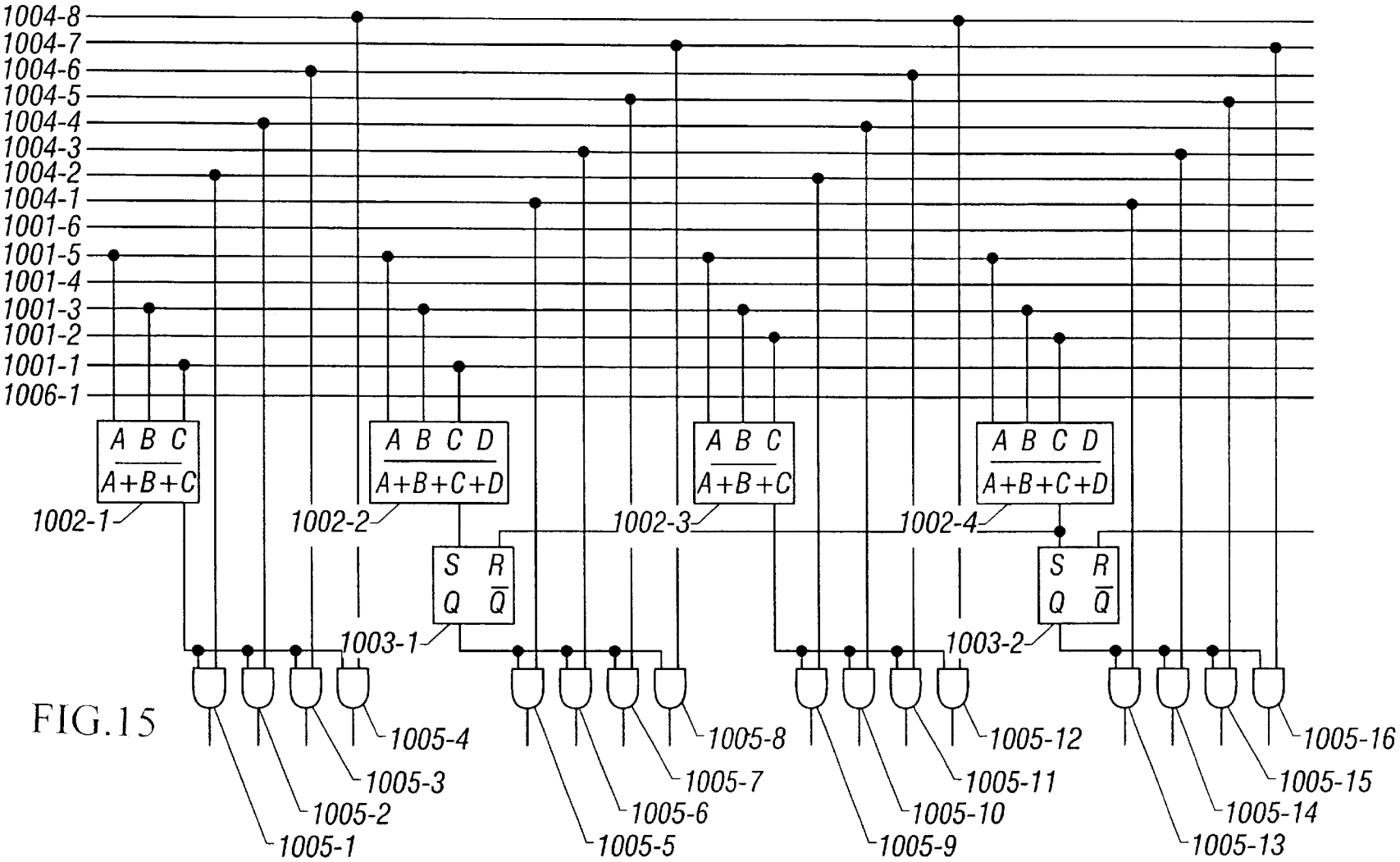
FIG. 15 is a circuit diagram showing a scanning circuit according to a ninth embodiment of the invention.

FIG. 15 shows a scanning circuit according to a ninth embodiment of the invention.

This scanning circuit consists of scan control signal lines 1001, first logic circuits 1002, flip-flop circuits 1003, timing control signal lines 1004, second logic circuits 1005, and a glitch preventing pulse signal line 1006. Each first logic circuit 1002 performs a logic operation on signals that are input from three of the six scan control signal lines 1001 and the single glitch preventing pulse signal line 1006. Each odd-stage first logic circuit 1002 supplies an operation result to four second logic circuits 1005. Each even-stage first logic circuit 1002 supplies an operation result to the set terminal of one of the flip-flop circuits 1003 and the reset terminal of another flip-flop circuit 1003 such that each flip-flop circuit 1003 receives at its reset terminal a signal coming from a first logic circuit 1002 that is located two stages after a first logic circuit 1002 that supplies a signal to the set terminal of the same flip-flop circuit 1003. Like the odd-stage first logic circuits 1002, each flip-flop circuit 1003 supplies a signal to four second logic circuits 1005. Each second logic circuit 1005 performs a logic operation on a signal that is supplied from the corresponding first logic circuit 1002 or flip-flop circuit 1003 and a signal that is supplied from the corresponding timing control signal line 1004, and outputs an operation result.

Figure 16:
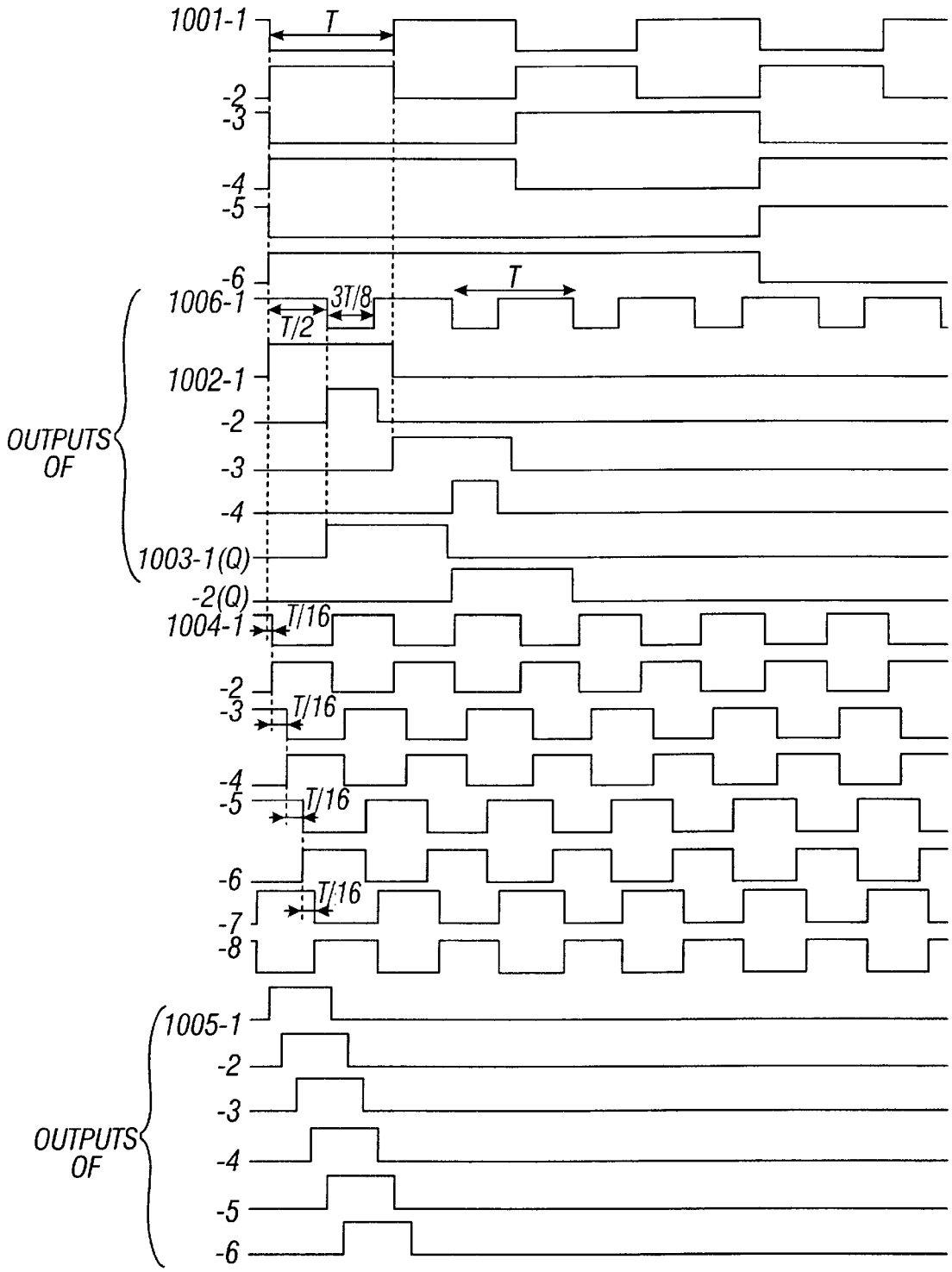
FIG. 16 is a timing chart of the scanning circuit of FIG. 15.

FIG. 16 is a timing chart of this scanning circuit. Signals on the scan control signal lines 1001-1 to 1001-6 correspond to signals of the scan control signal lines 701-1 to 701-6 of the sixth embodiment or the scan control signal lines 901-1 to 901-6 of the eighth embodiment, respectively. A signal on the glitch preventing pulse signal line 1006 has a cycle T (T: switching interval of the scan control,signal line 1001-1), is Low during a period of 3T/8, and falls T/2 after a rise and a fall of a signal on the scan control signal line 1001-1.

One of the scan control signal lines 1001-5 and 1001-6 is connected to terminal A of each first logic circuit 1002. One of the scan control signal lines 1001-3 and 1001-4 is connected to terminal B. One of the scan control signal lines 1001-1 and 1001-2 is connected to terminal C. The glitch preventing pulse signal lines 1006 is connected to terminal D, which exists only in the even-stage first logic circuits 1002. The combinations of terminals A–C, the scan control signal lines 1001, and the glitch preventing pulse signal lines 1006 are different for the respective first logic circuits 1002. The first logic circuit 1002-1 outputs a pulse when signals on all of the scan control signal lines 1001-1, 1001-3, and 1001-5, which are connected to the first logic circuit 1002-1, are Low. The first logic circuit 1002-2 outputs a pulse when signals on all of the scan control signal lines 1001-1, 1001-3, and 1001-5 and the glitch preventing pulse signal line 1006, which are connected to the first logic circuit 10012, are Low. The first logic circuit 1002-3 outputs a pulse when signals on all of the scan control signal lines 1001-2, 1001-3, and 1001-5 and the glitch preventing pulse signal line 1006, which are connected to the first logic circuit 1002-3, are Low. Therefore, the odd-stage first logic circuits 1002 produce pulse signals which have a pulse width of T and phases deviated from each other by T/2, and rise in synchronism with a rise or fall of a signal on the scan control signal line 1001-1. The even-stage first logic circuits 1002 produce pulse signals which have a pulse width of T and phases deviated from each other by 3T/8, and rise in synchronism with a fall of a signal on the glitch preventing pulse signal line 1006. Since signals on the glitch preventing pulse signal lines 1006 fall after switching of signals on the scan control signal lines 1001 and rise before switching of the signals on the scan control signal lines 1001, each first logic circuit 1002 never outputs a signal at a time point when a signal on the scan control signal line 1001 is switched. Therefore, there can be prevented glitches which would otherwise occur due to timing deviations of signals on the scan control signal lines 1001.

A signal on the timing control signal line 1004-1 falls T/16 after a fall of a signal on the scan control signal line 1001-1, and has a cycle of T (T: switching interval of the signal on the scan control signal line 1001-1) and a duty cycle of 50%. Signals on the timing control signal lines 1004-3, 1004-5, and 1004-7 are signals obtained by delaying, by T/8, signals on the timing control signal lines 1004-1, 1004-3, and 1004-5, respectively. Signals on the timing control signal lines 1004-2, 1004-4, 1004-6, and 1004-8 are signals whose polarities are reverse to those of signals on the timing control signal lines 1004-1, 1004-3, 1004-5, and 1004-7, respectively. Therefore, signals on the timing control signal lines 1004-2, 1004-4, 1004-6, and 1004-8 sequentially rise after a rise of the output signal of the first logic circuit 1002-1, and sequentially fall before a fall thereof. Since the second logic circuits 1005-1 to 1005-4 produces an AND result of an output signal of the first logic circuit 1002-1 and signals on the timing control signal lines 1004-2, 1004-4, 1004-6, and 1004-8, they output pulses while the output signal of the first logic circuit 1002-1 and the signals on the timing control signal lines 1004-2, 1004-4, 1004-6, and 1004-8 are High. In this manner, pulse signals having the same pulse width and deviated from each other by a fixed time are produced.

The flip-flop circuit 1003-1 is set in synchronism with a rise of the output of the first logic circuit 1002-1, and is reset in synchronism with a rise of the output of the first logic circuit 1002-4. Therefore, the flip-flop circuit 1003-1 is set and reset in synchronism with falls of a signal on the glitch preventing pulse signal line 1006-1.

On the other hand, signals on the timing control signal lines 1004-1, 1004-3, 1004-5, and 1004-7 sequentially rise after the flip-flop circuit 1003-1 is set, and sequentially fall before the flip-flop circuit 1003-1 is reset.

Since the second logic circuits 1005-5 to 1005-8 take AND of a positive logic output signal of the flip-flop circuit 1003-1 and signals on the timing control signal lines 1004-1, 1004-3, 1004-5, and 1004-7, respectively (outputs of the second logic circuits 1005-7 and 1005-8 are not shown in FIG. 16), they output pulses while the signals on the timing control signal lines 1004-1, 1004-3, 1004-5, and 1004-7 are High in a period from the setting to the resetting of the flip-flop circuit 1003-1. In this manner, pulse signals having the same pulse width and deviated from each other by a fixed time are produced.

The scanning circuit thus constructed produces pulse signals having the same pulse width and deviated from each other by a fixed time, that is, operates as a scanning circuit.

The number of signal lines connected to the scanning circuit is 6+8+1=15, which is less than a half of a number 8×4=32 that would be obtained when the scheme of this embodiment of selecting three of six scan control signal lines is applied to the conventional method of FIGS. 33 and 34. Accordingly, the circuit scale and the parasitic capacitances occurring in the wiring can be reduced from the conventional case.

In addition, as in the case of the fourth and eighth embodiments, the total number of switching per second from High to Low or Low to High of signals on the scan control signal lines 1001 and the glitch preventing pulse signal line 1006 is smaller than in the conventional case. This, combined with reduction in parasitic capacitances occurring in the wiring, can reduce the power consumption.

Further, since the second logic circuits 1005 that are connected to the odd-stage first logic circuits 1002 do not produce any signals at time points when the first logic circuits generate glitches and the even-stage first logic circuits 1002 generate no glitches, there occurs no erroneous operation in the flip-flop circuits 1003. Thus, the scanning circuit can produce scanning signals at the required timing.

Further, because of the design in which the signal output timing of each first logic circuit 1002 is adjusted by the combination of the scan control signal lines 1001 and the glitch preventing pulse signal line 1006 connected thereto, each of the odd-stage first logic circuits 1002 and the even-stage first logic circuits 1002 can have the same configuration.

Still further, since one flip-flop circuit 1003 is provided for two stages, the configuration of the scanning circuit can be simplified.

Embodiment 10

Figure 17:
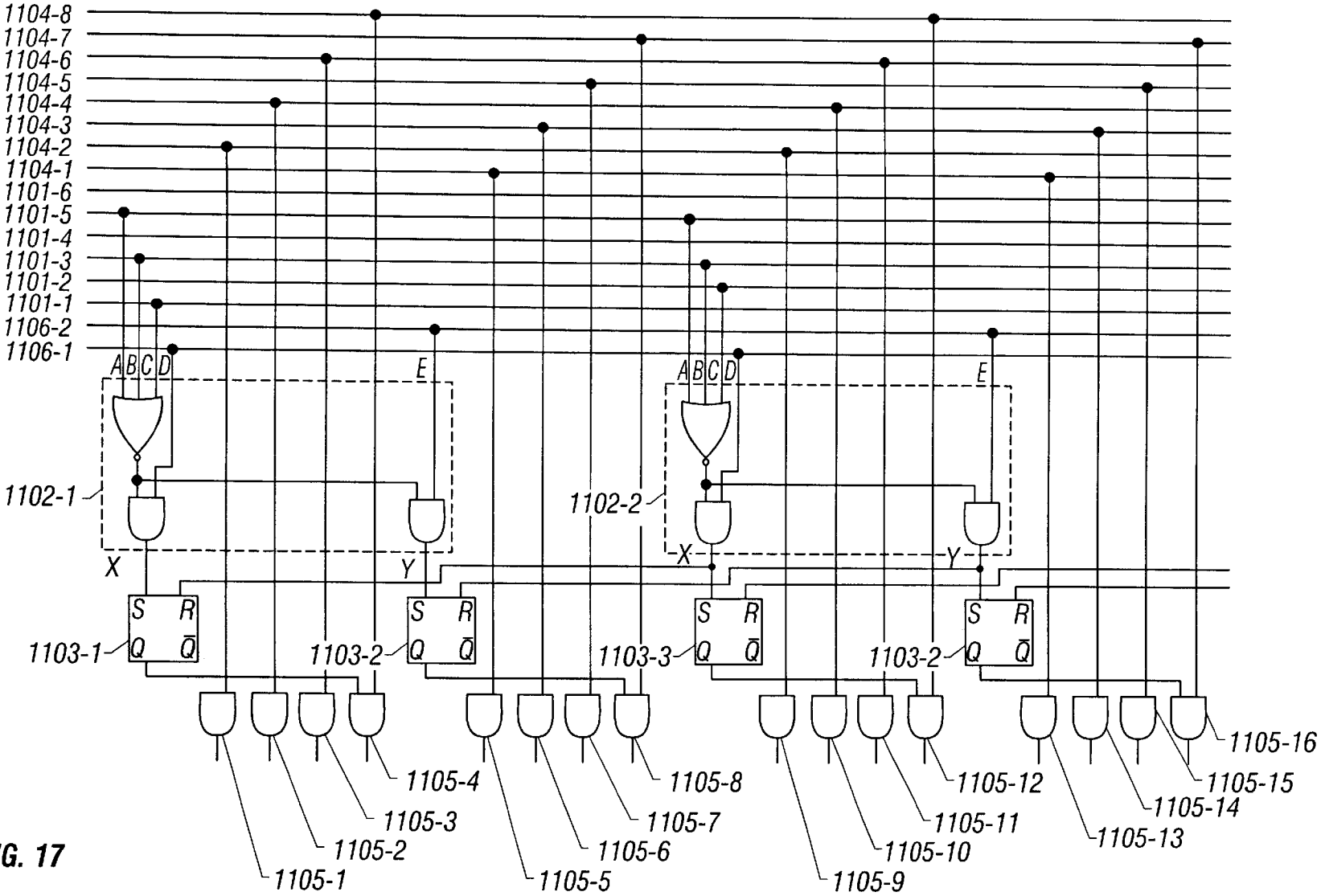
FIG. 17 is a circuit diagram showing a scanning circuit according to a tenth embodiment of the invention.

FIG. 17 shows a scanning circuit according to a tenth embodiment of the invention.

This scanning circuit consists of scan control signal lines 1101, first logic circuits 1102, flip-flop circuits 1103, timing control signal lines 1104, second logic circuits 1105, and glitch preventing pulse signal lines 1106. Each first logic circuit 1102 performs a logic operation on signals that are input from three of the six scan control signal lines 1101 and the two glitch preventing pulse signal lines 1106, and supplies operation results, i.e., two outputs, to the set and reset terminals of different flip-flop circuits 1103 such that each flip-flop circuit 1103 receives at its reset terminal a signal coming from a first logic circuit 1102 that is located one stage after a first logic circuit 1102 that supplies a signal to the set terminal of the same flip-flop circuit 1103. Each flip-flop circuit 1103 supplies a signal to four second logic circuits 1105. Each second logic circuit 1105 performs a logic operation on signals that are supplied from the corresponding flip-flop circuit 1103 and timing control signal line 1104, and outputs an operation result.

Figure 18:
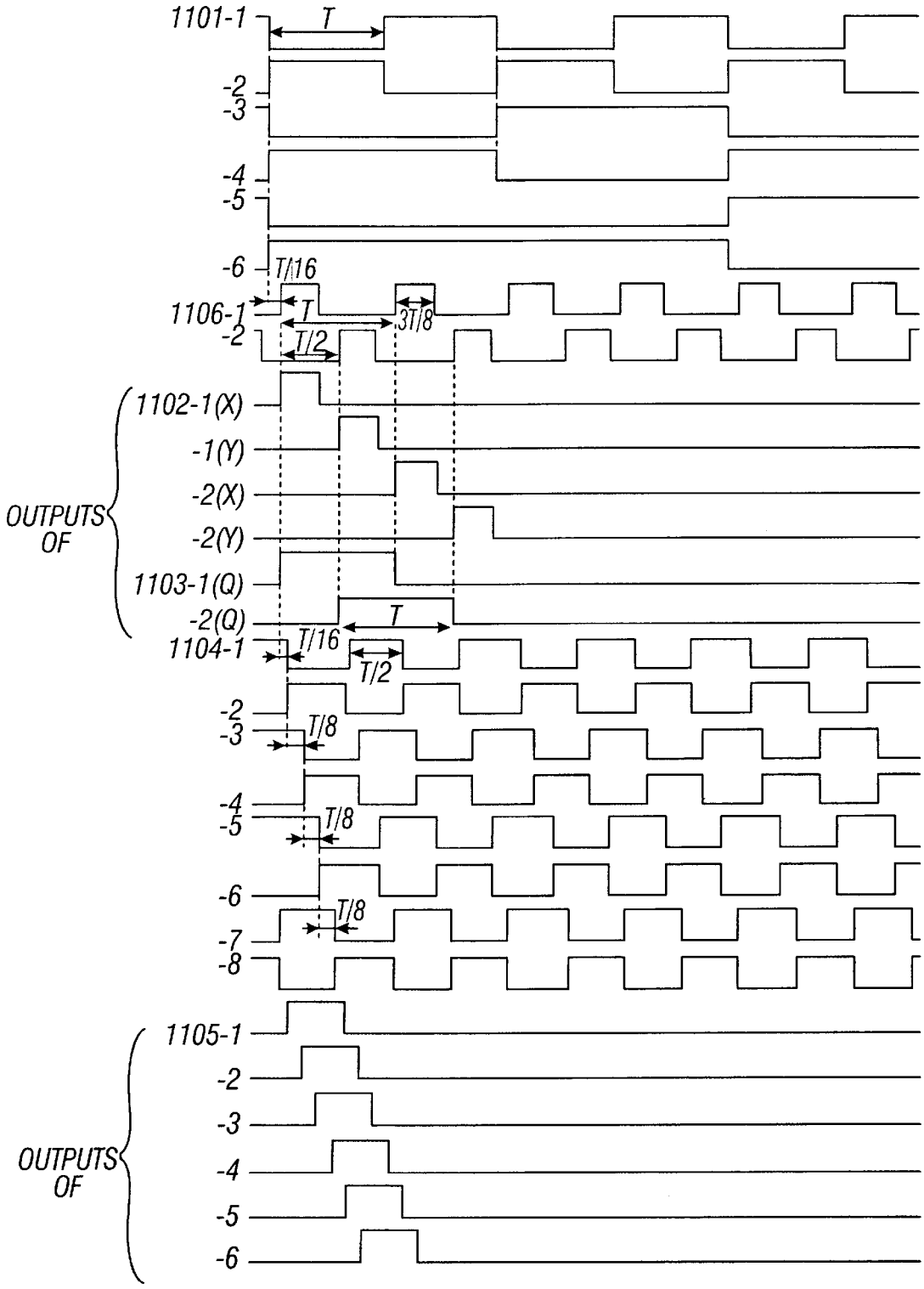
FIG. 18 is a timing chart of the scanning circuit of FIG. 17.

FIG. 18 is a timing chart of this scanning circuit. Signals on the scan control signal lines 1101-1 to 1101-6 correspond to signals of the scan control signal lines of the sixth, eighth, and ninth embodiments, respectively. On the other hand, signals on the glitch preventing pulse signal lines 1106 are signals whose polarities are reverse to those of signals on the glitch preventing pulse signal lines of the second, third, and fourth embodiments, respectively.

One of the scan control signal lines 1101-5 and 1101-6 is connected to terminal A of each first logic circuit 1102. One of the scan control signal lines 1101-3 and 1101-4 is connected to terminal B. One of the scan control signal lines 1101-1 and 1101-2 is connected to terminal C. The glitch preventing pulse signal lines 1106-1 and 1106-2 are connected to terminals D and E, respectively. The combinations of terminals A–C and the scan control signal lines 1101 are different for the respective first logic circuits 1102. The first logic circuit 1102-1 outputs a pulse at its output terminal X when signals on all of the scan control signal lines 1101-1, 1101-3, and 1101-5, which are connected to the terminal A to C of the first logic circuit 1102-1, are Low and a signal on the glitch preventing pulse signal line 1106-1 is High. On the other hand, the first logic circuit 1102-1 outputs a pulse at its output terminal Y when signals on all of the scan control signal lines 1101-1, 1101-3, and 1101-5 are Low and a signal on the glitch preventing pulse signal line 1106-2 is High. Similarly, the first logic circuit 1102-2 outputs a pulse at its output terminal X when signals on all of the scan control signal lines 1101-2, 1101-3, and 1101-5, which are connected to the terminal A to C of the first logic circuit 1102-2, are Low and a signal on the glitch preventing pulse signal line 1106-1 is High. On the other hand, the first logic circuit 1102-2 outputs a pulse at its output terminal Y when signals on all of the scan control signal lines 1101-2, 1101-3, and 1101-5 and the glitch preventing pulse signal line 1106-2 is Low. Therefore, the first logic circuits 1102 produce pulse signals that have a pulse width of 3T/8 and phases deviated from each other by T/2, in which pulse signals at the output terminal X rise in synchronism with rises of a signal on the glitch preventing pulse signal line 1106-1 and pulse signals at the output terminals Y rise in synchronism with rises of a signal on the glitch preventing pulse signal line 1106-2. Since signals on the glitch preventing pulse signal lines 1106 rise after switching of signals on the scan control signal lines 1101 and fall before switching of the signals on the scan control signal lines 1101, each first logic circuit 1102 never outputs a signal at a time point when a signal on the scan control signal line 1101 is switched. Therefore, there can be prevented glitches which would otherwise occur due to timing deviations of signals on the scan control signal lines 1101.

The flip-flop circuit 1103-1 is set in synchronism with a rise of the output at terminal X of the first logic circuit 1102-1, and is reset in synchronism with a rise of the output at terminal X of the first logic circuit 1102-2. Therefore, the flip-flop circuit 1103-1 is set and reset in synchronism with rises of a signal on the glitch preventing pulse signal line 1106-1.

On the other hand, a signal on the timing control signal line 1104-1 falls T/16 after a rise of a signal on the glitch preventing pulse signal line 1106-1, and has a cycle of T and a duty cycle of 50%. Signals on the timing control signal lines 1104-3, 1104-5, and 1104-7 are signals obtained by delaying, by T/8, signals on the timing control signal lines 1104-1, 1104-3, and 1104-5, respectively. Signals on the timing control signal lines 1104-2, 1104-4, 1104-6, and 1104-8 are signals whose polarities are reverse to those of signals on the timing control signal lines 1104-1, 1104-3, 1104-5, and 1104-7, respectively. Therefore, signals on the timing control signal lines 1104-2, 1104-4, 1104-6, and 1104-8 sequentially rise after the flip-flop circuit 1103-1 is set, and sequentially fall before the flip-flop circuit 1103-1 is reset.

Since the second logic circuits 1105-1 to 1105-4 take AND of a positive logic output signal of the flip-flop circuit 1103-1 and signals on the timing control signal lines 1104-2, 1104-4, 1104-6, and 1104-8, respectively, they output pulses while the signals on the timing control signal lines 1104-2, 1104-4, 1104-6, and 1104-8 are High in a period from the setting to the resetting of the flip-flop circuit 1103-1. In this manner, pulse signals having the same pulse width and deviated from each other by a fixed time are produced.

Similarly, the flip-flop circuit 1103-2 is set and reset in synchronism with rises of a signal on the glitch preventing pulse signal line 1106-2.

On the other hand, signals on the timing control signal lines 1104-1, 1104-3, 1104-5, and 1104-7 sequentially rise after the flip-flop circuit 1103-2 is set, and sequentially fall before the flip-flop circuit 1103-2 is reset.

Since the second logic circuits 1105-5 to 1105-8 take AND of a positive logic output signal of the flip-flop circuit 1103-2 and signals on the timing control signal lines 1104-1, 1104-3, 1104-5, and 1104-7, respectively (outputs of the second logic circuits 1105-7 and 1105-8 are not shown in FIG. 18), they output pulses while the signals on the timing control signal lines 1104-1, 1104-3, 1104-5, and 1104-7 are High in a period from the setting to the resetting of the flip-flop circuit 1103-2. In this manner, pulse signals having the same pulse width and deviated from each other by a fixed time are produced.

The scanning circuit thus constructed produces pulse signals having the same pulse width and deviated from each other by a fixed time, that is, operates as a scanning circuit.

The number of signal lines connected to the scanning circuit is 6+8+2=16, which is a half of a number 8×4=32 that would be obtained when the scheme of this embodiment of selecting three of six scan control signal lines is applied to the conventional method of FIGS. 33 and 34. Accordingly, the circuit scale and the parasitic capacitances occurring in the wiring can be reduced from the conventional case.

In addition, as in the case of the fourth to ninth embodiments, the total number of switching per second from High to Low or Low to High of signals on the scan control signal lines 1101 and the glitch preventing pulse signal lines 1106 is smaller than in the conventional case. This, combined with reduction in parasitic capacitances occurring in the wiring, can reduce the power consumption.

Further, since no glitches occur in the first logic circuits 1102, there occurs no erroneous operation in the flip-flop circuits 1103. Thus, the scanning circuit can produce scanning signals at the required timing.

Further, because of the design in which the signal output timing of each first logic circuit 1102 is adjusted by the combination of the scan control signal lines 1101 and the glitch preventing pulse signal lines 1106 connected thereto, the respective first logic circuits 1102 can have the same configuration.

Still further, since two flip-flop circuits 1103 are driven by a single first logic circuit 1102, the configuration of the scanning circuit can be simplified.

Each of the scanning circuits of the third to tenth embodiments may be provided in one or both of a data signal line driver circuit and a scan signal line driver circuit which are attached to an already assembled matrix-type image display device. Alternatively, each scanning circuit may be provided in one or both of a data signal line driver circuit and a scan signal line driver circuit which are formed on the same substrate as a matrix-type image display device as in the case of a substrate integration type. In a matrix-type image display device having the above-described scanning circuit of the invention, superior display images can be obtained because of suppression of glitches which would otherwise appear on the outputs of the scanning circuit.

Embodiment 11

This embodiment is directed to a manufacturing method of a substrate of a liquid crystal display device using an active matrix circuit.

A manufacturing process of a monolithic active matrix circuit according to this embodiment will be hereinafter described with reference to FIGS. 19A–19F. This is a low-temperature polysilicon process. The left side and the right side of FIGS. 19A–19F show manufacturing processes of TFTs of a driver circuit and a TFT of active matrix circuit, respectively.

First, a silicon oxide film of 1,000–3,000 Å in thickness is formed on a glass substrate 1201 as an undercoat oxide film 1202 by sputtering or plasma CVD in an oxygen atmosphere.

Thereafter, an amorphous silicon film is formed by plasma CVD or LPCVD at a thickness of 300–1,500 Å, preferably 500–1,000 Å. Thermal annealing is then performed at more than 500° C., preferably at 500°–600° C., to crystallize the amorphous silicon film or improve its crystallinity. Optical annealing by laser light, for instance, may be performed subsequently to further improve the crystallinity. Further, in the thermal annealing step for crystallization, an element (catalyst element) such as nickel for accelerating crystallization of silicon may be added as disclosed in Japanese Unexamined Patent Publication Nos. Hei. 6-244103 and Hei. 6-244104.

Next, the silicon film is etched into island-like active layers 1204 and 1205 respectively for p-channel and n-channel TFTs of the driver circuit and an island-like active layer for a pixel TFT of the matrix circuit. A silicon oxide gate insulating film of 500–2,000 Å in thickness is then formed by sputtering in an oxygen atmosphere. Alternatively, plasma CVD may be used, in which case good results were obtained by using a material gas of dinitrogen monoxide ($N_2O$) or a combination of oxygen ($O_2$) and monosilane ($SiH_4$).

Figure 19A:
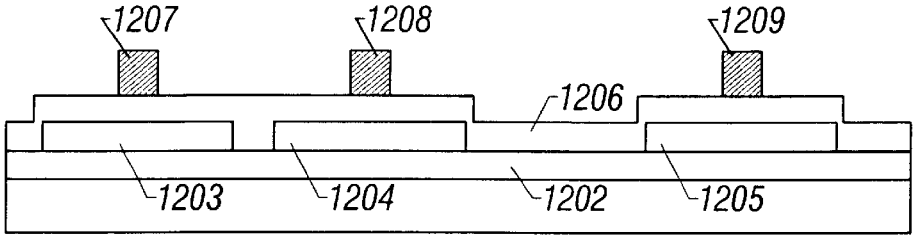
FIGS. 19A–19F show a manufacturing process of a monolithic active matrix circuit according to an eleventh embodiment of the invention.

Thereafter, an aluminum film of 2,000–6,000 Å in thickness is formed over the entire substrate surface by sputtering. To prevent occurrence of hillocks in a subsequent heating process, silicon, scandium, or palladium may be added to aluminum. The aluminum film is then etched into gate electrodes 1207–1209. (FIG. 19A)

Figure 19B:
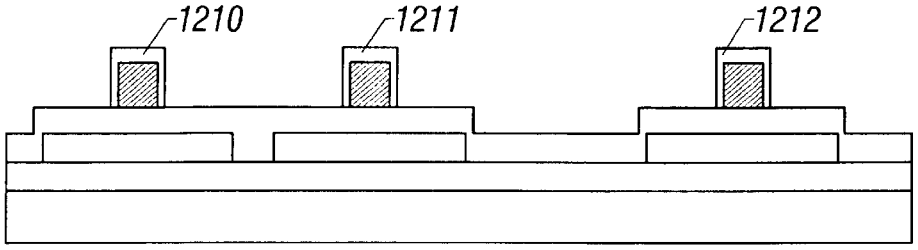

Next, the aluminum gate electrodes 1207–1209 are anodized. As a result, the surface portions of the aluminum gate electrodes 1207–1209 turn aluminum oxide films 1210–1212, which will serve as insulators. (FIG. 19B)

Figure 19C:
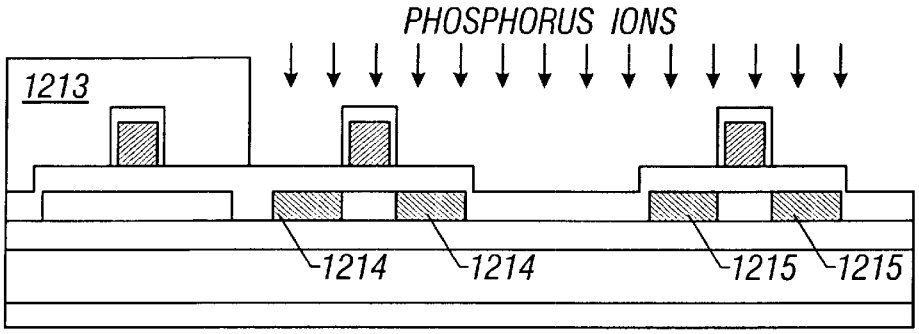

Thereafter, a photoresist mask 1213 is so formed as to cover the active layer 1203 for the p-channel TFT. Phosphorus is then implanted at a dose of $1\times10^{12}$ to $5\times10^{13}$ atoms/cm$^2$ by ion doping by using a doping gas of phosphine. As a result, strong n-type regions (source and drain) 1214 and 1215 are formed. (FIG. 19C)

Figure 19D:
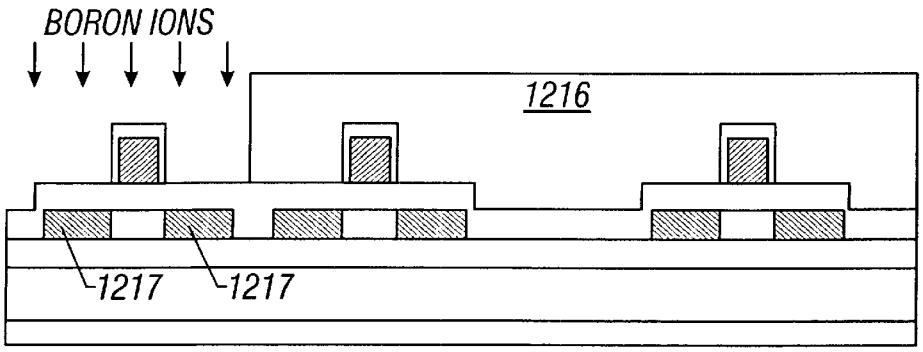

Next, a photoresist mask 1216 is so formed as to cover the active layer 1704 for the n-channel TFT and the active layer 1705 for the pixel TFT. Boron is then implanted at a dose of $5\times10^{14}$ to $8\times10^{15}$ atoms/cm$^2$ by ion doping by using a doping gas of diborane ($B_2H_6$). As a result, strong p-type regions (source and drain) 1217 are formed. (FIG. 19D)

Then, thermal annealing is performed at 450°–850° C. for 0.5–3 hours to repair doping damage, activate the doped impurities, and restore the crystallinity of silicon. A silicon oxide film of 3,000–6,000 Å in thickness as an interlayer insulating film 1218 is formed over the entire surface by plasma CVD. Instead of the silicon oxide film, a silicon nitride film or a multi-layer of a silicon oxide film and a silicon nitride film may be formed. Contact holes for the sources and drains are then formed by etching the interlayer insulating film 1218 by wet etching or dry etching.

Figure 19E:
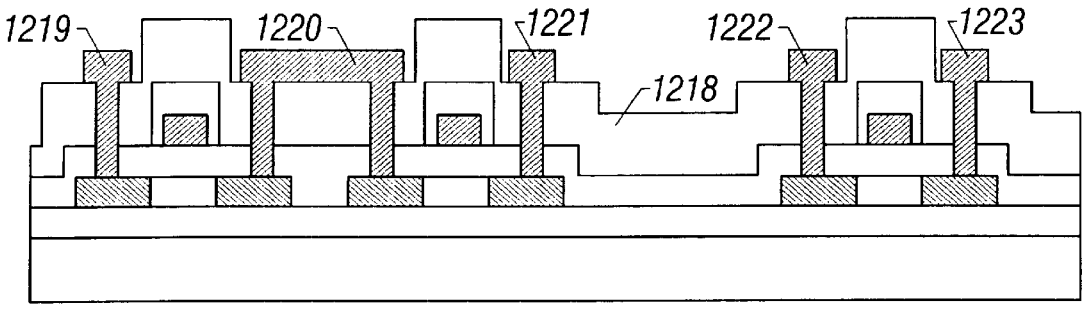

Thereafter, an aluminum film or a multi-layer film of titanium and aluminum is formed at a thickness of 2,000–6,000 Å by sputtering, and then etched into electrodes/wiring lines 1219–1221 for the driver circuit TFTs and electrodes/wiring lines 1222 and 1223 for the pixel TFT. (FIG. 19E)

Figure 19F:
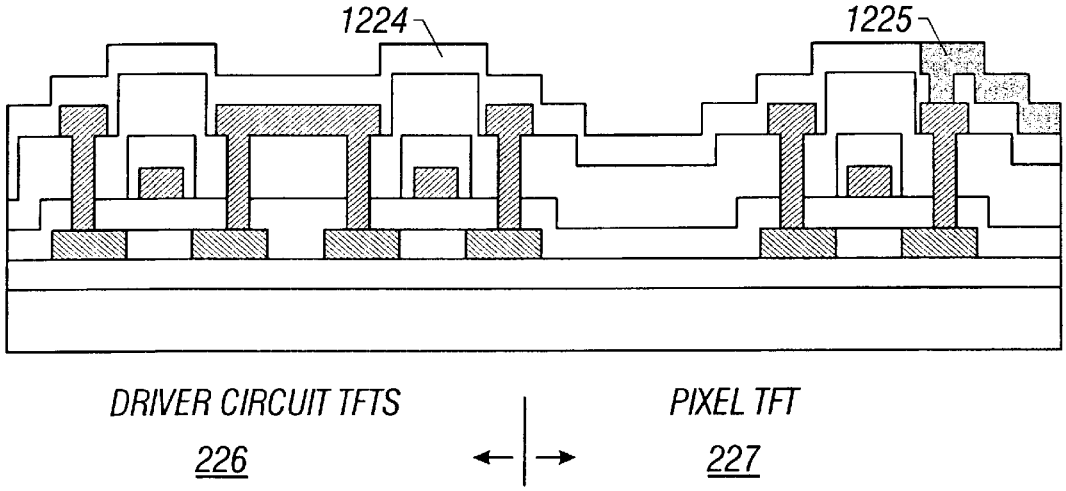
Figure 20:
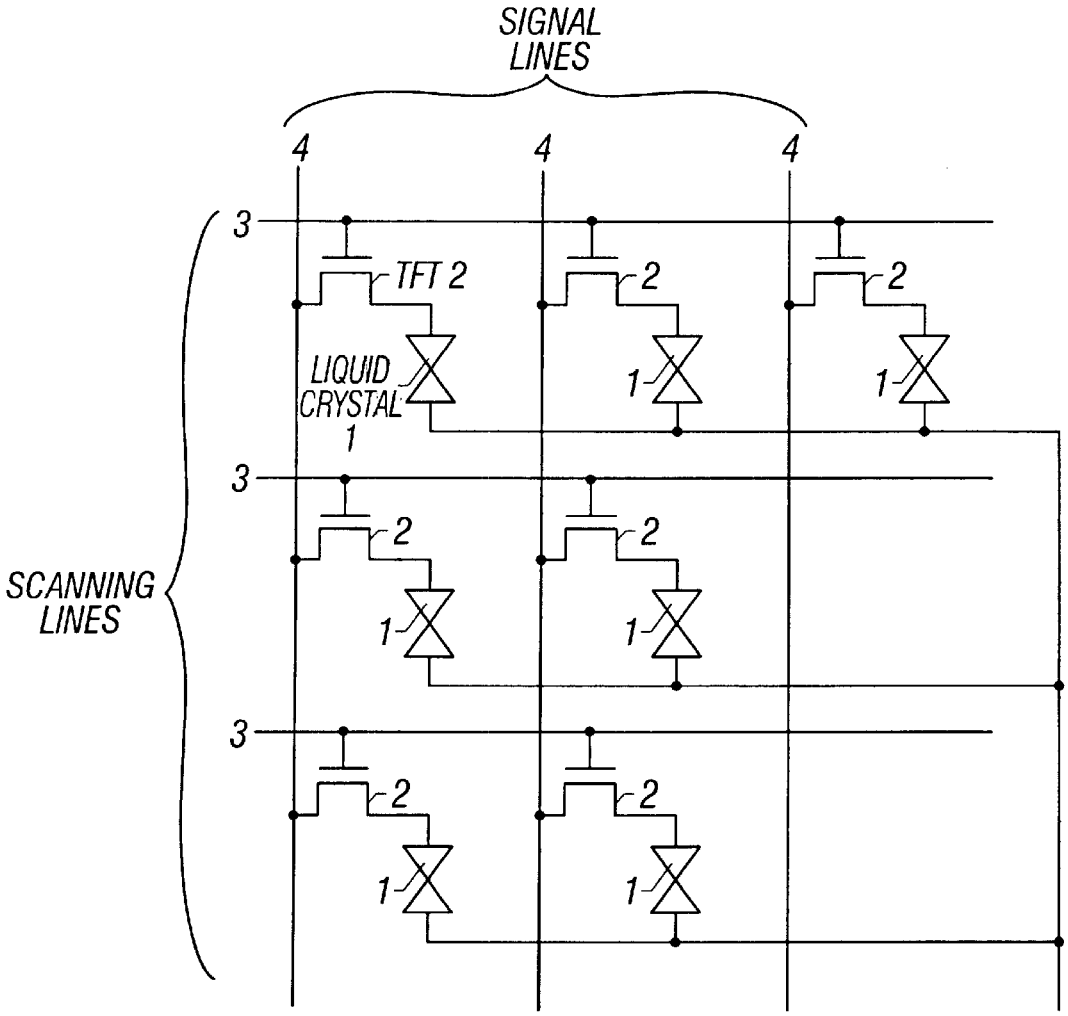
FIG. 20 (Prior Art)
FIG. 20 shows an example of a conventional active matrix using TFTs.
Figure 21A:
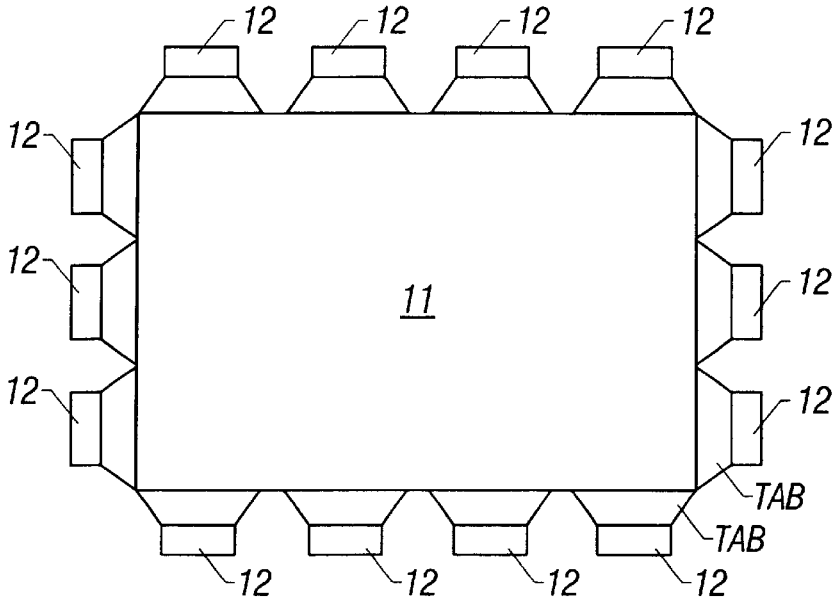
FIG. 21A (Prior Art)
FIGS. 21A and 21B show examples of conventional active matrix liquid crystal display devices using amorphous silicon TFTs.
Figure 21B:
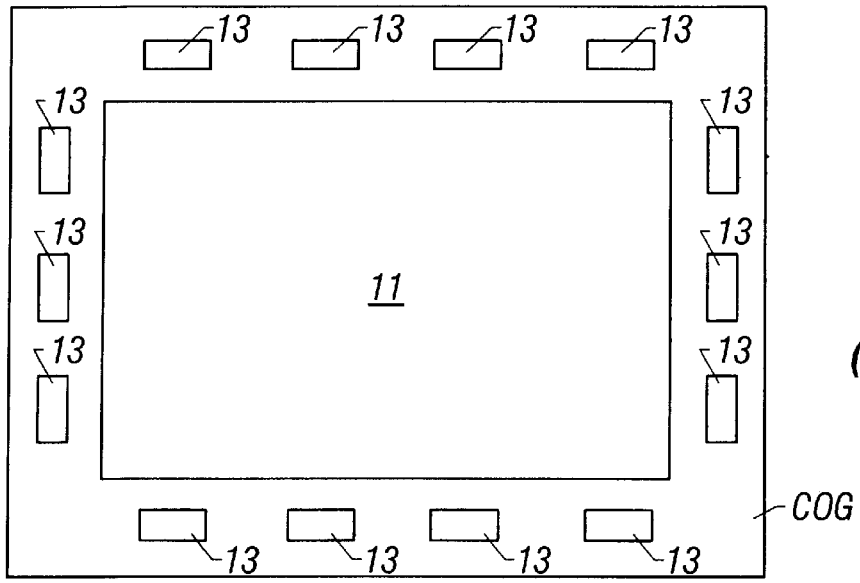
FIG. 21B (Prior Art)
Figure 22:
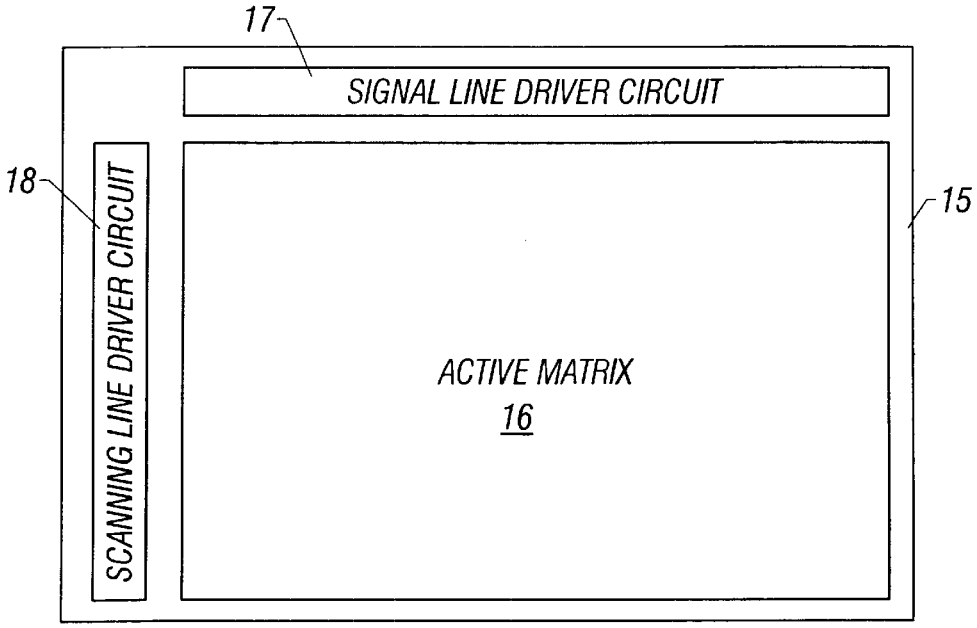
FIG. 22 (Prior Art)
FIG. 22 shows an example of a conventional active matrix liquid crystal display devices using polysilicon TFTs.
Figure 23:
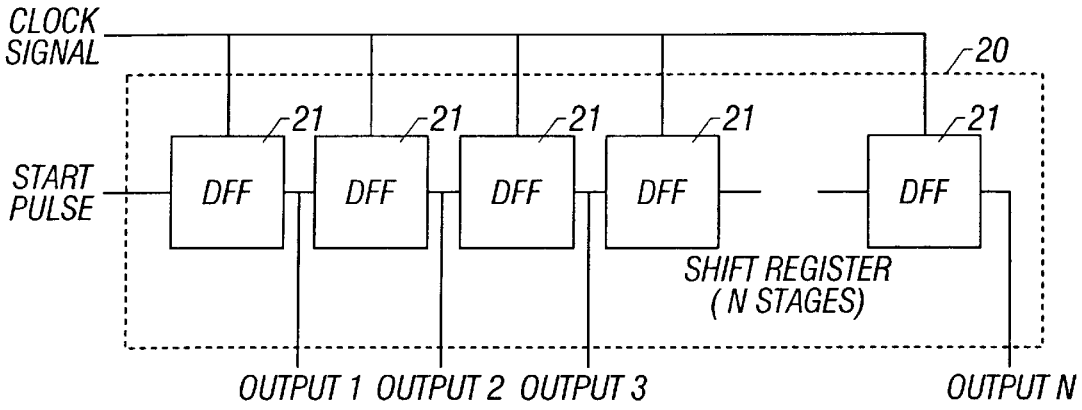
FIG. 23 (Prior Art)
FIG. 23 is a block diagram of a shift register.
Figure 24A:
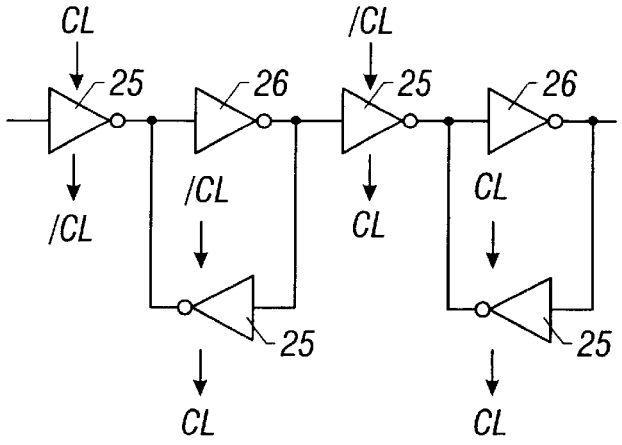
FIG. 24A (Prior Art)
FIGS. 24A–24E show circuit configurations of a DFF, a clocked inverter, and an inverter.
Figure 24B:
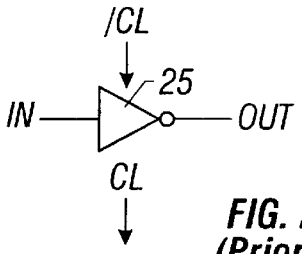
FIG. 24B (Prior Art)
Figure 24C:
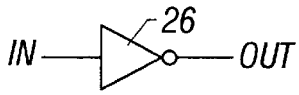
FIG. 24C (Prior Art)
Figure 24D:
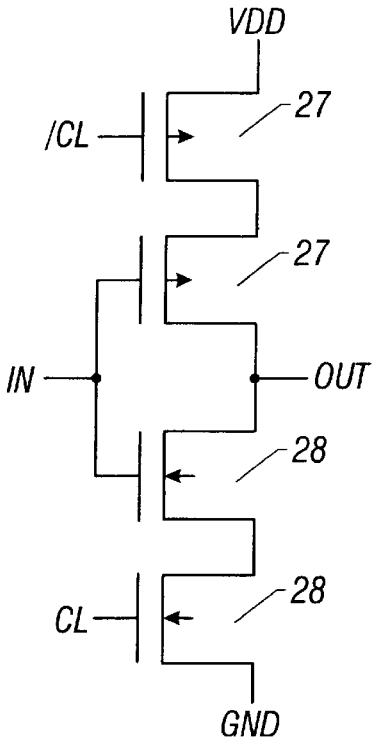
FIG. 24D (Prior Art)
Figure 24E:
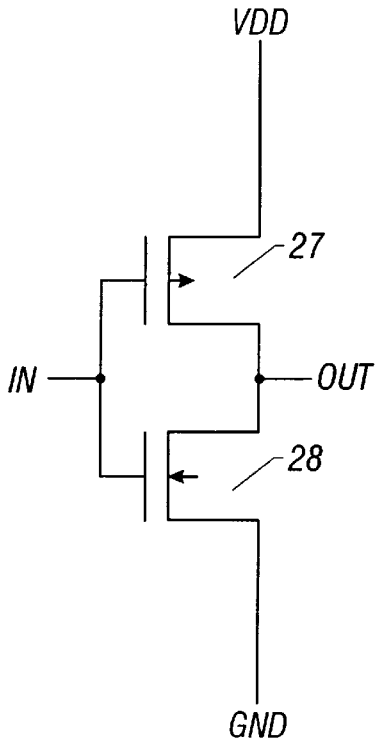
FIG. 24E (Prior Art)
Figure 25A:
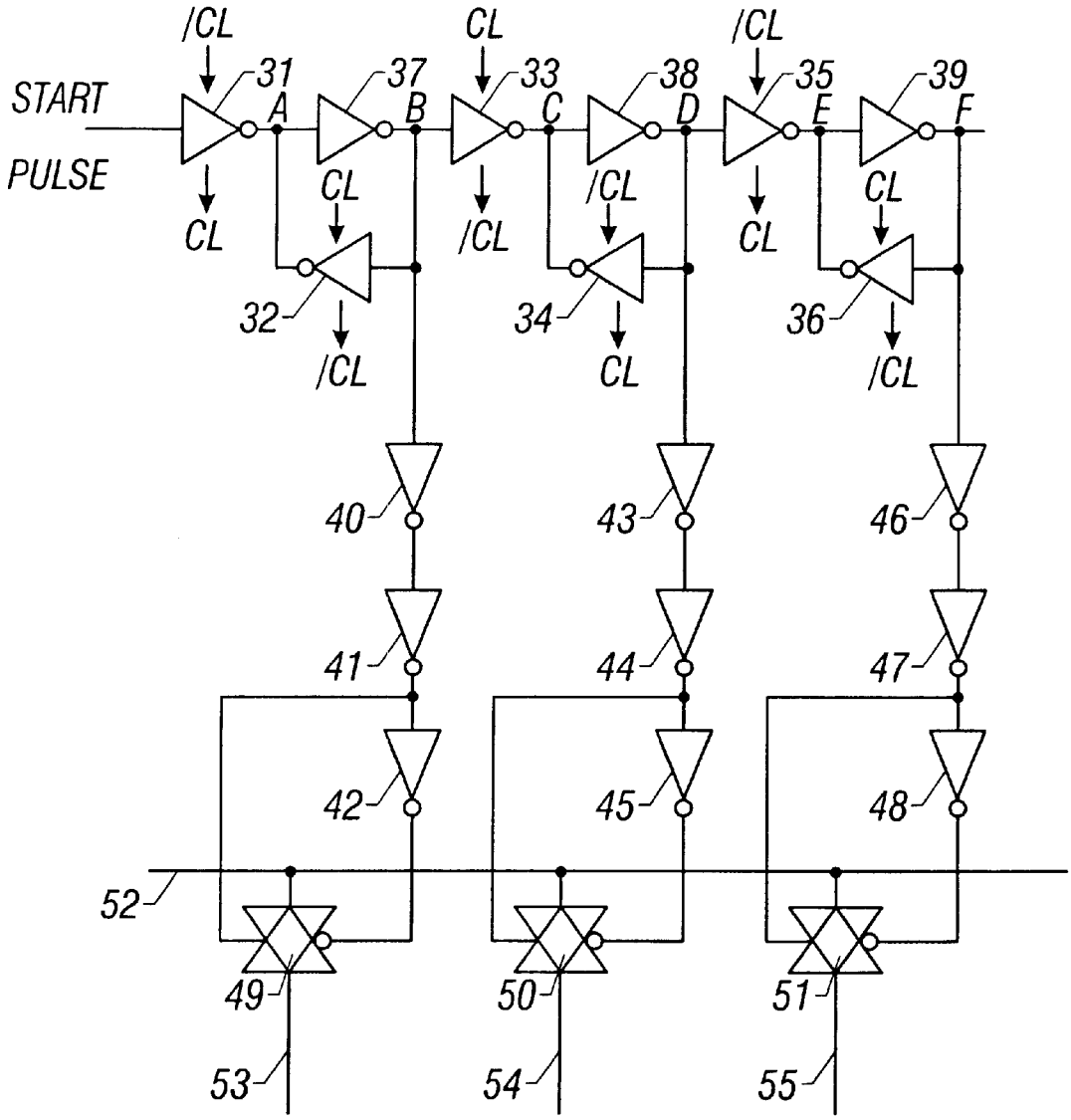
FIG. 25A (Prior Art)
FIGS. 25A and 25B are a block diagram and a timing chart, respectively, of a signal line driver circuit using a shift register.
Figure 25B:
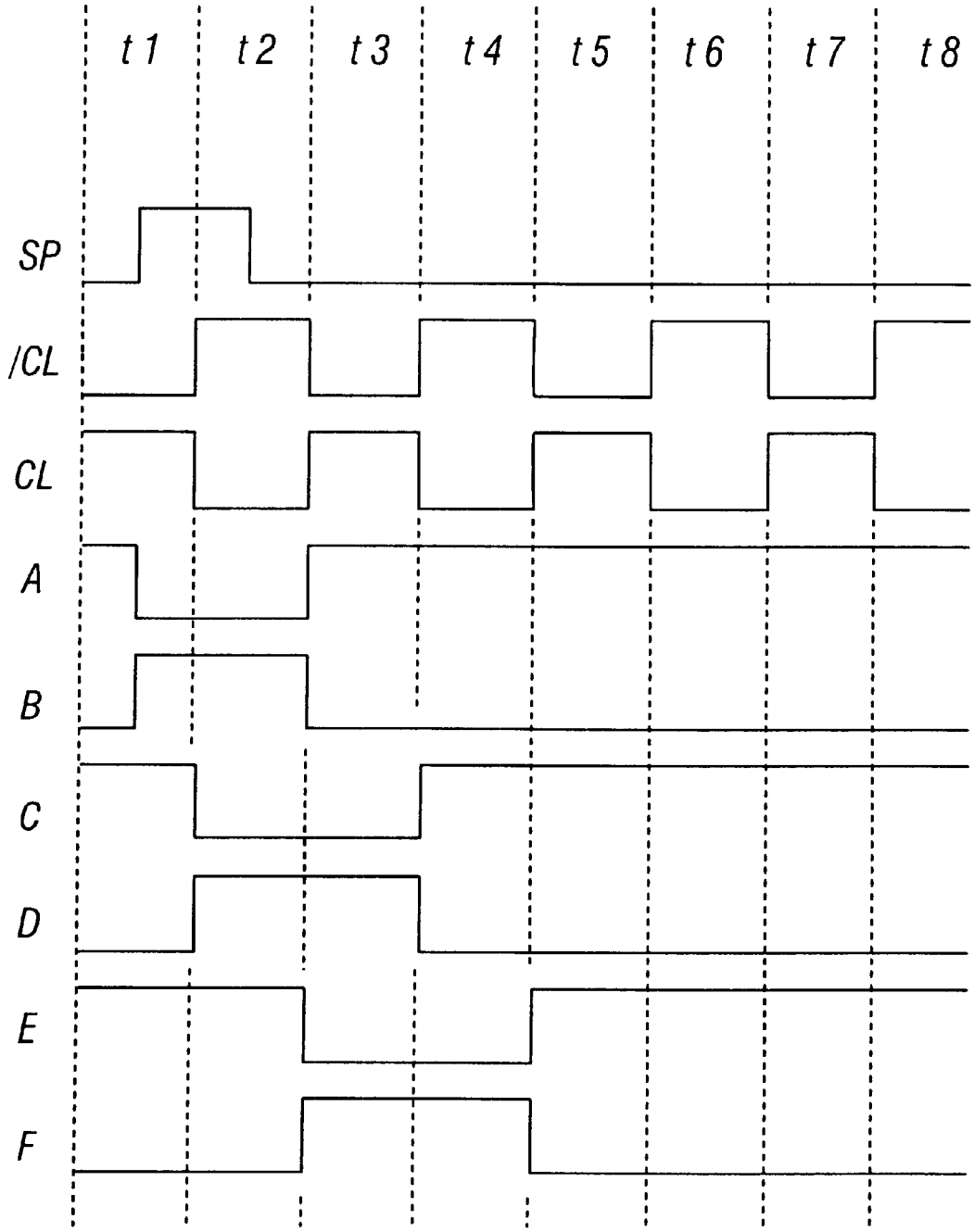
FIG. 25B (Prior Art)
Figure 26:
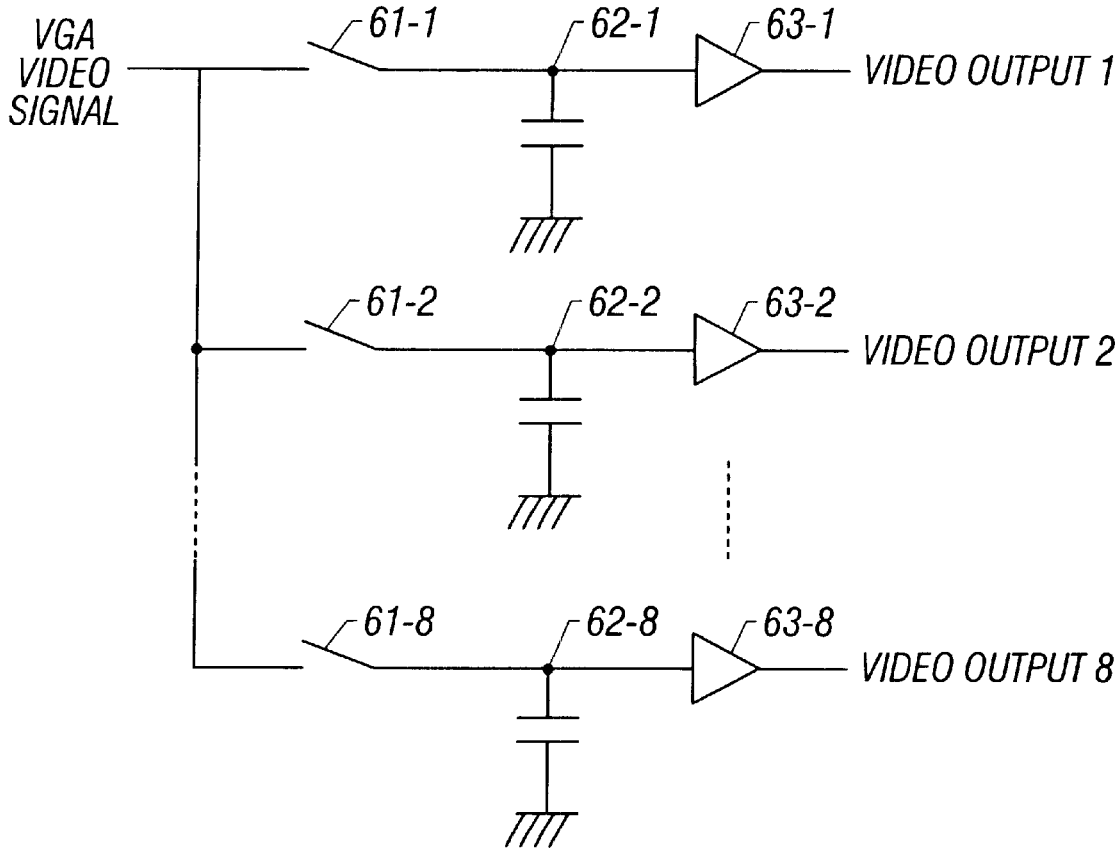
FIG. 26 (Prior Art)
FIG. 26 shows an external sampling circuit.
Figure 27:
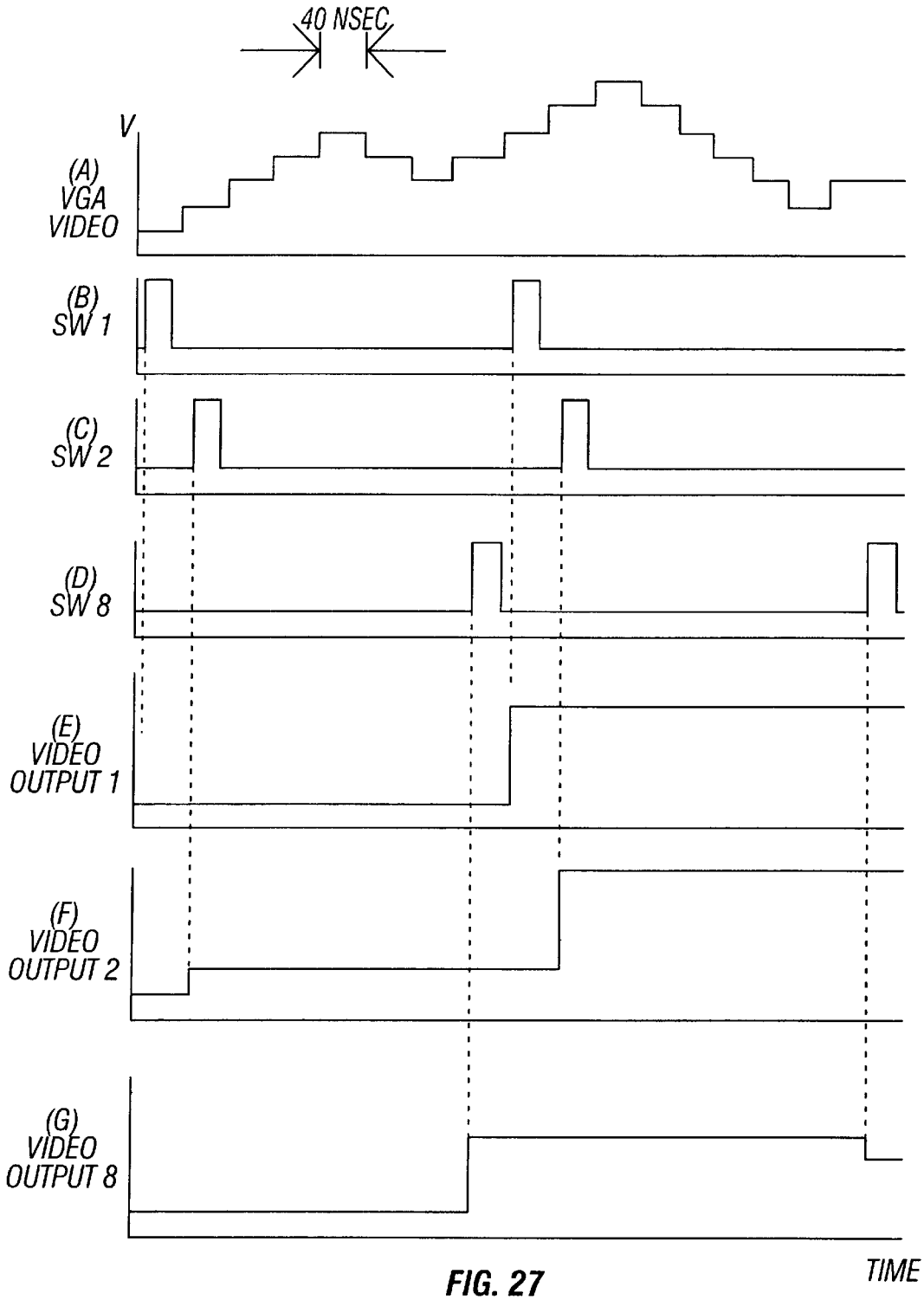
FIG. 27 (Prior Art)
FIG. 27 is a timing chart of the external sampling circuit of FIG. 26.
Figure 28:
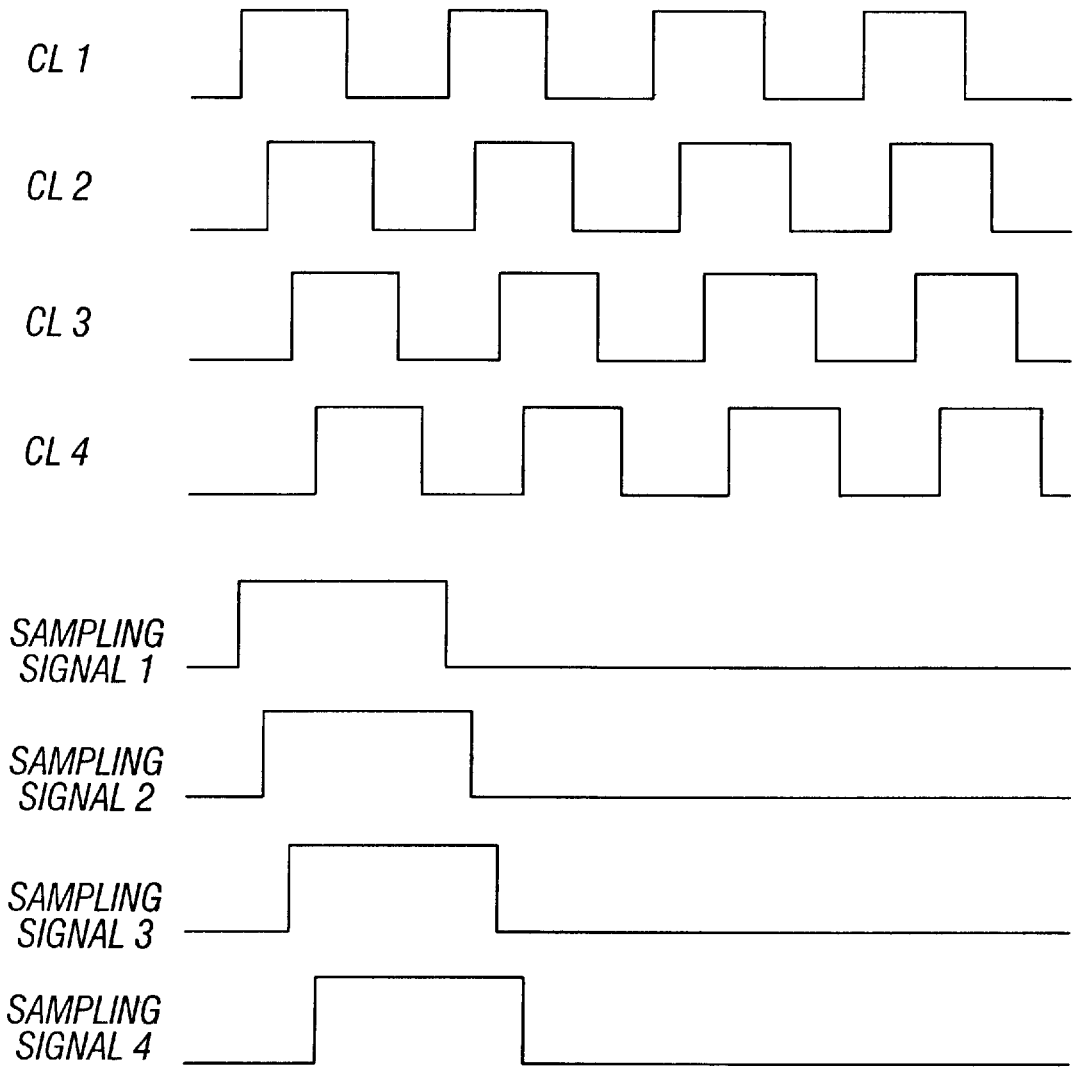
FIG. 28 (Prior Art)
FIG. 28 is a timing chart of a four-phase clock type sampling method.
Figure 29A:
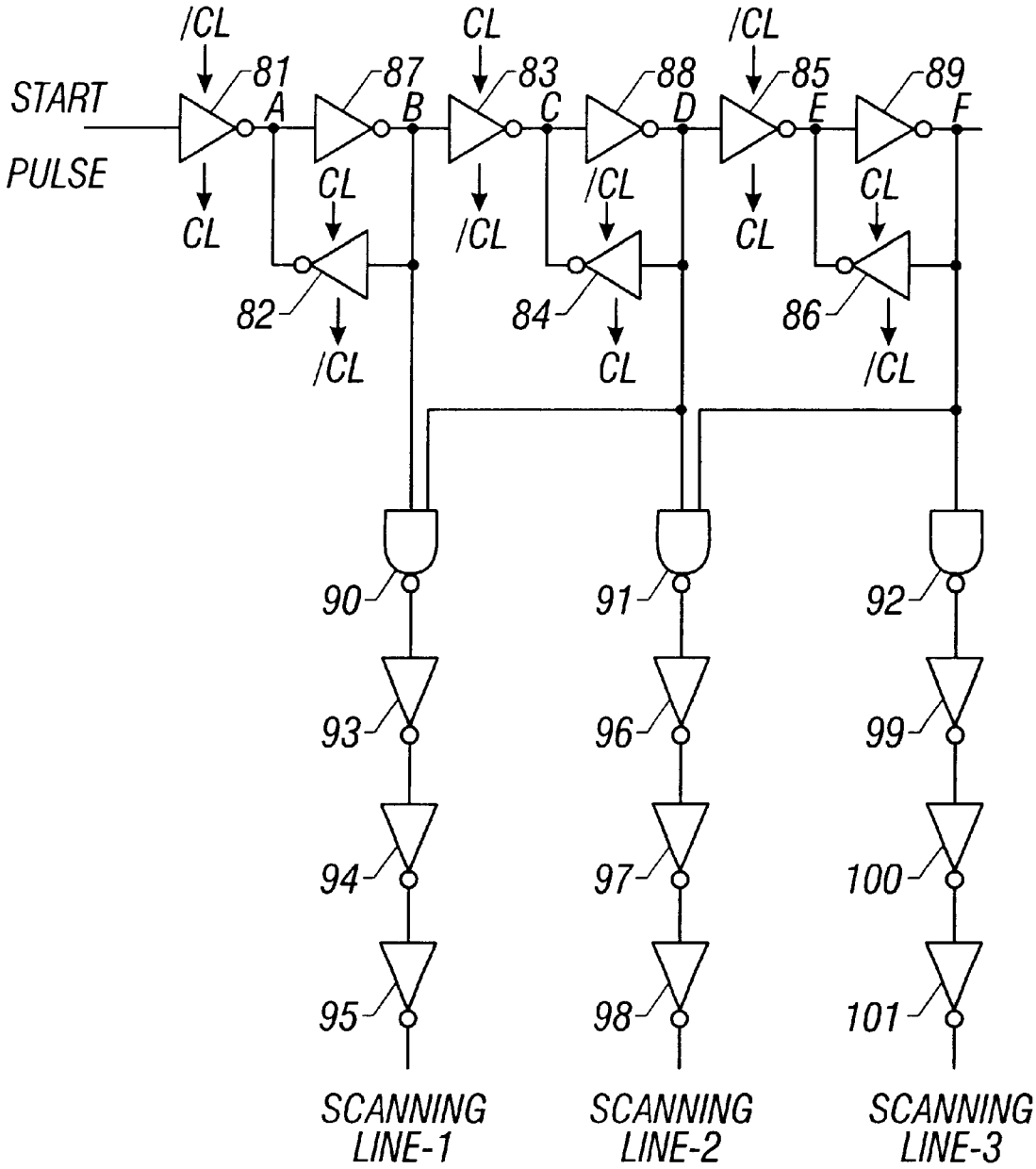
FIG. 29A (Prior Art)
FIGS. 29A and 29B are a block diagram and a timing chart, respectively, of a scanning line driver circuit.
Figure 29B:
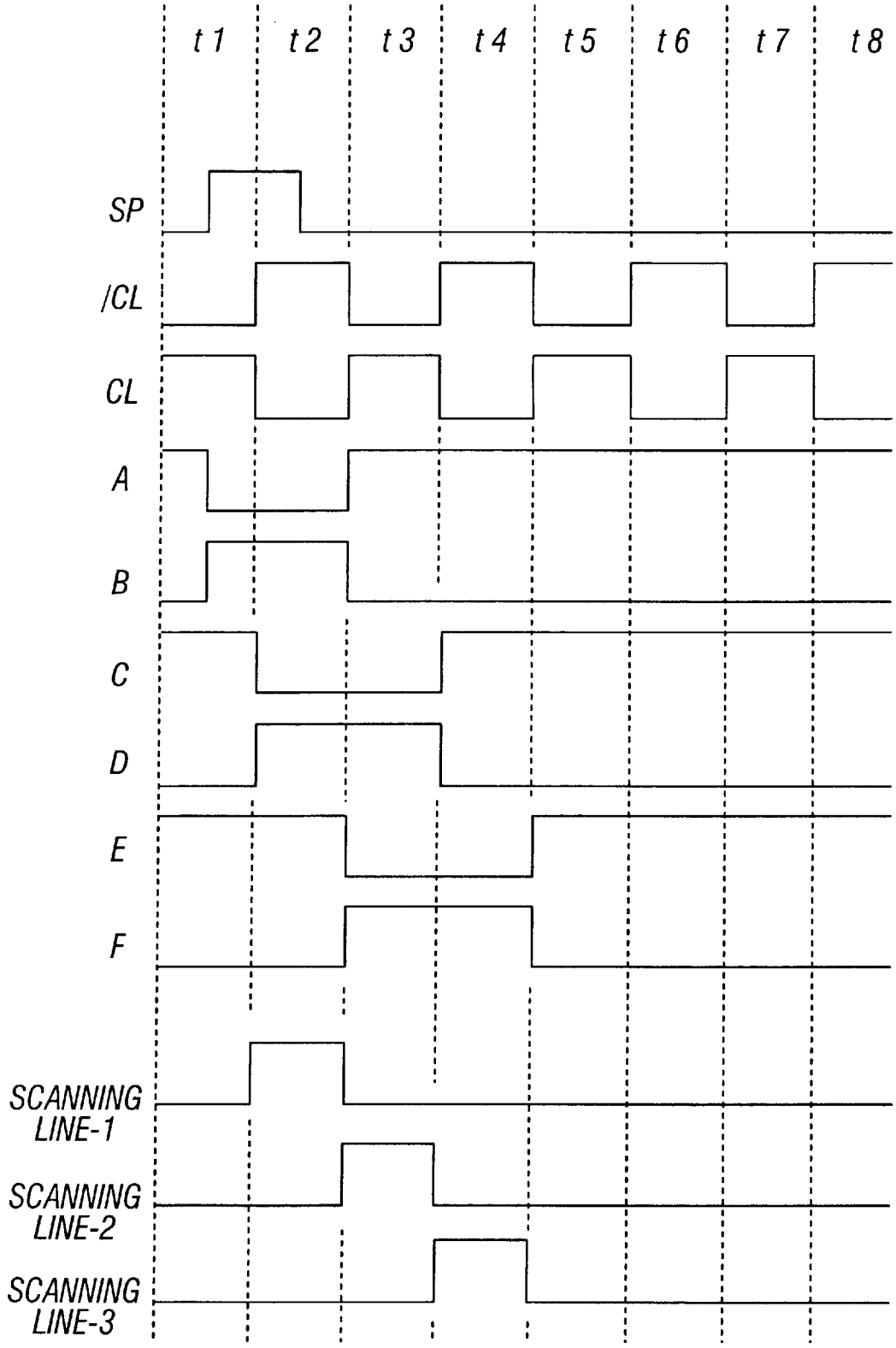
FIG. 29B (Prior Art)
Figure 30:
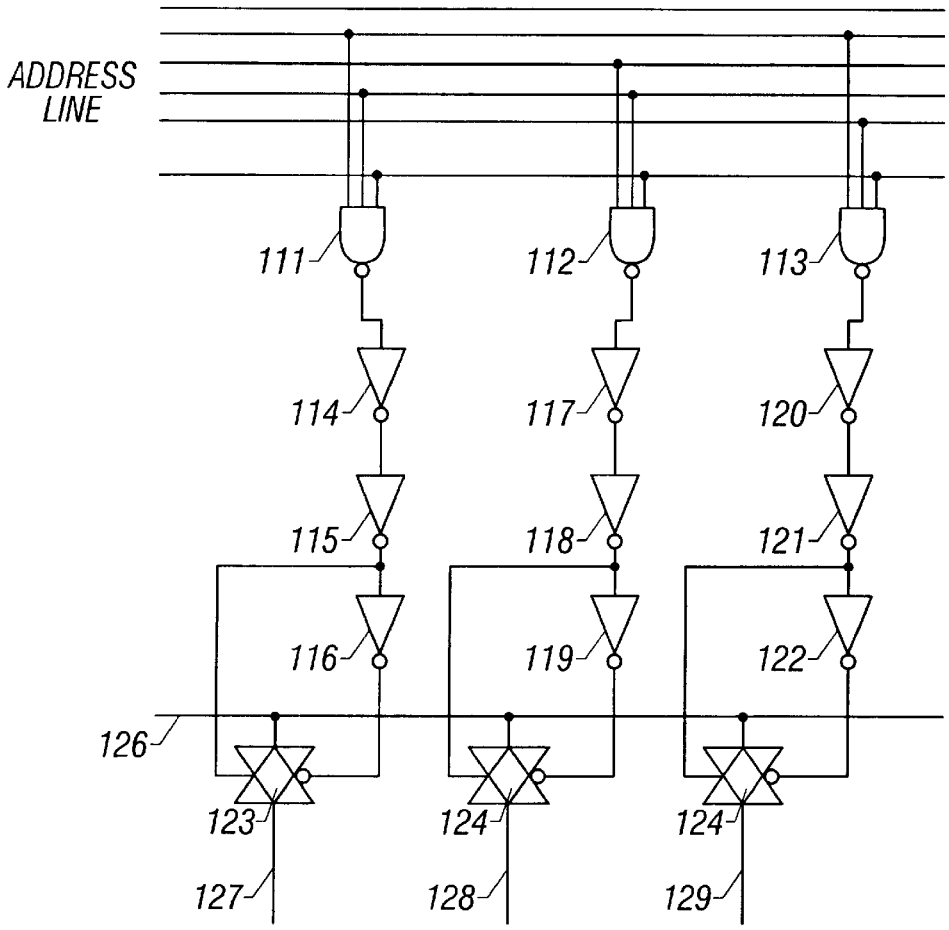
FIG. 30 (Prior Art)
FIG. 30 is a block diagram of a decoder-type signal line driver circuit.
Figure 31:
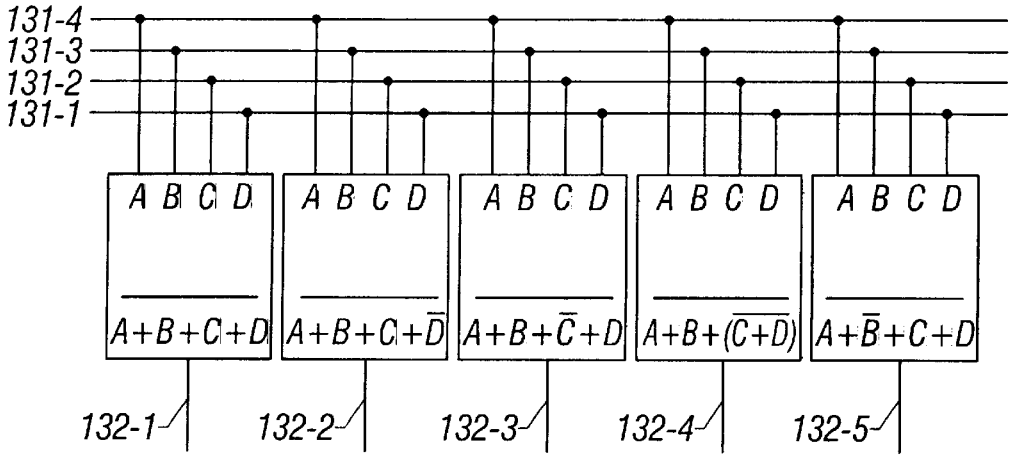
FIG. 31 (Prior Art)
FIG. 31 is a circuit diagram of an example of a scanning circuit constituting a signal line driver circuit or a scanning line driver circuit that is used in a matrix-type image display device.
Figure 32:
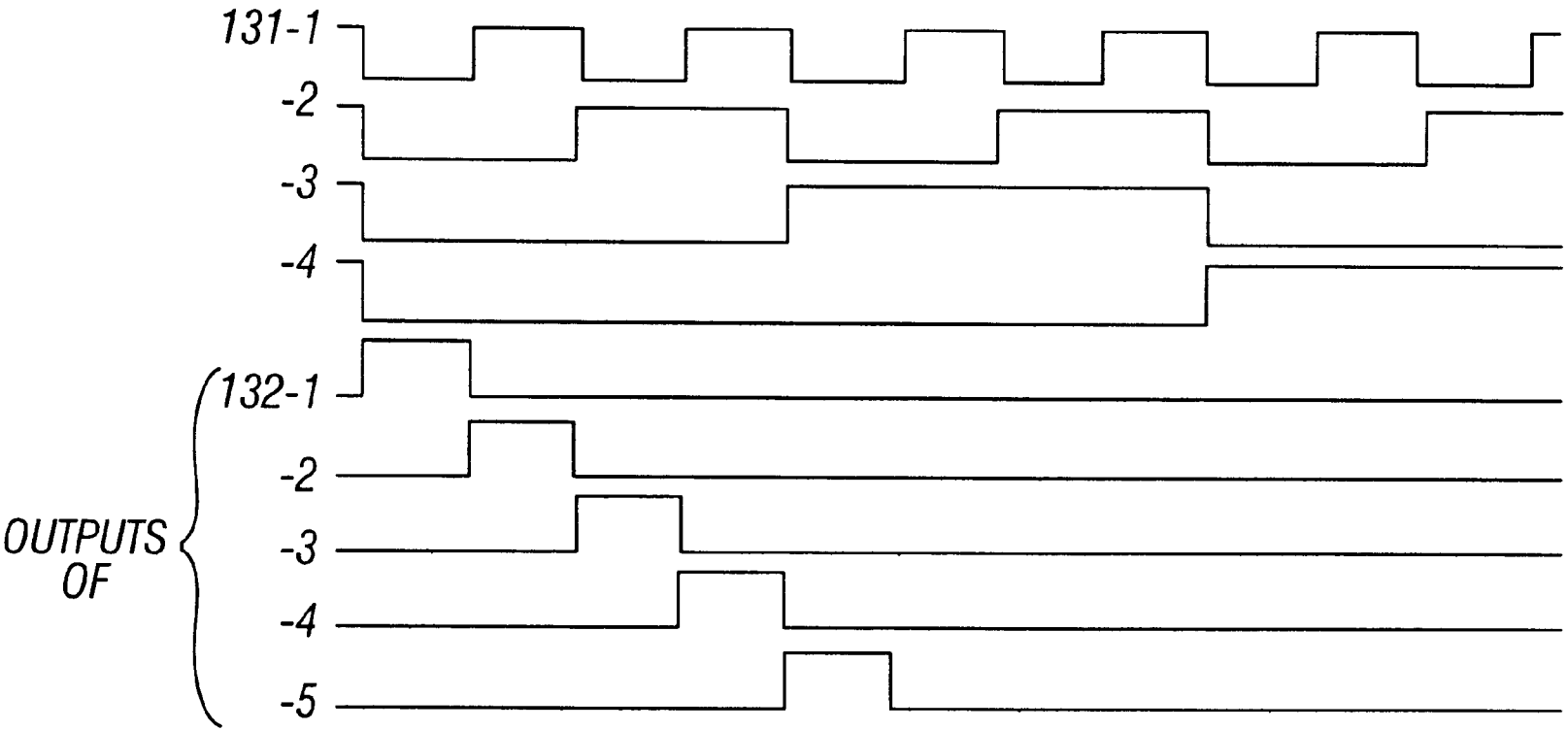
FIG. 32 (Prior Art)
FIG. 32 is a timing chart of the scanning circuit of FIG. 31.

Further, a silicon nitride film 1224 of 1,000–3,000 Å in thickness is formed by plasma CVD as a passivation film, and then etched to form a contact hole that reaches the electrode 1223 of the pixel TFT. Finally, an ITO (indium tin oxide) film of 500–1,500 Å in thickness is formed by sputtering, and etched to form a pixel electrode 1225. Thus, the peripheral driver circuits and the active matrix circuit are formed in an integral manner. (FIG. 19F)

As described above, in the liquid crystal display device according to the invention, the number of address signal lines of the decoder circuit can be reduced by selectively driving the matrix signal lines by using the multi-phase clock signals and the decoder circuit in combination. As a result, the area occupied by the driver circuit as well as the crosstalk between wiring lines can be reduced, so that a higher quality display device can be realized.

The invention can reduce, with a relatively simple circuit configuration, the number of signal lines required by a scanning circuit which constitutes at least one of the data signal line driver circuit and the scan signal line driver circuit for driving a matrix-type image display device, thereby decreasing the circuit scale and the power consumption. In addition, by using such a scanning circuit in at least one of the data signal line driver circuit and the scan signal line driver circuit, glitches can be prevented from appearing on the outputs of the scanning circuit, whereby superior display images can be obtained.

What is claimed is:

1. An active matrix display device comprising:

a substrate having an insulating surface;

a plurality of pixel electrodes arranged in a matrix form over said substrate;

a plurality of switching elements electrically connected to said pixel electrodes wherein each of said switching elements comprises at least one first thin film transistor formed over said substrate;

a driver circuit comprising a plurality of second thin film transistors formed over said substrate for driving said plurality of switching elements;

a level shift circuit formed over said substrate for amplifying clock signals to be inputted to said driver circuit.

2. An active matrix device according to claim 1 wherein each of said first and second thin film transistors has an active layer comprising polysilicon.

3. An active matrix device according to claim 1 wherein said clock signals are multi-phase clock signals.

4. An active matrix device according to claim 1 wherein said driver circuit includes a decoder circuit.

5. An active matrix display device comprising:

a substrate having an insulating surface;

a plurality of pixel electrodes arranged in a matrix form over said substrate;

a plurality of Switching elements electrically connected to said pixel electrodes wherein each of said switching elements comprises at least one first thin film transistor formed over said substrate;

a frequency divider circuit comprising a plurality of second thin film transistors formed over said substrate; and a level shift circuit formed over said substrate for amplifying clock signals to be inputted to said frequency divider circuit.

6. An active matrix device according to claim 5 wherein each of said first and second thin film transistors has an active layer comprising polysilicon.

7. An active matrix device according to claim 5 wherein said clock signals are multi-phase clock signals.

8. An active matrix device according to claim 5 further comprising a decoder circuit.

9. An active matrix display device comprising:

a substrate having an insulating surface;

a plurality of pixel electrodes arranged in a matrix form over said substrate;

a plurality of switching elements electrically connected to said pixel electrodes wherein each of said switching elements comprises at least one first thin film transistor formed over said substrate;

a counter circuit comprising a plurality of second thin film transistors formed over said substrate; and a level shift circuit formed over said substrate for amplifying clock signals to be inputted to said counter circuit.

10. An active matrix device according to claim 9 wherein each of said first and second thin film transistors has an active layer comprising polysilicon.

11. An active matrix device according to claim 10 further comprising a decoder circuit.

12. An active matrix display device comprising:

a substrate having an insulating surface;

a plurality of pixel electrodes arranged in a matrix form over said substrate;

a plurality of switching elements electrically connected to said pixel electrodes wherein each of said switching elements comprises at least one first thin film transistor formed over said substrate;

a driver circuit comprising a plurality of second thin film transistors formed over said substrate for driving said plurality of switching elements;

a synchronous counter circuit operationally connected to said driver circuit, said synchronous counter circuit comprising a plurality of third thin film transistors formed over said substrate; and a level shift circuit formed over said substrate for amplifying clock signals to be inputted to the synchronous counter circuit.

13. The active matrix display device according to claim 12 wherein each of said first, second and third thin film transistors has an active layer comprising polysilicon.

14. An active matrix display device comprising:

a substrate having an insulating surface;

a plurality of pixel electrodes arranged in a matrix form over said substrate;

a plurality of switching elements electrically connected to said pixel electrodes wherein each of said switching elements comprises at least one first thin film transistor formed over said substrate;

a driver circuit comprising a plurality of second thin film transistors formed over said substrate for driving said plurality of switching elements;

a frequency divider circuit operationally connected to said driver circuit, said frequency divider circuit comprising a plurality of third thin film transistors formed over said substrate; and a level shift circuit formed over said substrate for amplifying clock signals to be inputted to the synchronous counter circuit.

15. The active matrix display device according to claim 14 wherein each of said first, second and third thin film transistors has an active layer comprising polysilicon.

* * * * *